US007138950B2

(12) United States Patent
Fukushima et al.

(10) Patent No.: US 7,138,950 B2
(45) Date of Patent: Nov. 21, 2006

(54) ANTENNA AND ELECTRONIC EQUIPMENT USING THE SAME

(75) Inventors: Susumu Fukushima, Katano (JP); Hideki Nanba, Kyoto (JP); Hiroshi Kuroda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 271 days.

(21) Appl. No.: 10/689,845

(22) Filed: Oct. 22, 2003

(65) Prior Publication Data

US 2004/0130494 A1 Jul. 8, 2004

(30) Foreign Application Priority Data

| | | |
|---|---|---|
| Oct. 22, 2002 | (JP) | 2002-306928 |
| Jan. 30, 2003 | (JP) | 2003-021816 |
| May 26, 2003 | (JP) | 2003-147245 |
| Sep. 1, 2003 | (JP) | 2003-308542 |

(51) Int. Cl.
*H01Q 1/24* (2006.01)

(52) U.S. Cl. ..... 343/702

(58) Field of Classification Search ..... 343/702, 343/700 MS, 873, 846, 829, 848
See application file for complete search history.

(56) References Cited

U.S. PATENT DOCUMENTS

| | | | | |
|---|---|---|---|---|
| 5,696,517 | A | 12/1997 | Kawahata et al. | |
| 5,748,149 | A * | 5/1998 | Kawahata | 343/700 MS |
| 5,760,746 | A | 6/1998 | Kawahata | |
| 5,861,854 | A * | 1/1999 | Kawahata et al. | 343/702 |
| 5,952,970 | A * | 9/1999 | Kawahata | 343/700 MS |
| 6,100,849 | A | 8/2000 | Tsubaki et al. | |
| 6,177,908 | B1 | 1/2001 | Kawahata et al. | |
| 6,323,811 | B1 * | 11/2001 | Tsubaki et al. | 343/700 MS |
| 6,419,506 | B1 * | 7/2002 | Jones et al. | 439/131 |
| 2002/0057138 | A1 | 5/2002 | Takagl et al. | |
| 2002/0145569 | A1 | 10/2002 | Onaka et al. | |

FOREIGN PATENT DOCUMENTS

| | | |
|---|---|---|
| JP | 09-98015 | 4/1997 |
| JP | 11-74721 | 3/1999 |
| JP | P2000-151258 | 5/2000 |
| JP | P2000-278028 | 10/2000 |
| JP | P2002-290141 | 10/2002 |
| JP | P2002-290143 | 10/2002 |
| JP | P2002-299945 | 10/2002 |
| WO | WO 01/18909 | 3/2001 |

* cited by examiner

*Primary Examiner*—Shih-Chao Chen
*Assistant Examiner*—Huedung X. Cao
(74) *Attorney, Agent, or Firm*—McDermott Will & Emery LLP

(57) ABSTRACT

The objective of the present invention is to realize, in an antenna and an electronic equipment using the same, miniaturization of that antenna. To achieve said objective, an antenna electrode (19) is provided on the surface of the main body (18), a grounding electrode (20) is provided on the back face, and a signal electrode (21) is provided on the circumferential face, the antenna electrode (19) being different in length at the X axis from the Y axis. This enables to construct a broad-band antenna with a single piece of antenna, contributing to miniaturization of the antenna.

14 Claims, 47 Drawing Sheets

20a
18
λ2

19

18
18
45°
20a
λ1
20a
21

18
20a
21a

20

FIG. 22A
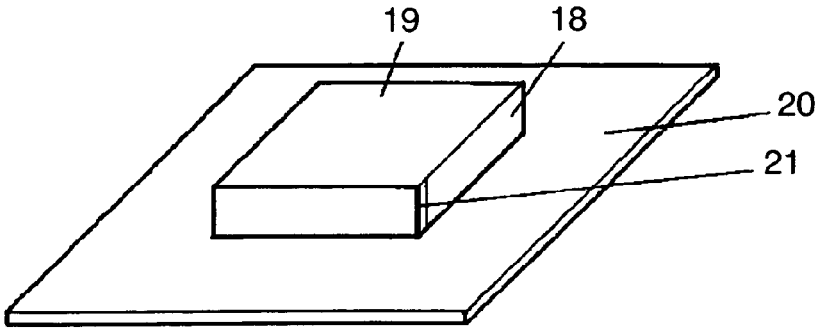
FIG. 22B
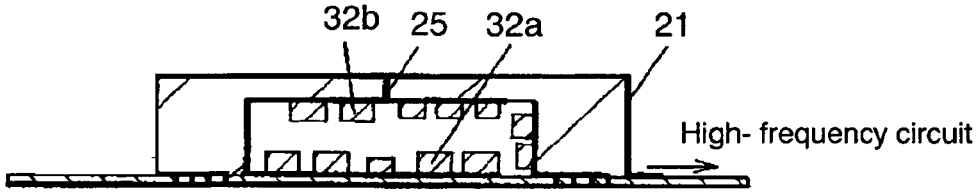
FIG. 22D
FIG. 21E
FIG. 21C
FIG. 21F
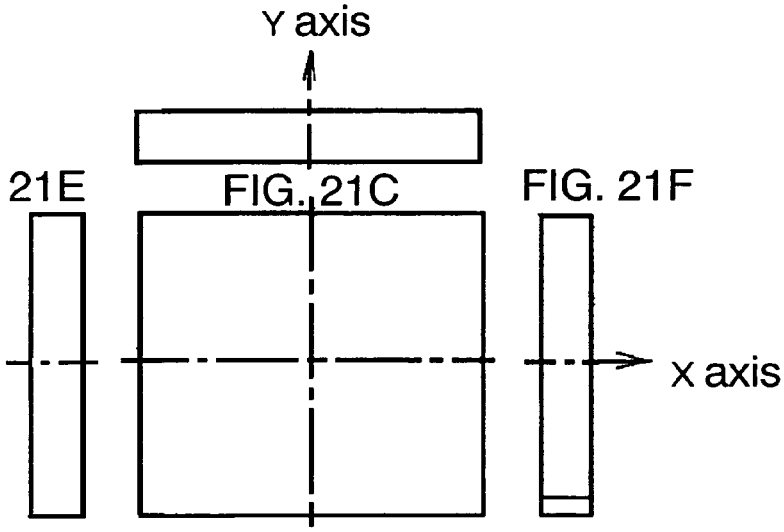
FIG. 22G
FIG. 22H
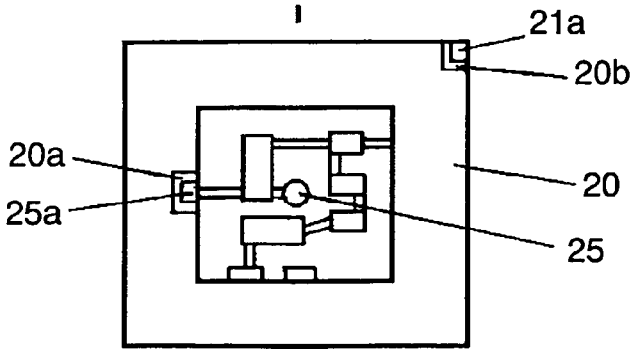

FIG. 23A
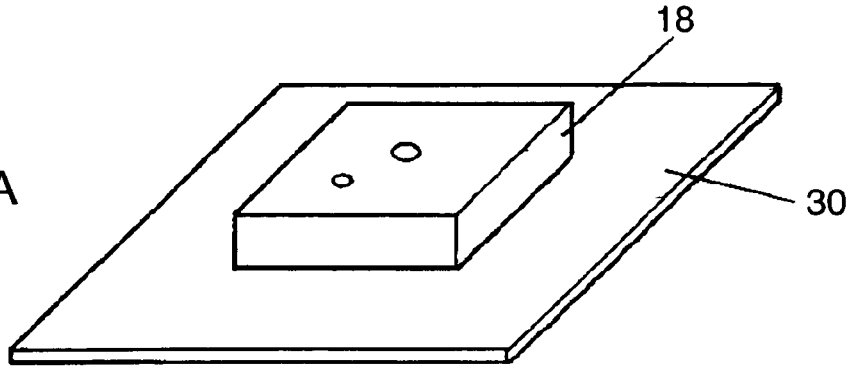
FIG. 23B
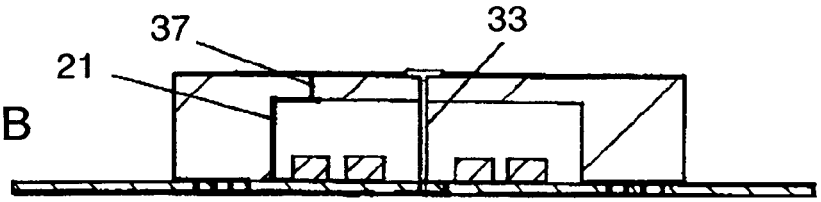
FIG. 23D
FIG. 23E
FIG. 23C
FIG. 23F
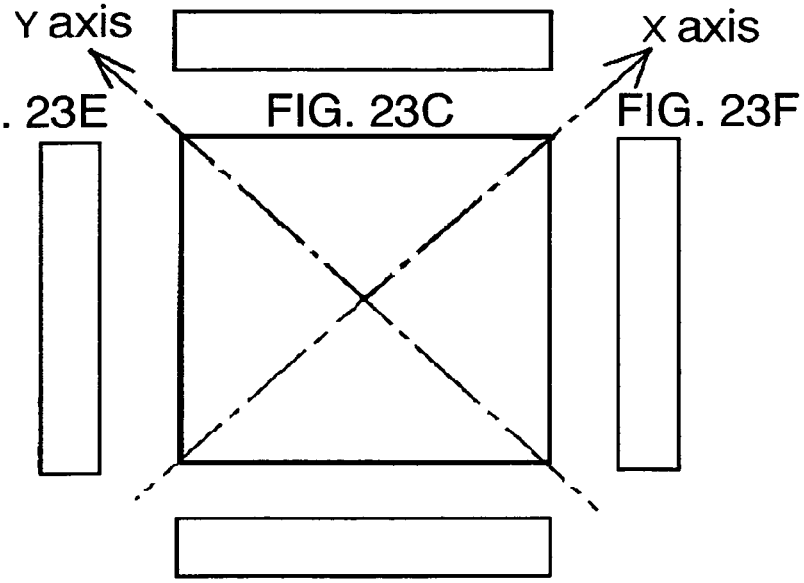
FIG. 23G
FIG. 23H
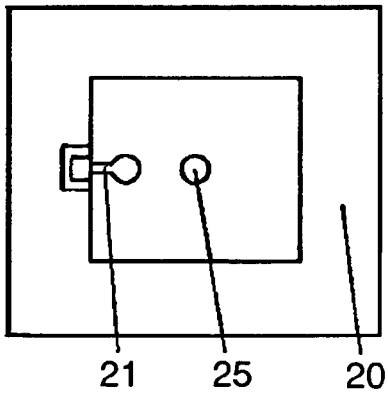

FIG. 24A
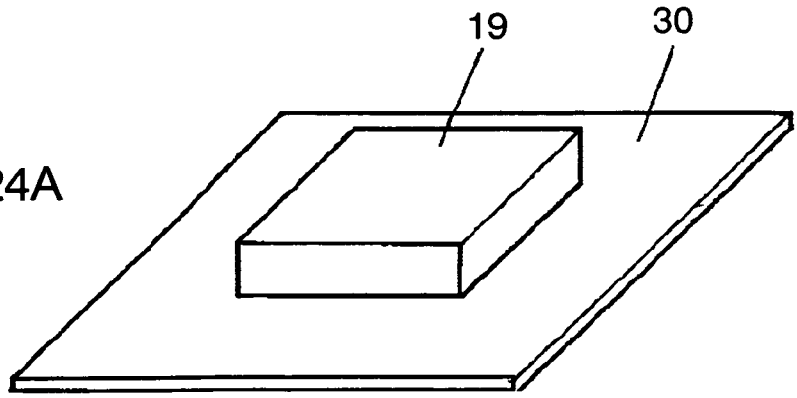
FIG. 24B
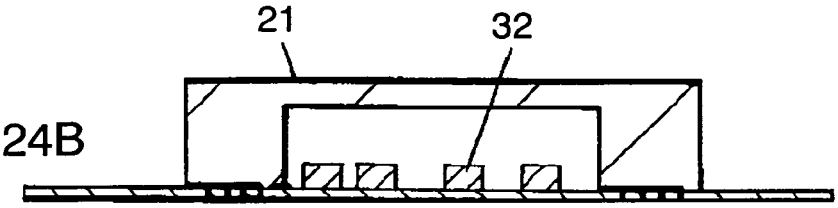
FIG. 24D
FIG. 24E
FIG. 24C
FIG. 24F
FIG. 24G
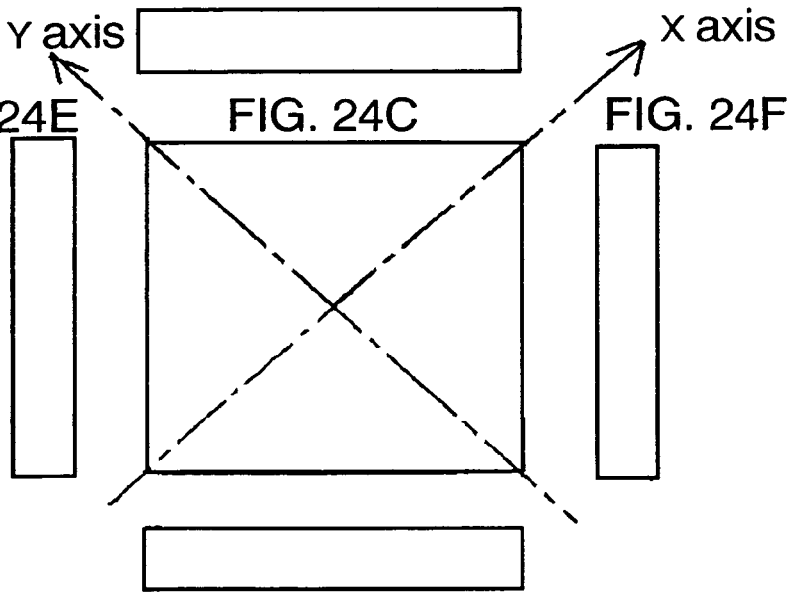
FIG. 24H
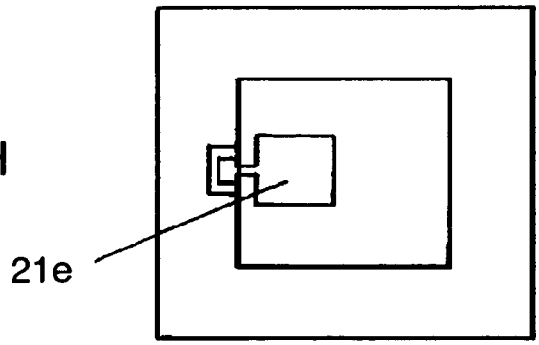

FIG. 25A
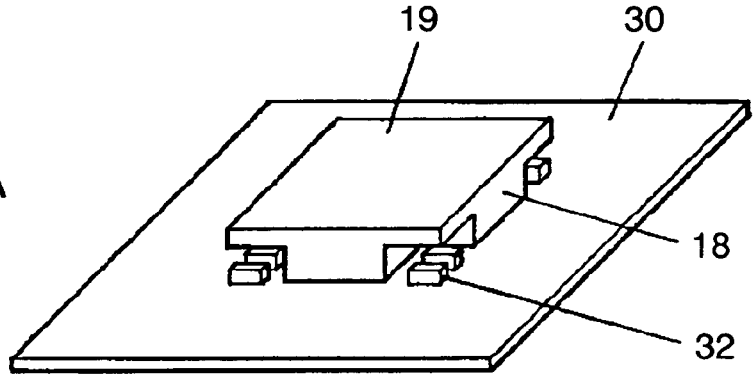
FIG. 25B
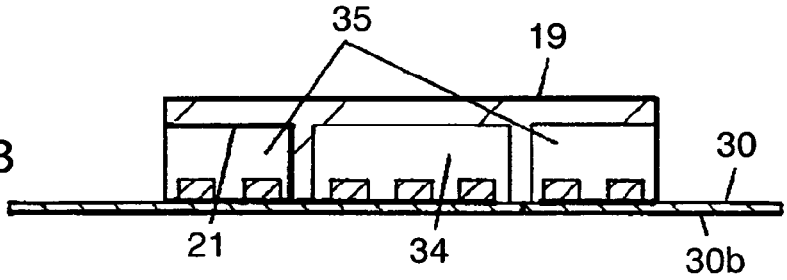
FIG. 25D
FIG. 25E
FIG. 25C
FIG. 25F
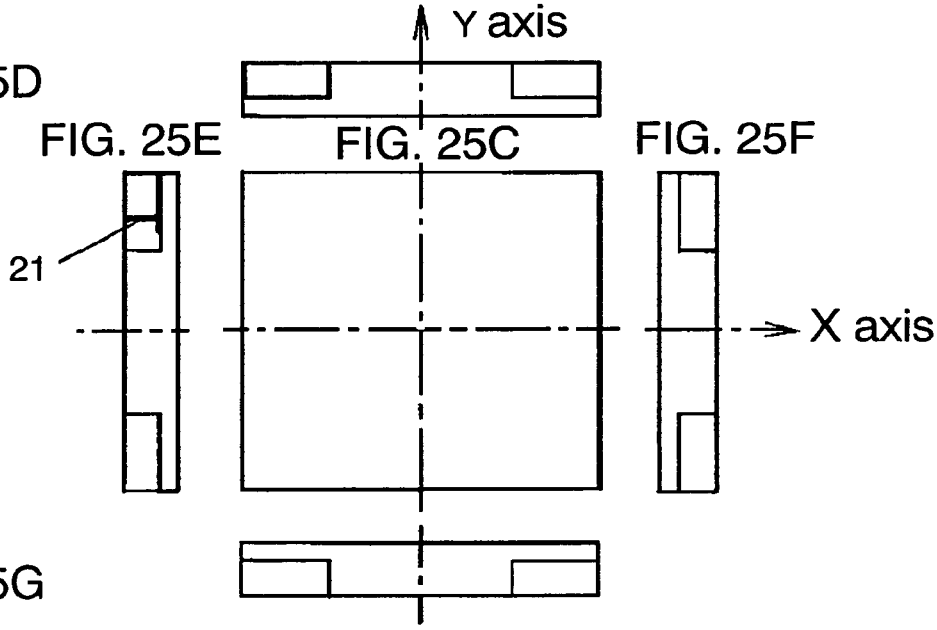
FIG. 25G
FIG. 25H
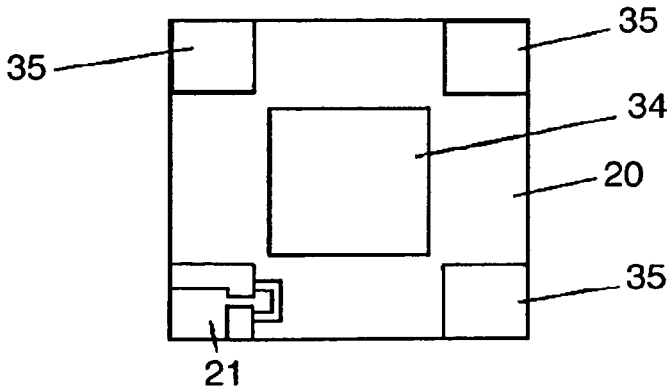

FIG. 26A
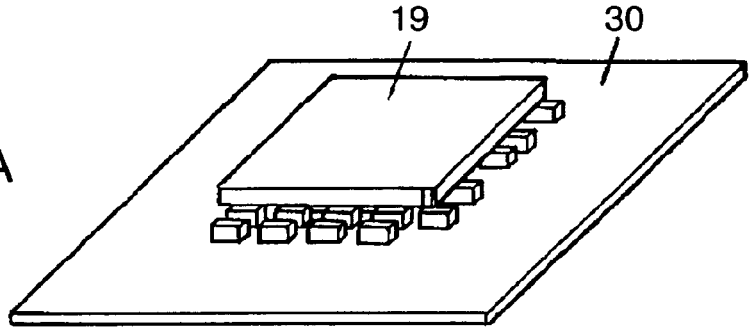
FIG. 26B
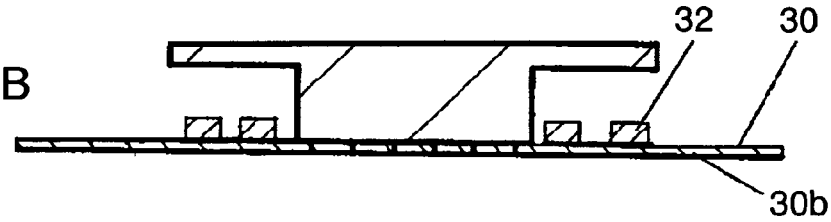
FIG. 26D
FIG. 26E
FIG. 26C
FIG. 26F
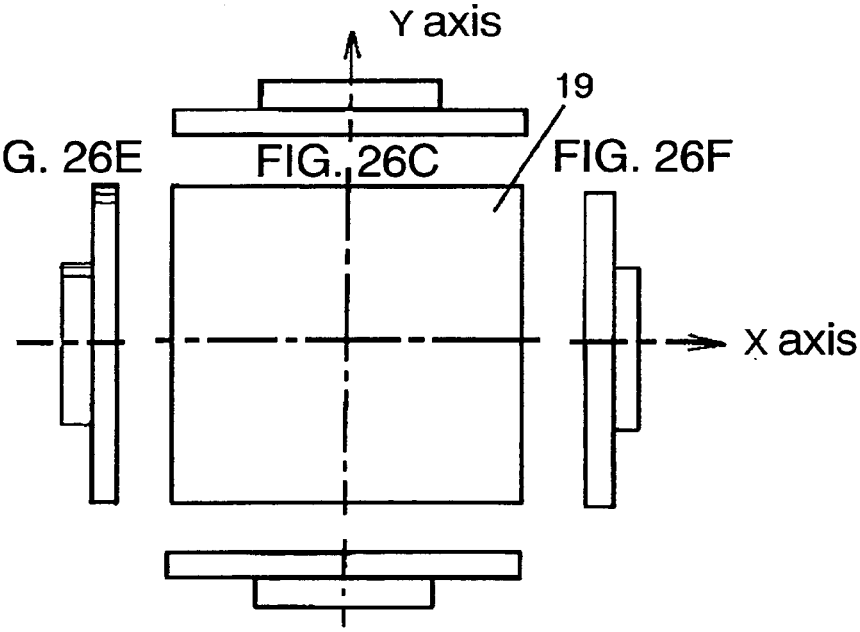
FIG. 26G
FIG. 26H
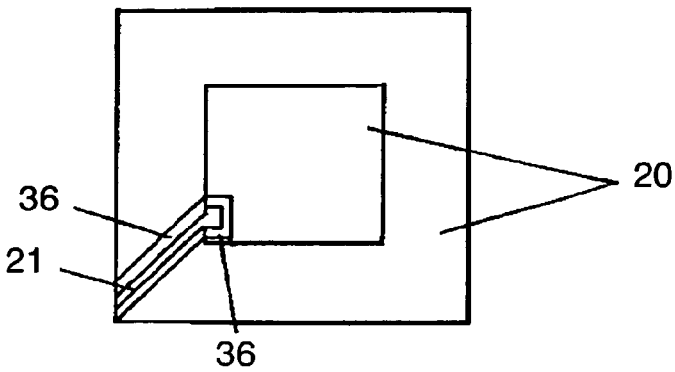

FIG. 27A
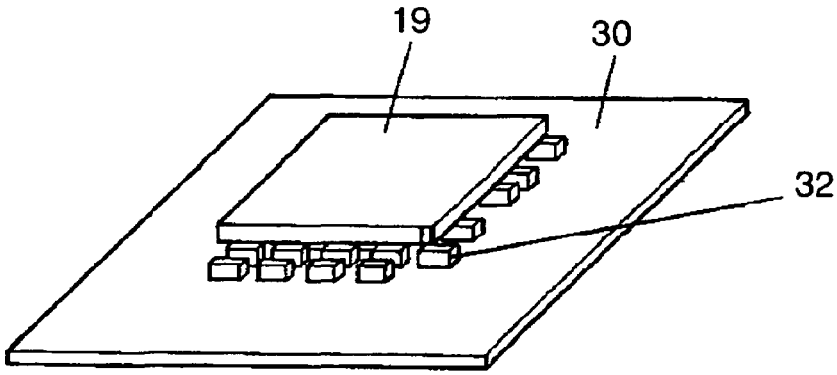
FIG. 27B
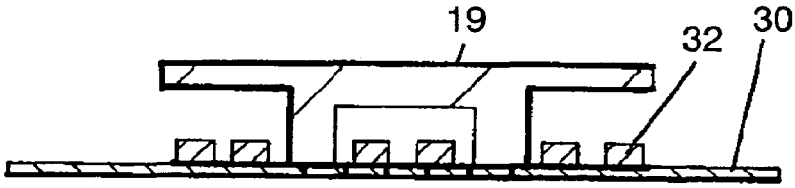
FIG. 27D
FIG. 27E
FIG. 27C
FIG. 27F
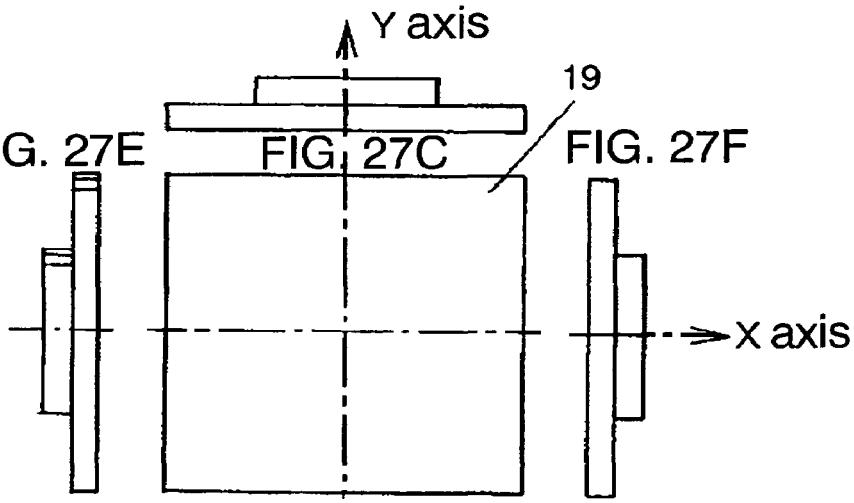
FIG. 27G
FIG. 27H
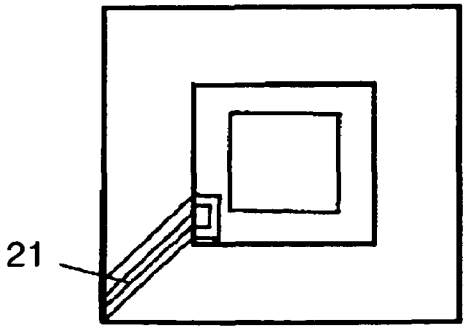

FIG. 28A
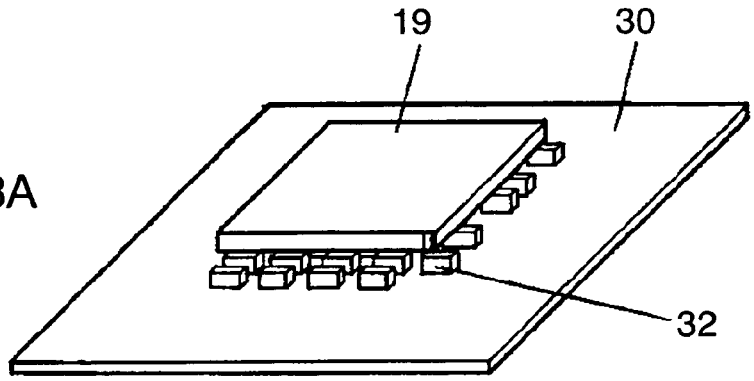
FIG. 28B
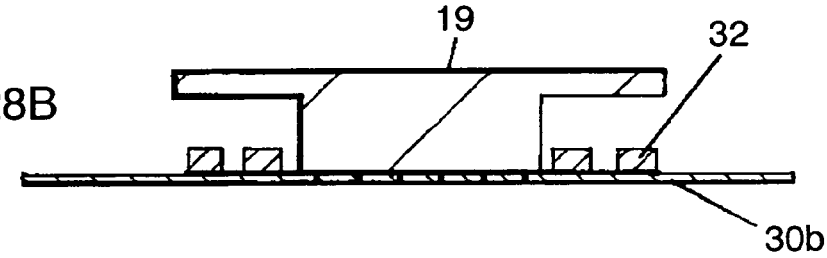
FIG. 28D
FIG. 28E
FIG. 28C
FIG. 28F
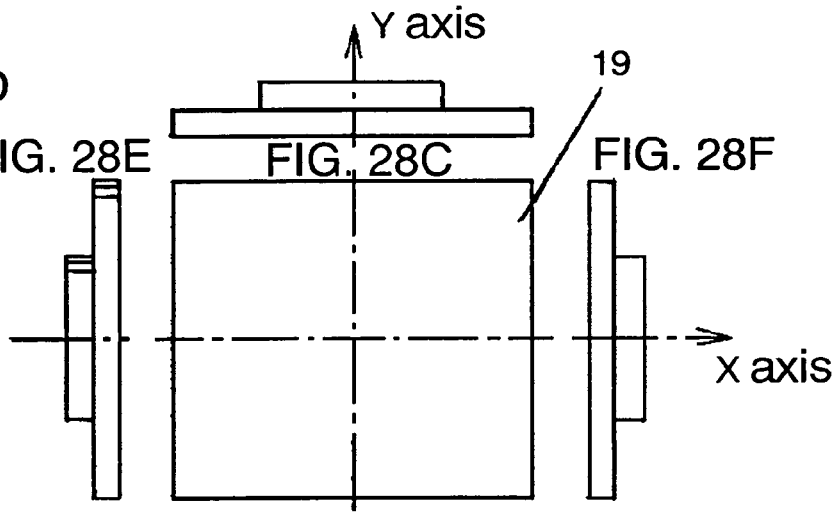
FIG. 28G
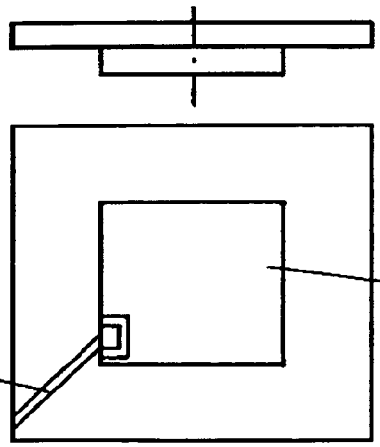
FIG. 28H

ANTENNA AND ELECTRONIC EQUIPMENT USING THE SAME

FIELD OF THE INVENTION

This invention relates an antenna and an electronic equipment using the same.

BACKGROUND OF THE INVENTION

Among the conventional types of electronic equipment, such as personal computers, etc. for example, there are some which enable to provide various kinds of communication services with the personal computer, by inserting a communication module in a slot portion of that personal computer. As communication module, one which is realized by comprising an antenna inside, to enable such communication, is introduced on the Japanese Laid-Open Patent Publication No. H9-98015, for example.

A problem with conventional electronic equipment is a large antenna size. Namely, in the communication system which became popular in recent years, the working frequency range is widened and, and the antenna must cover a broad band area to fully meet the service requirements of such communication system. The volume of antenna must inevitably be increased, for realizing such a broad-band antenna.

SUMMARY OF THE INVENTION

The objective of the present invention is to reduce the antenna size.

To achieve said objective, the present invention is an antenna comprising a main body having a flat part, an antenna electrode provided on the flat part of this body, a signal electrode electrically connected to this antenna electrode, and a grounding electrode provided in a way to face said antenna electrode of the main body, said antenna electrode being different in length at the X axis from the Y axis which is orthogonal or about orthogonal to it. By utilizing the effect that a single antenna has different resonance characteristics if only the antenna electrode is realized in different lengths at its X axis and Y axis, it becomes possible to construct a broad-band antenna through a synthesis of those resonance characteristics. Thus a broad-band antenna can be realized from a single antenna, contributing to reduction of antenna size.

Moreover, the antenna according to the present invention is an antenna comprising a grounding board composed of a conductor plate, and a radiation board composed of a conductor plate provided facing this grounding board, this radiation board being different in length at its X axis and Y axis either orthogonal or about orthogonal to it and at about half wave of the working frequency range. Furthermore, the antenna according to the present invention is an antenna constructed by having a feed conductor, which is provided at an end part on straight lines having an angle of about 45° against the X axis and Y axis of the radiation board at their intersection, and bent condownward in a way to have an angle of about 90° against the radiation board.

This makes it possible to realize an antenna by processing a flat conductor board into a proper shape by either punching or etching and bending the feed conductor portion by means of press working, etc., and realize an inexpensive and high-quality antenna through simplification of the antenna manufacturing method.

Still more, the antenna according to the present invention enables to realize reduction of antenna size, by optimizing the position of arrangement of the radiation board against the grounding board and the position of arrangement of the feed conductor.

Yet more, the electronic equipment according to the present invention comprises a circuit board and an antenna mounted on the surface of this circuit board, said antenna comprising a main body having a flat part, an antenna electrode provided on the flat part of this body, and a grounding electrode provided on the main body portion facing this antenna electrode, said antenna electrode being constructed to be different in length at the X axis from the Y axis orthogonal or about orthogonal to this X axis, said circuit board further comprising a signal electrode, wherein this signal electrode is made to face the no-electrode part of the grounding electrode provided on the grounding electrode of said antenna.

Since the antenna impedance can be controlled freely with a change in the position of no-electrode part of the grounding electrode facing the signal electrode of the circuit board, it becomes possible to design antennas in broad band by a simple method of changing the mounting position of the antenna.

BRIEF DESCRIPTION OF THE DRAWINGS

FIG. 4A is a perspective view of the surface side of the antenna according to a preferred embodiment of the present invention, while

FIG. 7A is a perspective view of the surface side of the antenna according to other preferred embodiment of the present invention, while

FIG. 21C is a top view of this antenna, FIG. 21E is a second side view of this antenna, FIG. 21F is a third side view of this antenna.

FIG. 22A is a perspective view of the antenna according to other preferred embodiment of the present invention, FIG. 22B is a sectional view of this antenna, FIG. 22C is a top view of this antenna, FIG. 22D is a first side view of this antenna, FIG. 22E is a second side view of this antenna, FIG. 22F is a third side view of this antenna, FIG. 22G is a fourth side view of this antenna, and FIG. 22H is a bottom view of this antenna.

FIG. 23A is a perspective view of the antenna according to other preferred embodiment of the present invention, FIG. 23B is a sectional view of this antenna, FIG. 23C is a top view of this antenna, FIG. 23D is a first side view of this antenna, FIG. 23E is a second side view of this antenna, FIG. 23F is a third side view of this antenna, FIG. 23G is a fourth side view of this antenna, and FIG. 23H is a bottom view of this antenna.

FIG. 24A is a perspective view of the antenna according to other preferred embodiment of the present invention, FIG. 24B is a sectional view of this antenna, FIG. 24C is a top view of this antenna, FIG. 24D is a first side view of this antenna, FIG. 24E is a second side view of this antenna, FIG. 24F is a third side view of this antenna, FIG. 24G is a fourth side view of this antenna, and FIG. 24H is a bottom view of this antenna.

FIG. 25A is a perspective view of the antenna according to other preferred embodiment of the present invention, FIG. 25B is a sectional view of this antenna, FIG. 25C is a top view of the antenna according to other preferred embodiment of the present invention, FIG. 25D is a first side view of this antenna according to other preferred embodiment of the present invention, FIG. 25E is a second side view of this antenna according to other preferred embodiment of the present invention, FIG. 25F is a third side view of this antenna according to other preferred embodiment of the present invention, FIG. 25G is a fourth side view of this antenna according to other preferred embodiment of the present invention, and FIG. 25H is a bottom view of this antenna according to other preferred embodiment of the present invention.

FIG. 26A is a perspective view of the antenna according to other preferred embodiment of the present invention, FIG. 26B is a sectional view of this antenna, FIG. 26C is a top view of this antenna, FIG. 26D is a first side view of this antenna, FIG. 26E is a second side view of this antenna, FIG. 26F is a third side view of this antenna, FIG. 26G is a fourth side view of this antenna, and FIG. 26H is a bottom view of this antenna.

FIG. 27A is a perspective view of the antenna according to other preferred embodiment of the present invention, FIG. 27B is a sectional view of this antenna, FIG. 27C is a top view of this antenna, FIG. 27D is a first side view of this antenna, FIG. 27E is a second side view of this antenna, FIG. 27F is a third side view of this antenna, FIG. 27G is a fourth side view of this antenna, and FIG. 27H is a bottom view of this antenna.

FIG. 28A is a perspective view of the antenna according to other preferred embodiment of the present invention, FIG. 28B is a sectional view of this antenna, FIG. 28C is a top view of this antenna, FIG. 28D is a first side view of this antenna, FIG. 28E is a second side view of this antenna, FIG. 28F is a third side view of this antenna, FIG. 28G is a fourth side view of this antenna, and FIG. 28H is a bottom view of this antenna.

FIG. 32A is a perspective view of the top face of the antenna according to other preferred embodiment of the present invention, while

FIG. 33A to FIG. 33C are impedance characteristic chart and a radiation characteristic chart.

FIG. 34A is a perspective view of the antenna according to other preferred embodiment of the present invention, while

FIG. 38A is a drawing showing the radiation pattern in the case where no inductor is loaded between the between the bottom end part of the rigid conductor and the grounding board, while

FIG. 43A, FIG. 43B and FIG. 43D are radiation characteristic charts of other preferred embodiment of the present invention in the case where the notch and the feed conductor position are changed, while

FIG. 46A is a front elevation of the electronic equipment according to other preferred embodiment of the present invention, while

DESCRIPTION OF THE PREFERRED EMBODIMENTS

One preferred embodiment of the present invention will be explained below with reference to drawings.

Figure 1:
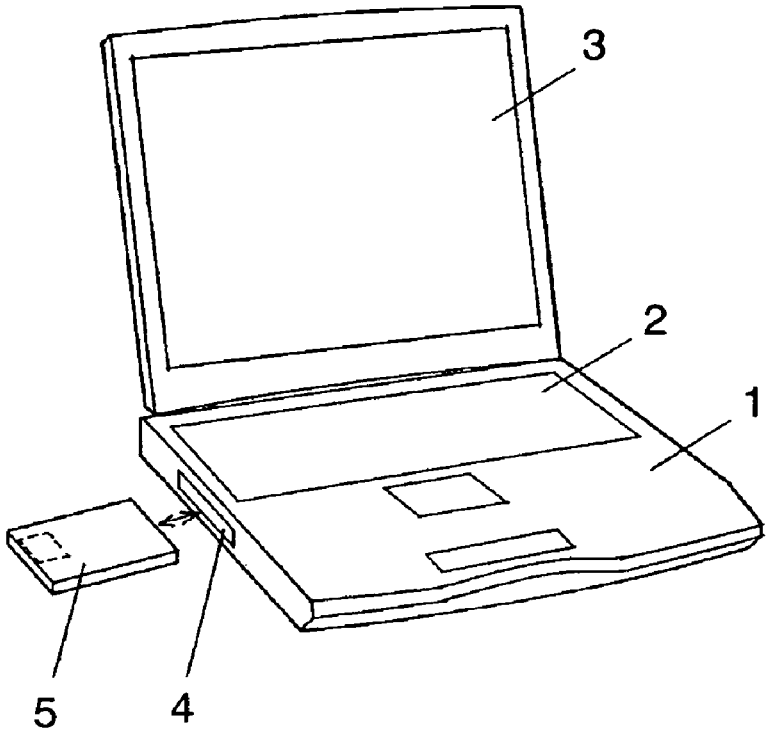
FIG. 1 is a perspective view of an electronic equipment using the antenna according to a preferred embodiment of the present invention.
Figure 2:
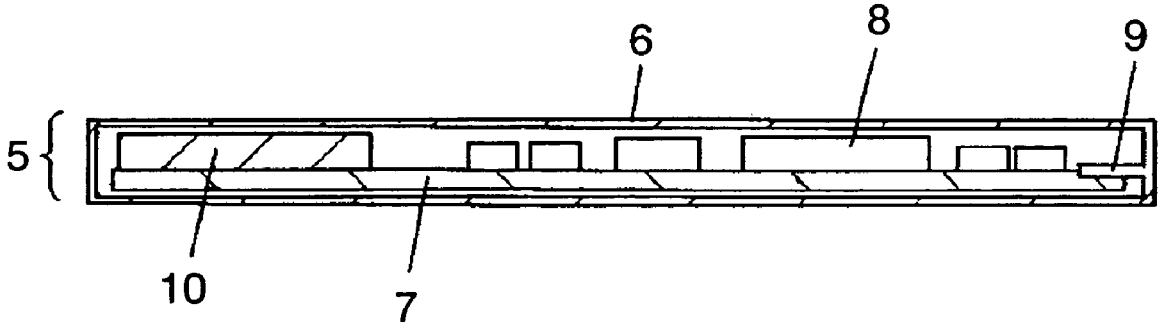
FIG. 2 is a sectional view of the main part of that electronic equipment.

In FIG. 1 and FIG. 2, the notebook personal computer 1 is provided with an input unit 2 and a display unit 3. Moreover, on the side face of the input unit 2 is provided a slot 4, in which to insert a communication module 5.

The communication module 5 is provided with a circuit board 7 in a flat body case 6, and on this circuit board 7 are mounted various kinds of electronic components 8 as shown in FIG. 2. Furthermore, in FIG. 2 as seen in the face, in the right side portion of the circuit board 7 is provided a connector 9 for obtaining electric connection by being inserted in the slot 4. In the same way, in FIG. 2 as seen in the face, an antenna 10 is provided in the left side portion of the circuit board 7.

Namely, in the case where the main body case 6 in FIG. 2 is inserted in the slot 4 in FIG. 1, the antenna 10 gets into a state protruding to outside from the slot 4, thereby enabling to perform transmission and reception of signals by utilizing this antenna 10.

Figure 3:
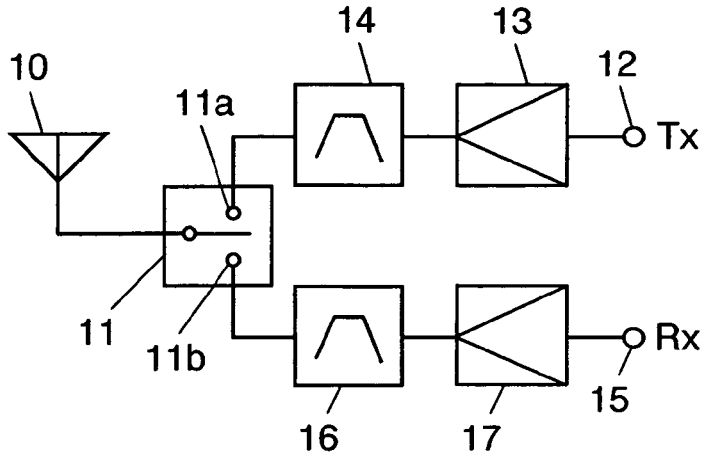
FIG. 3 is a block diagram of the circuit incorporated in the electronic equipment.

FIG. 3 indicates an example of block diagram of the circuit to be incorporated in the electronic equipment according to the present invention. In FIG. 3, the antenna 10 is connected to a switch 11, and to the contact 11*a* of the switch 11 are connected an amplifier 13 and a filter 14 toward a transmitting circuit 12, and to the contact 11*b* are further connected a filter 16 and an amplifier 17 toward a receiving circuit 15. This enables to establish communication with other electronic equipment through the antenna 10.

Figure 4A:
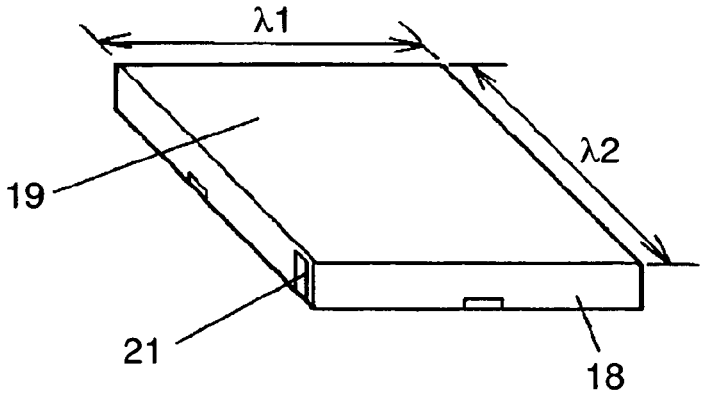
Figure 4B:
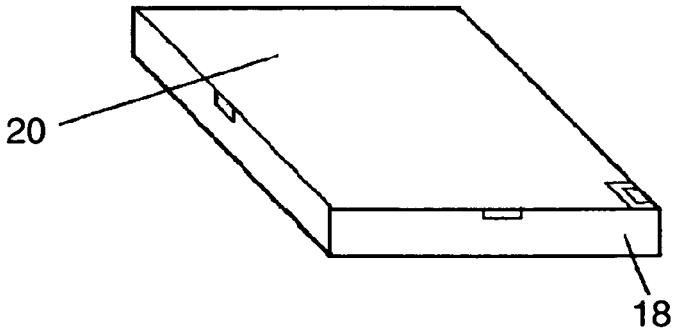
FIG. 4B is a perspective view of the back side of this antenna.

FIG. 4A and FIG. 4B indicate an example of the antenna 10. The flat body 18 indicated in FIG. 4A is constructed with alumina, for example, and on its surface side is sinter formed, on about the entire face, an antenna electrode 19 composed of silver and palladium alloy. Moreover, on the back face side of the main body 18 is sinter formed, on about the entire face, a grounding electrode 20 composed of silver and palladium electrode as shown in FIG. 4B.

Furthermore, on the outer circumferential face of the main body 18 is provided a signal electrode 21 in a state not in contact with the antenna electrode 19 and the grounding electrode 20. By adopting such no-contact power feed system, it becomes possible to easily adjust the combined capacity produced between the antenna electrode 19 and the signal electrode 21. Namely, if the no-contact part is adjusted in size and shape by mechanical or chemical grinding, this changes the substantial combined surface area between those electrodes, leading to adjustment of coupling capacity. This enables to sharply reduce deviations of antenna characteristics in the mass production of antennas.

This point is indicated in further detail in FIG. 5B to FIG. 5F. In FIG. 5A, the length of the antenna electrode 19 in the direction of X axis is given as λ2, and the length in the direction of Y axis is given as λ1, which are different from each other. Still more, the signal electrode 21 is provided at the outer circumference indicated in FIG. 4A and FIG. 4B corresponding to the direction of 45° against the X axis and Y axis at the intersection of the respective axes.

Figures 5A, 5B, 5C, 5D, 5E, 5F:
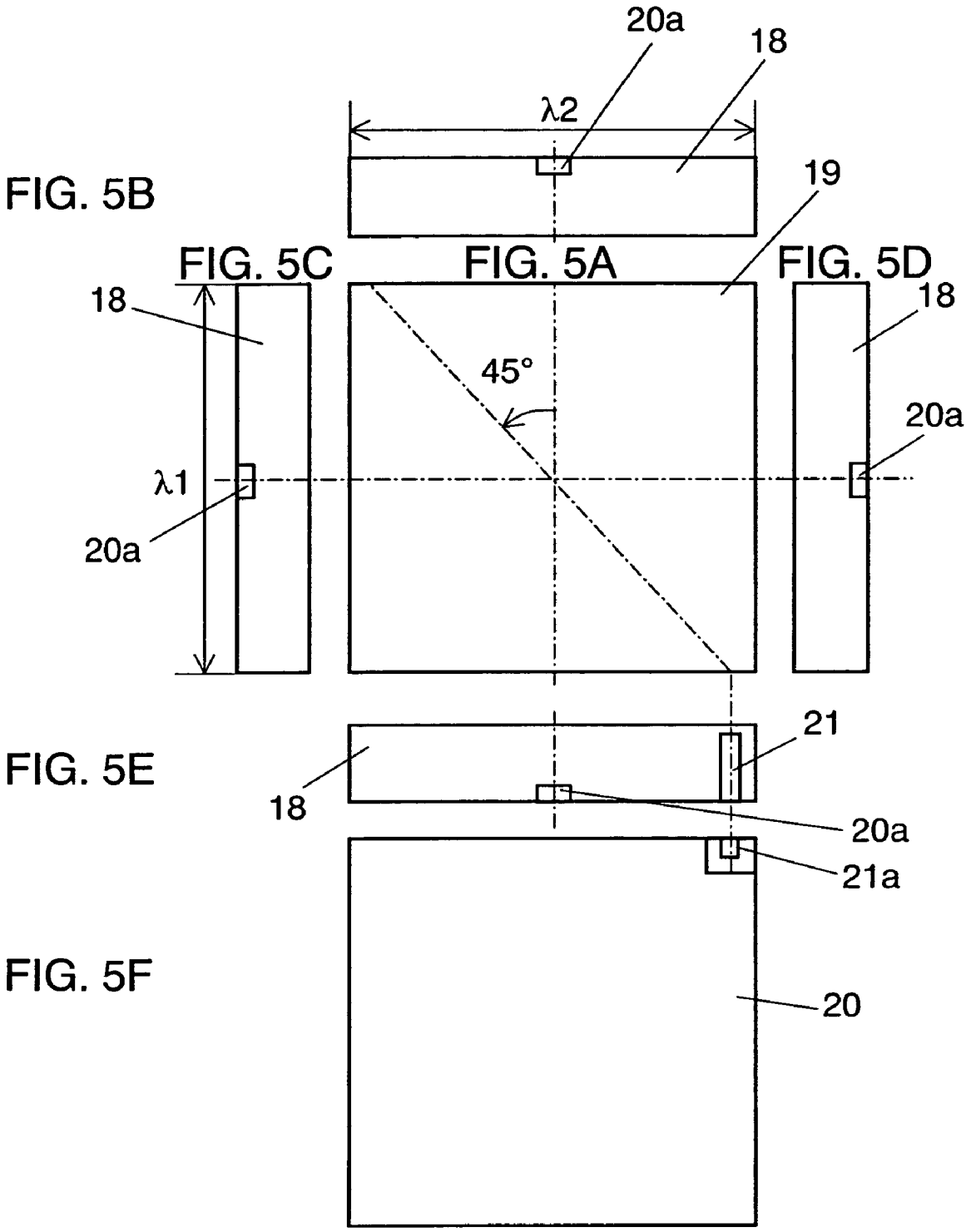
FIG. 5A is a plan view of the antenna according to the present invention.
FIG. 5B to FIG. 5E are side views of the antenna respectively.
FIG. 5F is a back view of this antenna.
Figure 6:
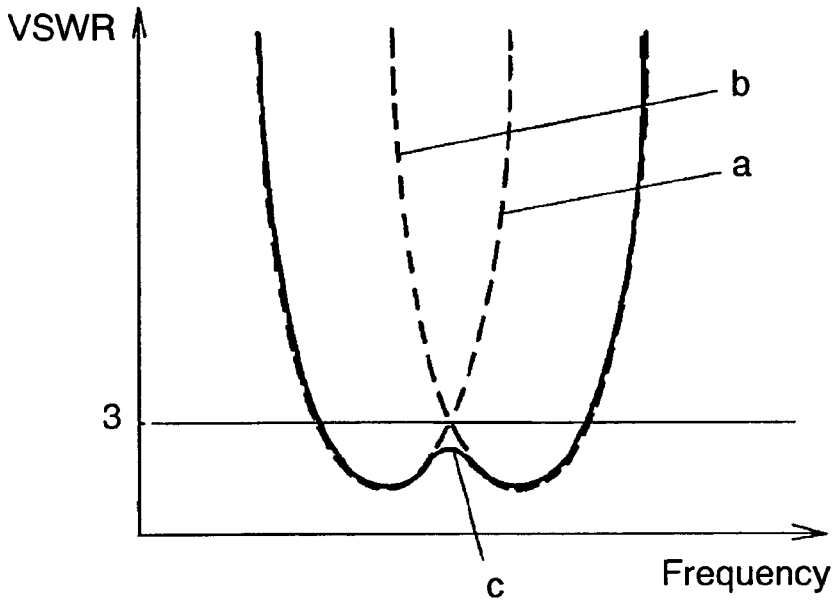
FIG. 6 is a VSWR (Voltage Standing Wave Ratio) characteristic diagram.

In the case of adoption of such construction, the resonance characteristic obtained by the length λ2 in the direction of X axis indicated in FIG. 5A can be expressed with line "a" in FIG. 6, while the resonance characteristic obtained by the length λ1 in the direction of Y axis can be expressed with line "b" in FIG. 6. Since the signal electrode 21 is provided, as mentioned above, at the outer circumference corresponding to the direction of 45° against the X axis and the Y axis, one can obtain broad band characteristics as expressed with the line "c" in FIG. 6.

Namely, as it is also apparent from FIG. 4, FIG. 5A to FIG. 5F, one can obtain broad band characteristics as shown with the line "c" in FIG. 6, by forming a flat antenna. If broad band characteristics are obtained this way, a single antenna is enough for a communication module communicating by using a broad band area. Yet more, since the antenna can be reduced also in size and in height, it becomes possible to reduce the box size of communication module and set equipment.

At other area on the outer circumference of the main body 18 is provided a connecting electrode 20*a*, from the grounding electrode 20 to other circuit board. In addition, a signal electrode 21*a* is provided, from the grounding electrode 21 to other signal line, as shown in FIG. 5F.

Figure 7A:
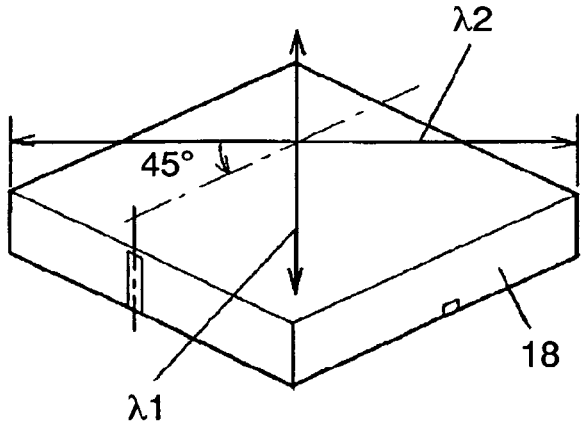
Figure 7B:
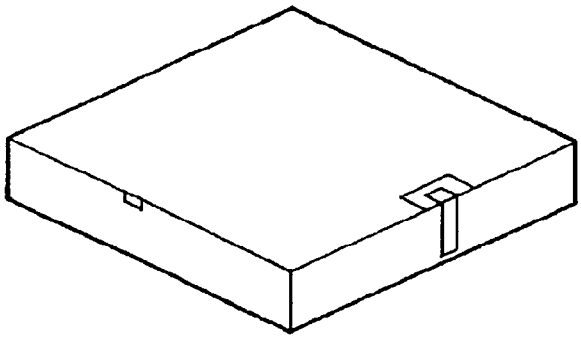
FIG. 7B is a perspective view of the back side of this antenna.

FIG. 7A to FIG. 7B and FIG. 8A to FIG. 8C indicate an antenna according to other preferred embodiment of the present invention. FIG. 7A and FIG. 7B show a case where the main body 18 is constructed in diamond shape. Even with such diamond shape, the lengths in X axis and Y axis of the main body 18 are different, and the signal electrode 21 is provided in the direction of 45° from the intersection of the respective axes.

Figure 8A:
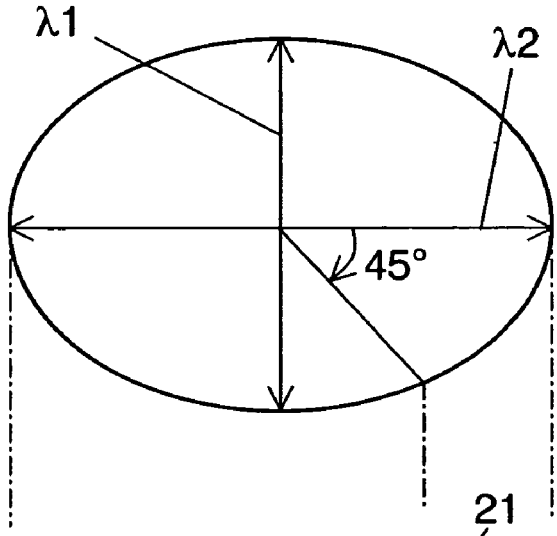
FIG. 8A is a plan view of the antenna according to other preferred embodiment of the present invention.
Figure 8B:
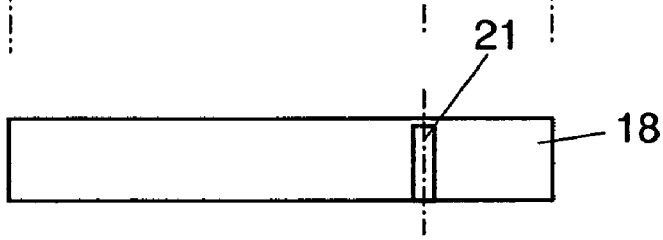
FIG. 8B is a side view of the antenna.
Figure 8C:
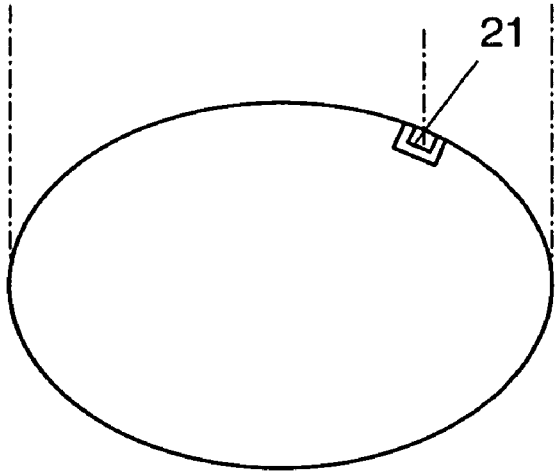
FIG. 8C is a back view of this antenna.

FIG. 8A to FIG. 8C shows a case where the main body 18 is constructed in elliptical shape, realized with different lengths in X axis and Y axis, and the signal electrode 21 is provided in the direction of 45° from the intersection of the respective axes.

Figure 9A:
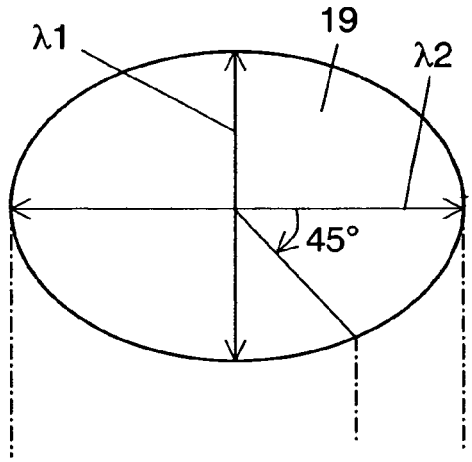
FIG. 9A is a plan view of the antenna according to other preferred embodiment of the present invention.
Figure 9B:
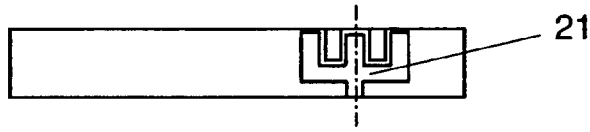
FIG. 9B is a side view of the antenna.
Figure 9C:
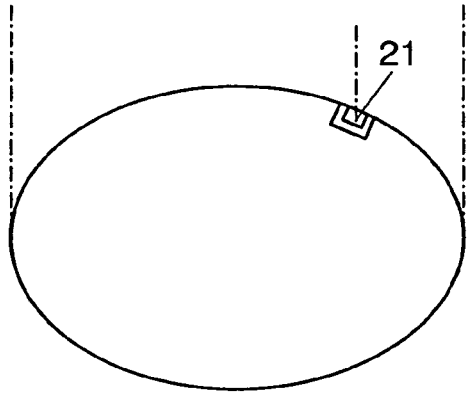
FIG. 9C is a back view of this antenna.

FIG. 9 indicates other preferred embodiment of the connecting part between the antenna electrode 19 and the signal electrode 21. The connecting part between the antenna electrode 19 and the signal electrode 21 is realized in concave and convex shape, to make them face each other. Namely, the signal electrode 21 is realized in a shape having 3 convex parts and 2 concave parts, while the antenna electrode 19 is in a shape having 2 convex parts to get into said 2 concave parts of the signal electrode 21, thus securing a wide opposing surface area between the two. This makes it possible to secure in advance a large connecting capacity between the antenna electrode 19 and the signal electrode 21. The setting of combined capacity can be realized by adjusting the opposing surface between the two electrodes, by mechanically or chemically grinding those concave and convex shapes, for example. Namely, the signal electrode 21 according to the present invention provided in concave and convex shapes can widen the adjusting range of the coupled capacity between the antenna electrode 19 and the signal electrode 21, and can therefore expand the degree of freedom of the impedance adjusting range of the antenna.

FIG. 10, FIG. 11A–FIG. 11B and FIG. 12A to FIG. 12C indicate still other preferred embodiments of the present invention. In those preferred embodiments, the antenna has a circuit board 7*a*, instead of the circuit board 7 indicated in FIG. 2. This circuit board 7*a* is provided, at its central part, with a signal line 7*b* in linear shape. And, at the portion of the signal line 7*b* of this circuit board 7*a* is mounted the antenna 19*f* indicated in FIG. 11A.

Figure 11A:
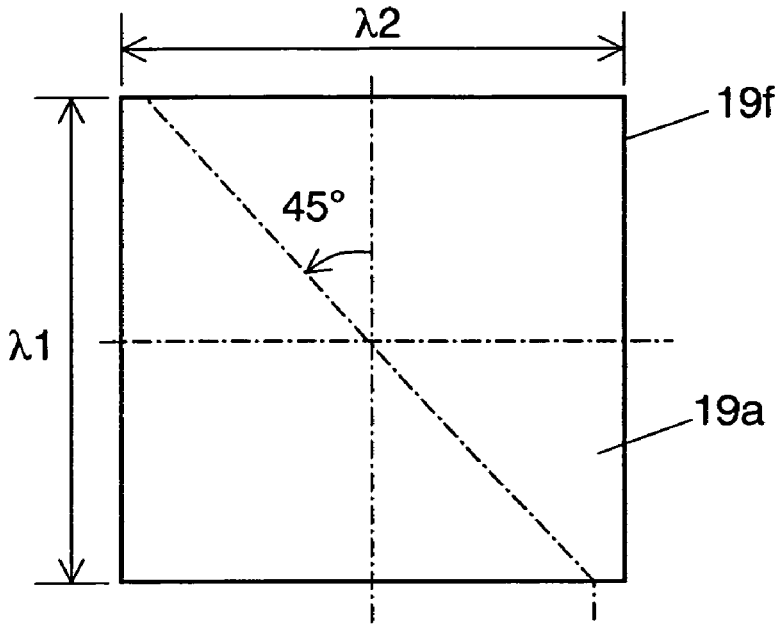
FIG. 11A is a plan view of the antenna according to the present invention to be mounted on the circuit board of the electronic equipment in FIG. 10 according to the present invention.
Figure 11B:
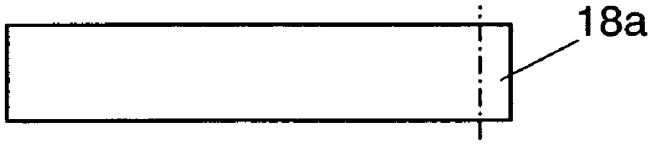
FIG. 11B is a side view of that antenna to be mounted on the circuit board of the electronic equipment in FIG. 10.

The antenna 19*f* indicated in FIG. 11A is provided, on about the entire face, on the surface side of the flat body 18 made of alumina, with an antenna electrode 19*a* composed of a sintered body of silver and palladium. The length λ2 in the direction of X axis of this antenna electrode 19*a* and the length λ1 in the direction of Y axis are set as lengths different from each other.

Figure 11C:
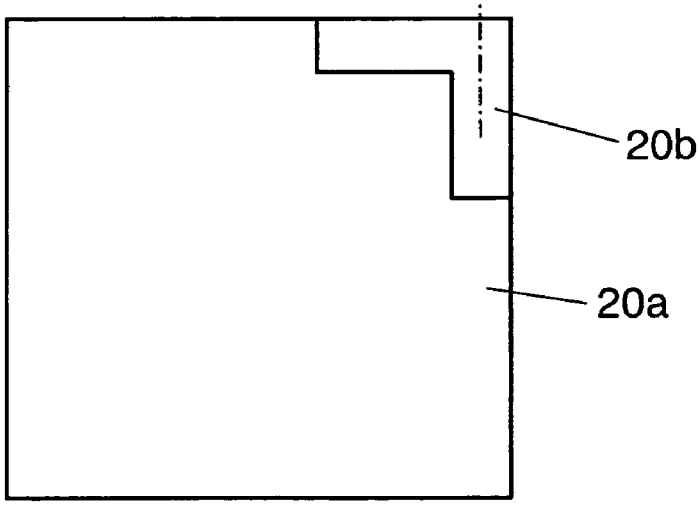
FIG. 11C is a back view of that antenna to be mounted on the circuit board of the electronic equipment in FIG. 10.

Moreover, on the back face side of this body 18*a* is provided a grounding electrode 20*a*, as shown in FIG. 11C, and a no-electrode part 20*b* of the grounding electrode 20*a* is provided in direction X and direction Y respectively from the corner part of the grounding electrode 20*a*.

Figure 10:
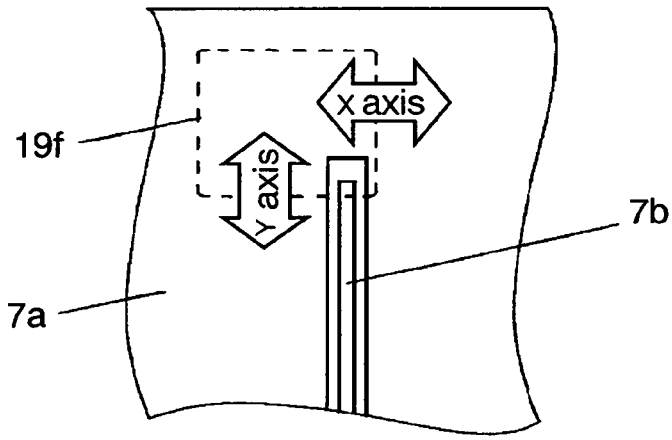
FIG. 10 is a plan view showing the circuit board of the electronic equipment according to one preferred embodiment of the present invention.

In other words, the antenna 19*f* is mounted as shown in FIG. 10, in such a way that the no-electrode part 20*b* of this grounding electrode 20*a* may become the portion where the signal line 7*b* in FIG. 10 is to be mounted. Namely, in these FIG. 10, FIG. 11A to FIG. 1C, the signal electrode is not provided on the antenna 19*f*, but is provided on the circuit board 7*a* side, as shown in FIG. 10. And, power is supplied to the antenna 19*f* indicated in FIG. 11A By using this signal line 7*b*.

Figure 12A:
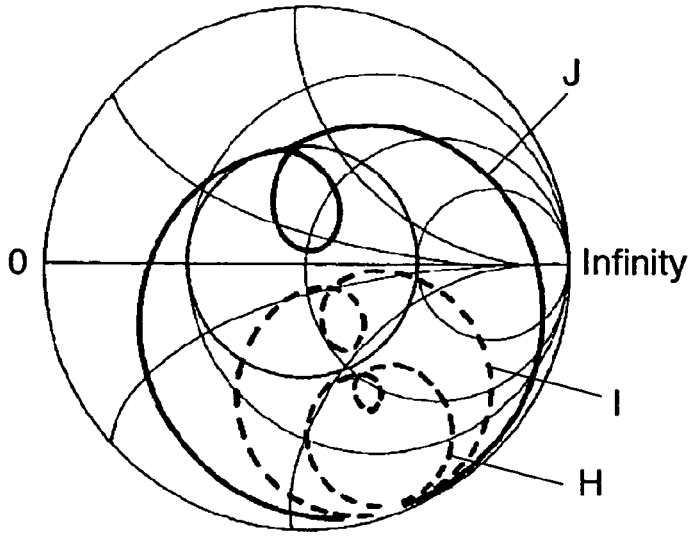
FIG. 12A to FIG. 12C are impedance characteristic diagrams of the antenna in FIG. 11A to FIG. 11C to be used for the electronic equipment according to the present invention.
Figure 12B:
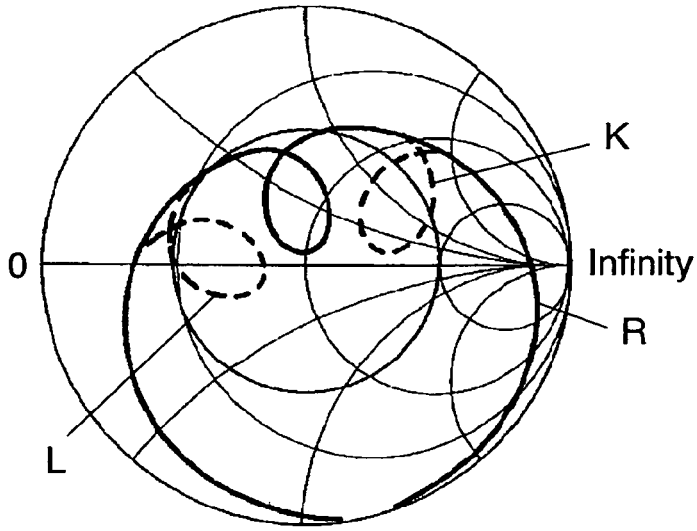
Figure 12C:
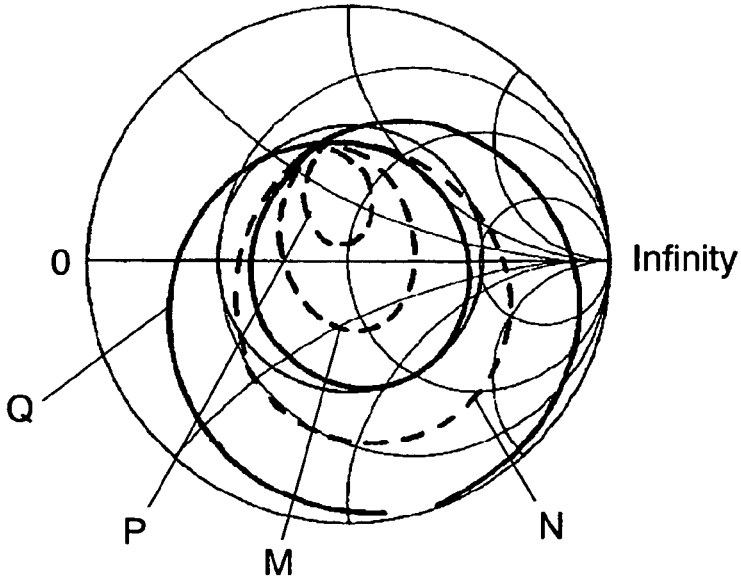

In this case, the input impedance of the antenna indicated in FIG. 12A to FIG. 12C can be adjusted, depending on which portion of the no-electrode part 20*b* of this grounding electrode 20*a* should be opposed by the signal line 7*b*.

Namely, by moving the antenna 19*f* indicated in FIG. 10 to the direction of Y axis, it becomes possible to adjust the input impedance of the antenna 19*f* from broken lines H, I to solid line J as shown in FIG. 12A and, by moving the antenna 19*f* to the direction of X axis, it becomes possible to adjust the input impedance of the antenna 19*f* from broken line to solid line as shown in FIG. 12B, and by adjusting the lengths λ2, λ1 of X axis and Y axis of the antenna 19*f* in FIG. 11A, it becomes possible to adjust the input impedance of the antenna 19*f* from broken lines M, N, P to solid line Q as shown in FIG. 12C. By using such of antenna design method, it becomes possible to about overlap the impedance of the antenna 19*f* on the circle "a" in FIG. 12A to FIG. 12C showing the desired VSWR value, providing the broadest area against the desired VSWR value. Naturally, it is by this antenna design method that the broad band design of antennas indicated in FIG. 4, FIG. 5, FIG. 7, FIGS. 8A–8C and FIG. 9 is made. Namely, a change in the capacity value between the antenna electrode 19 and the signal electrode 21 enables to change the input impedance of the antenna as in FIG. 12A, and a change in the position of power feed line 21 enables to change the input impedance of the antenna as in FIG. 12B.

Figure 13A:
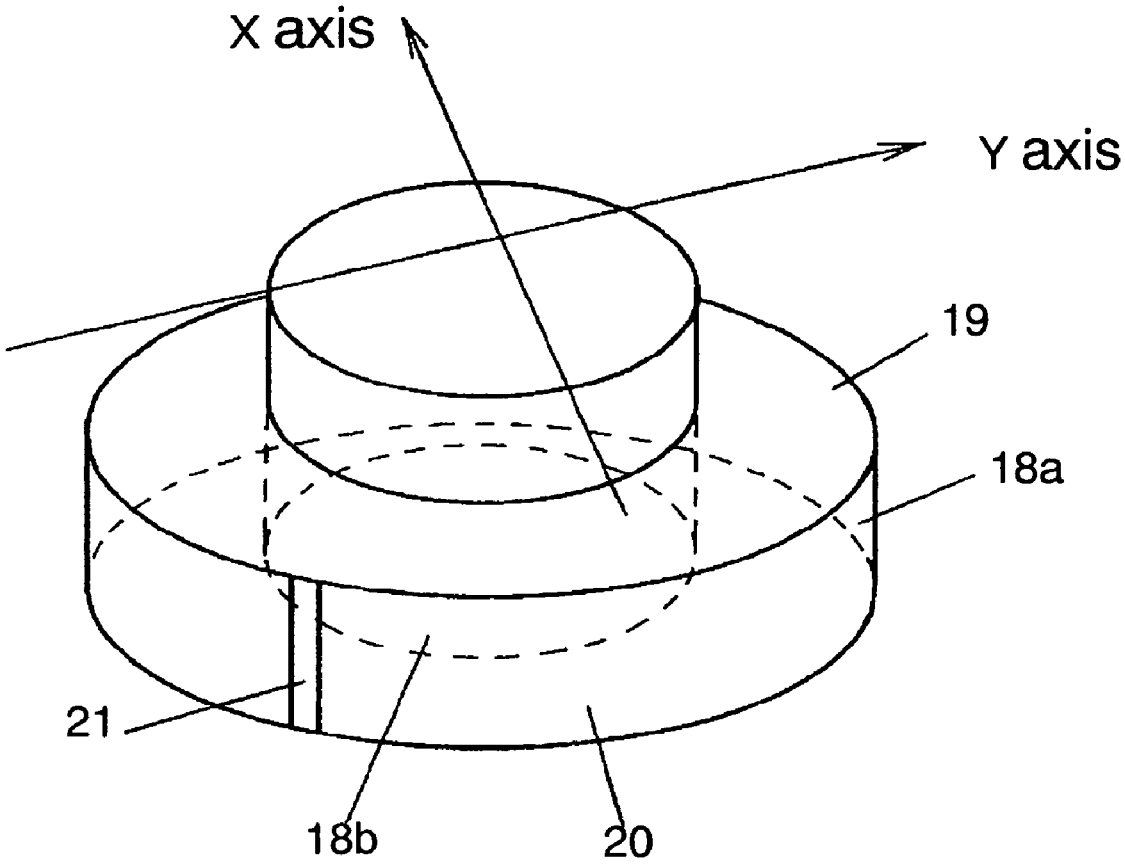
FIG. 13A is a perspective view of the antenna according to other preferred embodiment of the present invention.
Figure 13B:
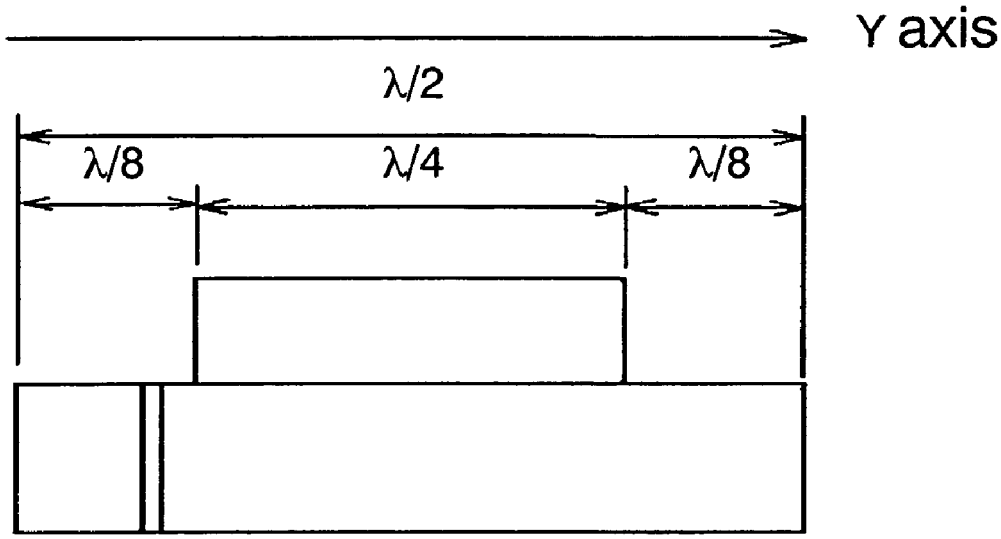
FIG. 13B is a side view of that antenna.

FIG. 13A and FIG. 13B indicate other preferred embodiment of the present invention. In FIG. 13A, the first main body 18*a* is disposed in the periphery of the second body 18B, the top face position of the second body 18B is set higher than the top face position of the first body 18*a*, an antenna electrode 19 is provided on the top face of the first body 18*a* and at a part positioned above the top face of the first body 18*a* of the surface of the second body 18*b*, and a grounding electrode 20 is provided on the bottom face of the first body 18*a* and the second body 18B.

Moreover, the peripheral shape of the top face position of the first body 18*a* is elliptical so that the electric lengths of X axis and Y axis of the antenna indicated in FIG. 13A may be different from each other. However, this elliptical shape does not have any great significance, and it is also all right to either adopt a structure in which the difference of level from the top face position of the first body 18*a* to the top face position of the second body 18*b* in X axis is different from that in Y axis, or take either a rectangular or elliptical shape for the shape of the periphery.

The signal electrode 21 is provided on the straight line having an angle of 45° against both X axis and Y axis at the intersection of those axes, at the end face in the periphery of the first body 18*a*.

By adopting such construction for the antenna, it becomes possible to realize the antenna electrode 19 in a shape having a convex part at the central part, and secure a clearance between the grounding electrode 20 and the antenna electrode 19 at the central part of the antenna electrode 19 larger than that in other parts. This enables to increase the characteristic impedance at the central part of the antenna electrode 19, and to miniaturize the antenna electrode 19 based on the principle of stepped impedance resonator.

Furthermore, by selecting the base material of the first body 18*a* and the second body 18*b* in such a way that the value obtained by dividing the permeability by the dielectric constant of the base material of the first body 18*a* may be smaller than the value obtained by dividing the relative magnetic permeability by the relative permittivity of the base material of the second body 18*b*, it becomes possible to keep the characteristic impedance in the first body 18*a* smaller than the characteristic impedance in the second body 18*b*. It also enables to miniaturize the antenna electrode 19.

Especially, by setting the electric length on X axis and Y axis on the first body 18*a* as λ/8 and the electric length on X axis and Y axis on the second body 18*b* as λ/4, it becomes possible to materialize a λ/2 stepped impedance resonator, and thus construct the antenna electrode 19 in the smallest possible size.

Figure 14A:
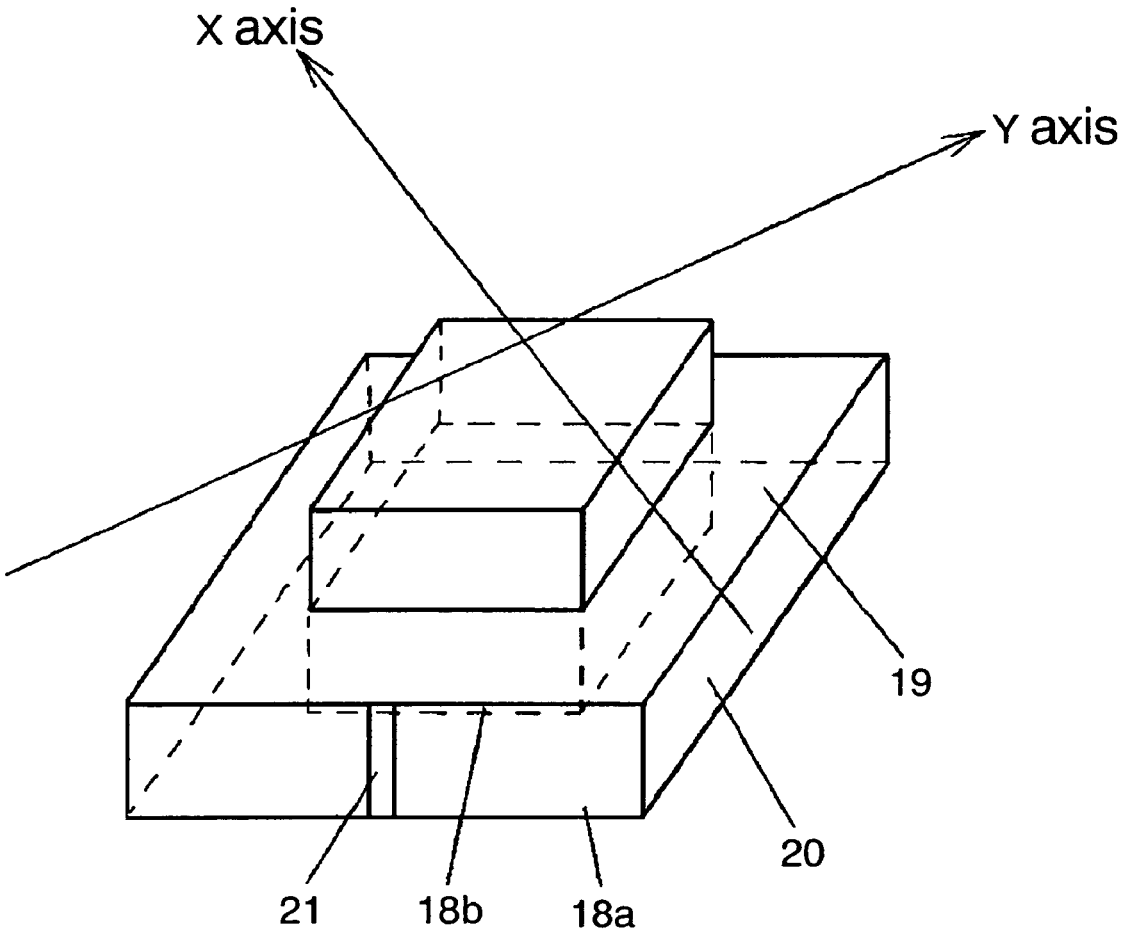
FIG. 14A is a perspective view of the antenna according to other preferred embodiment of the present invention.
Figure 14B:
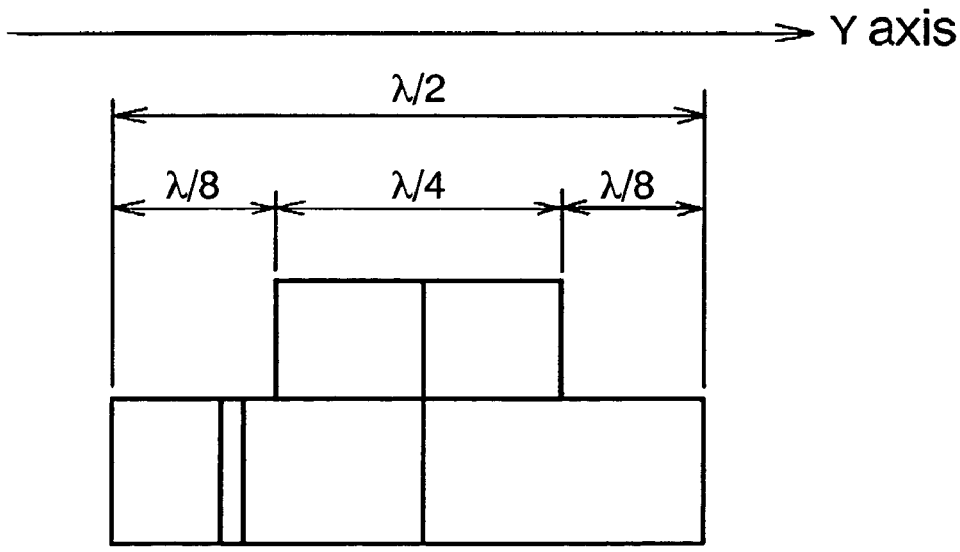
FIG. 14B is a side view of that antenna.

The antenna indicated in FIG. 14A and FIG. 14B is one realized by taking a diamond shape for the shape of periphery of the first body 18*a* and the second body 18*b* of the antenna explained in FIG. 13A and FIG. 13B. This enables to obtain effects of miniaturization in the same way as with the antenna in FIG. 13A and FIG. 13B.

Figure 15A:
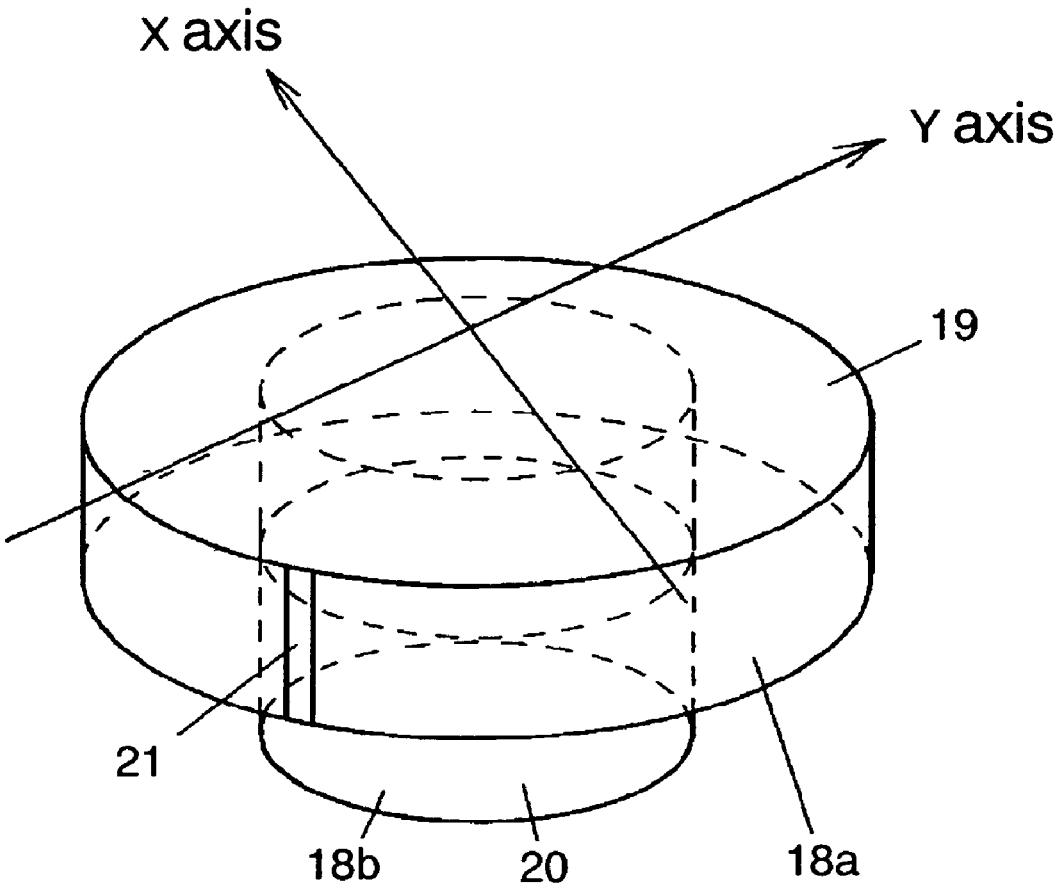
FIG. 15A is a perspective view of the antenna according to other preferred embodiment of the present invention.
Figure 15B:
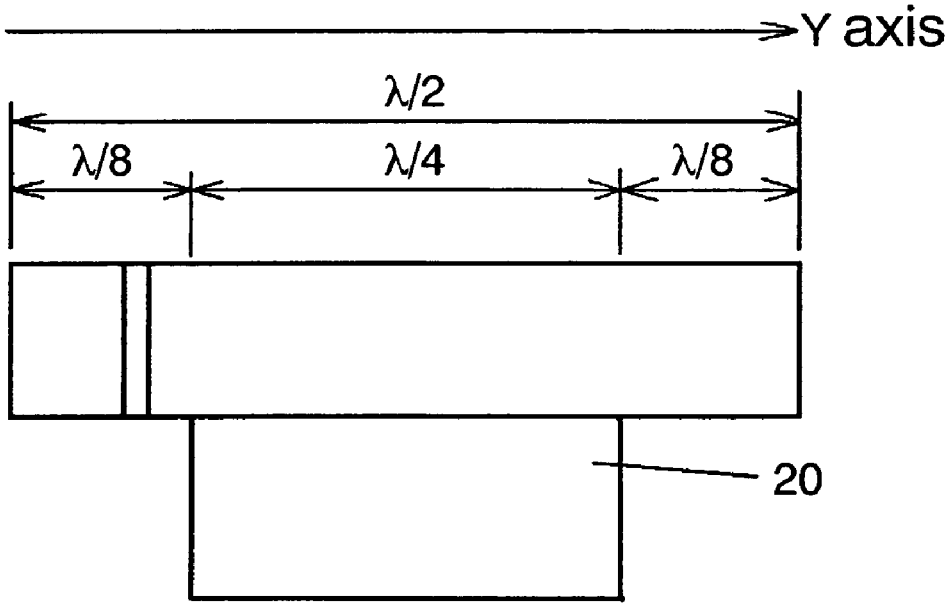
FIG. 15B is a side view of that antenna.

The antenna indicated in FIG. 15B and FIG. 15B is one realized by providing a convex part at the central part of the grounding electrode 20 without having any convex part at the central part of the antenna electrode 19 indicated in FIG. 13A and FIG. 13B. It can provide effects of miniaturization in the same way as with the antenna in FIG. 13A and FIG. 13B. Still more, it becomes possible to reduce the mounting surface area on the high-frequency circuit board, enabling miniaturization of the communication equipment.

Figure 16A:
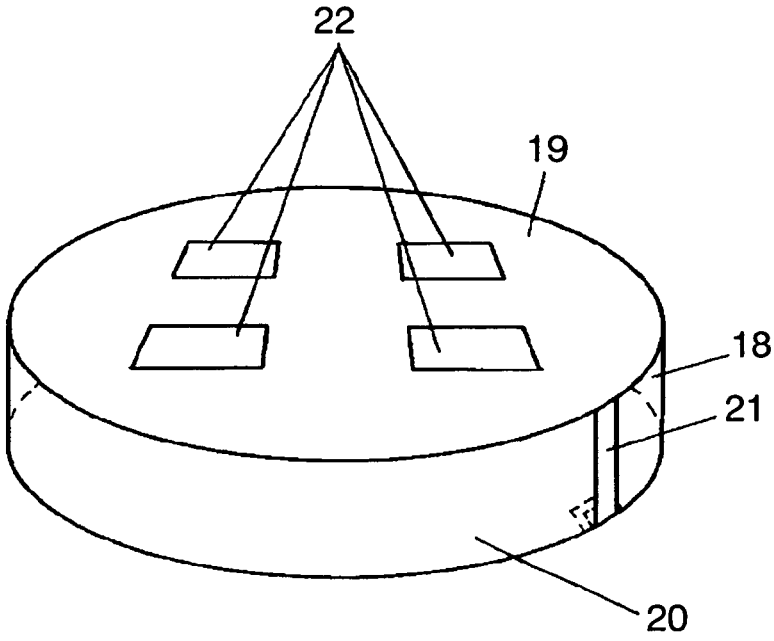
FIG. 16A is a perspective view of the antenna according to other preferred embodiment of the present invention.
Figure 16B:
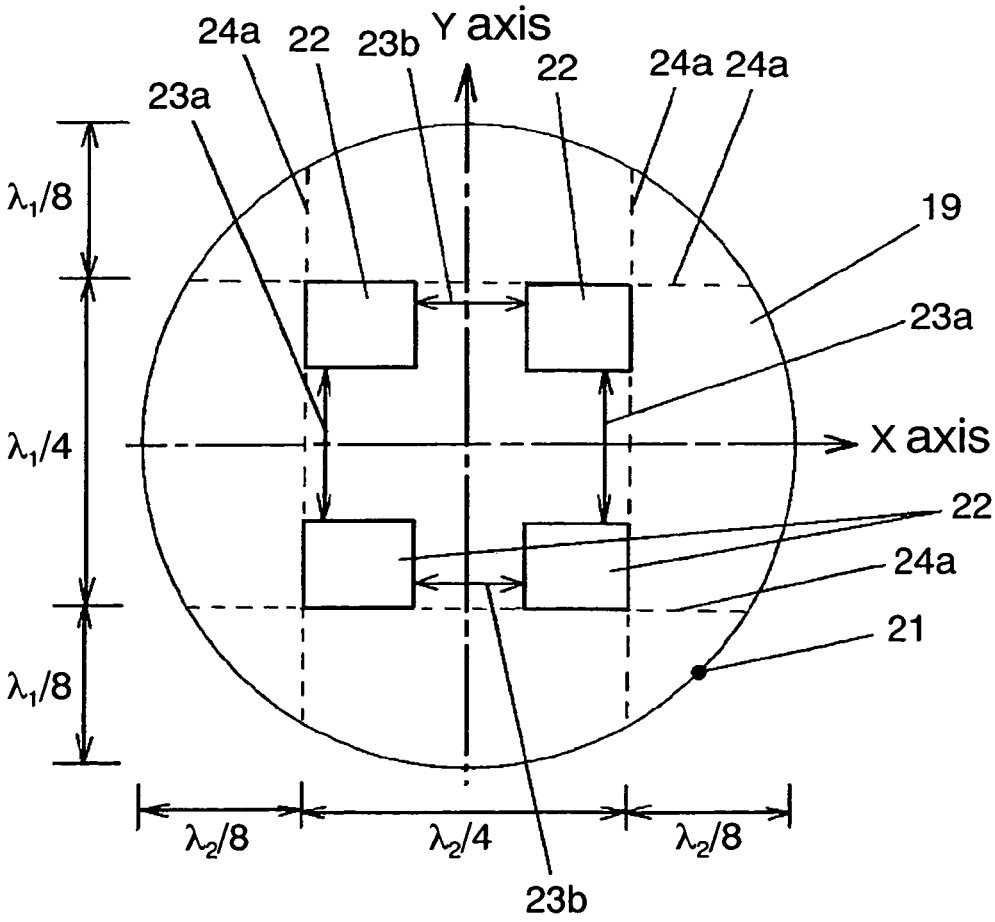
FIG. 16B is a top view of that antenna.

FIG. 16A and FIG. 16B indicate other preferred embodiment of the present invention. The antenna in FIG. 16A and FIG. 16B is realized by providing a grounding electrode 20 on the bottom face of the columnar body 18, providing an antenna electrode 19 having 4 slits 22 formed at a position axially symmetrical against X axis and Y axis on the face opposing the grounding electrode 20, and providing a signal electrode 21 on a straight line having an angle of 45° against both X axis and Y axis at the intersection of those axes. The top face shape of the main body 18 is circular, and the diameter of that circle is λ/2 in electric length. The shape of the slits is such that, in X axis and Y axis, the 4 line segments 24*a* orthogonal to X axis and Y axis get in contact with sides at the outer circumference of the slit 22, at the point of ⅛ of each wavelength from the end of the antenna electrode 19, and the slit interval 23*b* is narrower compared with the slit interval 23*a*.

Thanks to the presence of such slit 22 in the antenna electrode 19, the change in line width around the X axis of the antenna electrode 19 (especially the change in line width at the point of λ/8 from the periphery of the antenna electrode 19) becomes smaller than the change in line width around the Y axis. As a result, the amount of change in characteristic impedance on the Y axis becomes larger compared with the amount of change in characteristic impedance on the X axis and, from the principle of stepped impedance resonator, the reduction ratio of electric length on the Y axis can be set larger than the reduction ratio of electric length on the X axis.

As described above, by changing the slit shape, it becomes possible to adjust the resonance frequency of resonant current on X axis and Y axis and, by narrowing the slit intervals 23*a* and 23*b*, it becomes possible to promote miniaturization of the antenna.

Figure 17A:
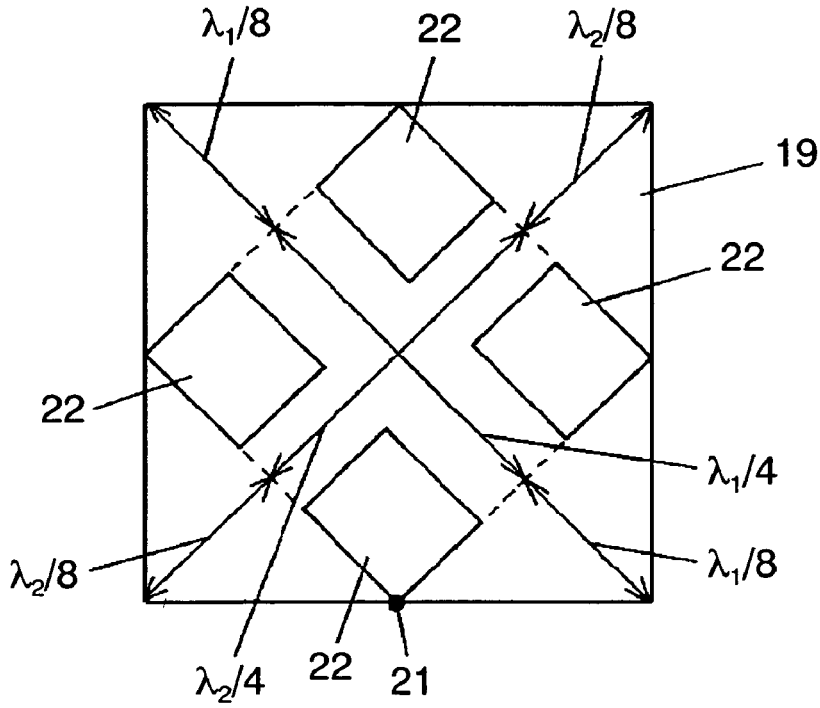
FIG. 17A is a top view of the antenna according to other preferred embodiment of the present invention.
Figure 17B:
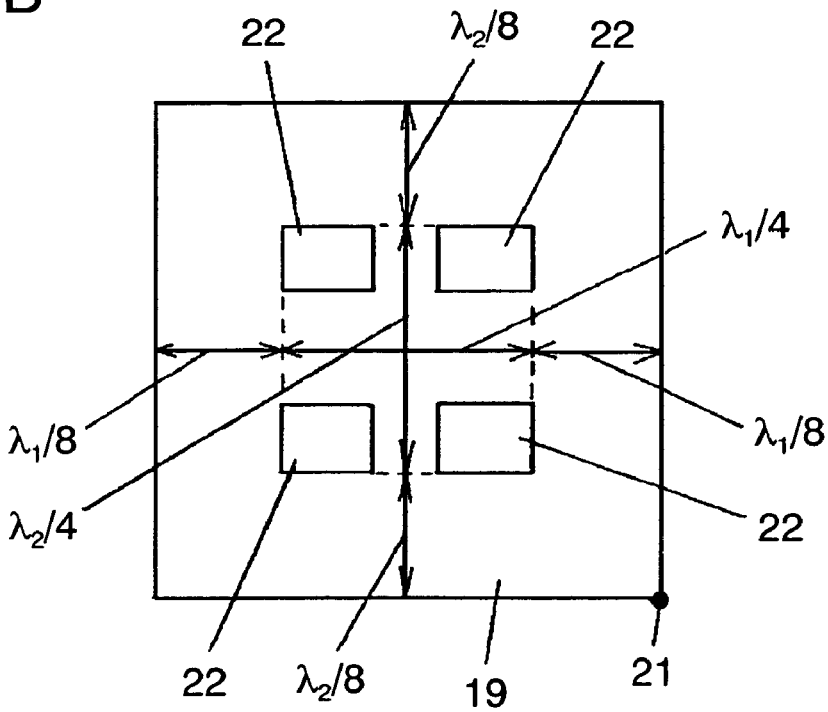
FIG. 17B is a top view of that antenna.

The antenna indicated in FIG. 17A and FIG. 17B is one realized in the case where square shape is adopted for the shape of the antenna electrode 19 of the antenna explained in FIG. 16A and FIG. 16B. Furthermore, the antenna indicated in FIG. 17A and FIG. 17B is realized by changing the forming position of the slit 22 according to the position of arrangement of the signal electrode 21, and provides effects similar to those of the antenna in FIG. 16A and FIG. 16B.

Figure 18A:
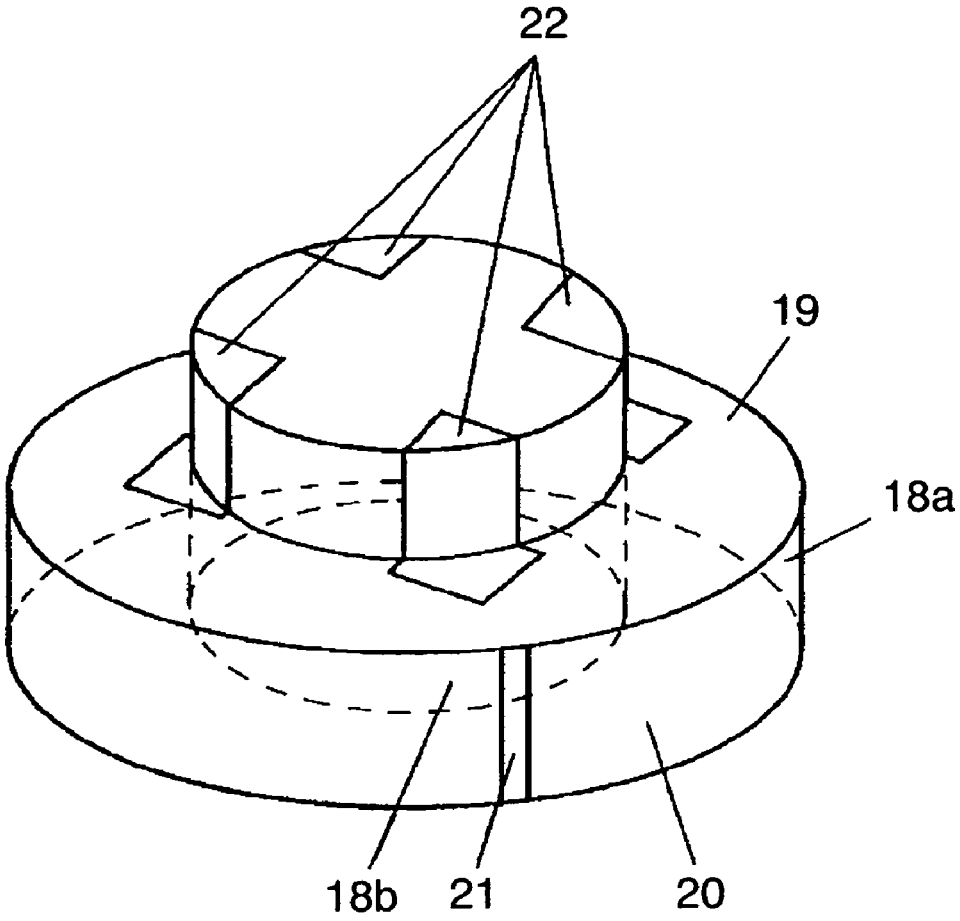
FIG. 18A is a perspective view of the antenna according to other preferred embodiment of the present invention.
Figure 18B:
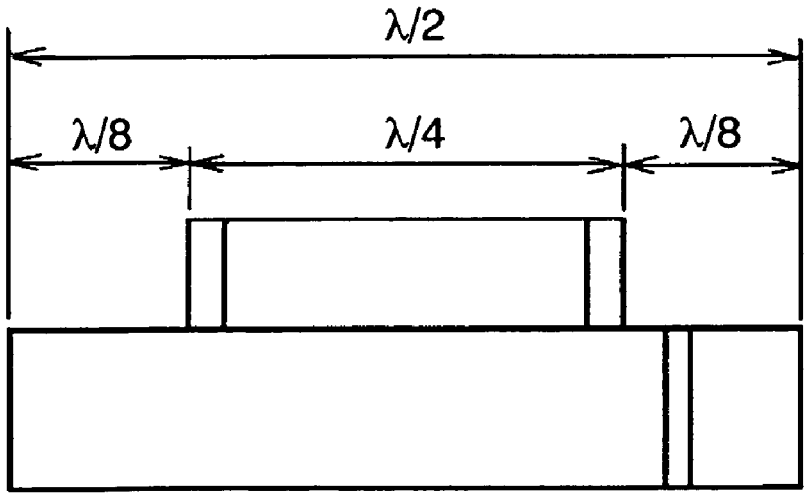
FIG. 18B is a side view of that antenna.

The antenna indicated in FIG. 18A and FIG. 18B is one realized by forming, on the antenna electrode 19 of the antenna indicated in FIG. 13A and FIG. 13B, a slit 22 which was explained in FIG. 16A and FIG. 16B. It enables to change and adjust the impedance of the antenna with a lot of design parameters such as selection of base material to be used for first body 18*a* and second body 18*b*, size of convex part at the central part of antenna electrode 19, shape of slit 22, etc., and to also expect great effects in promoting miniaturization of the antenna.

Figure 19A:
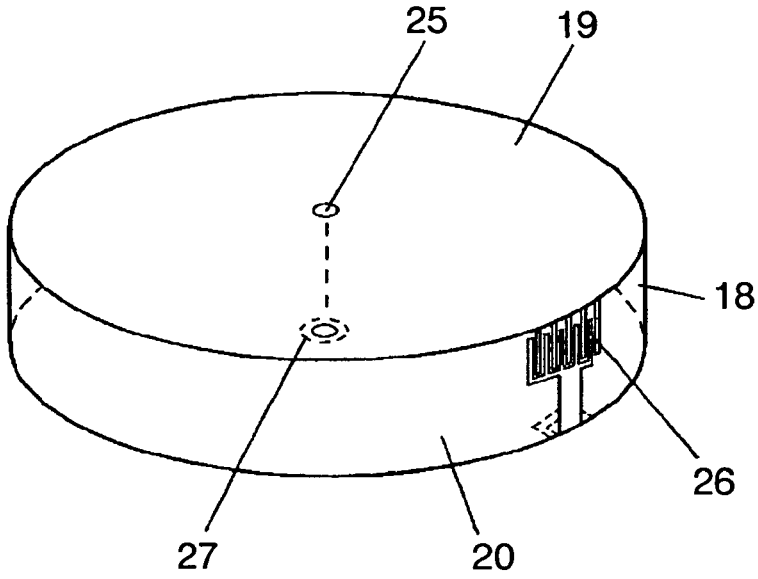
FIG. 19A is a perspective view of the antenna according to other preferred embodiment of the present invention.
Figure 19B:
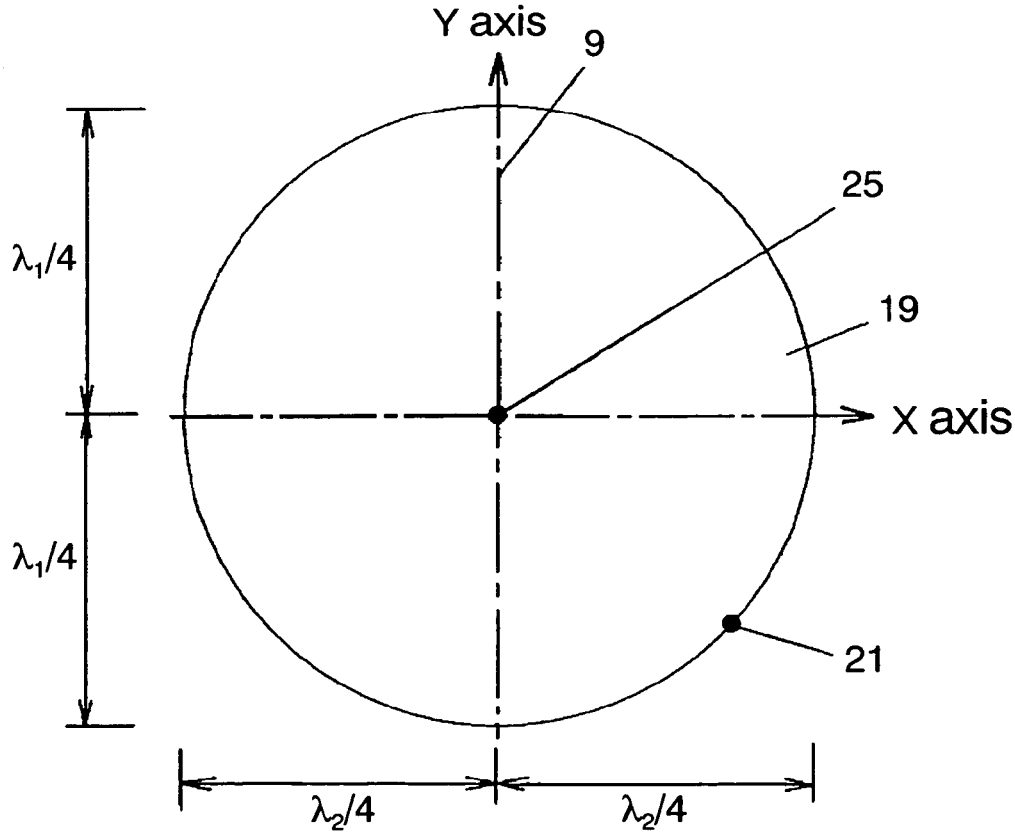
FIG. 19B is a top view of that antenna.
Figure 20A:
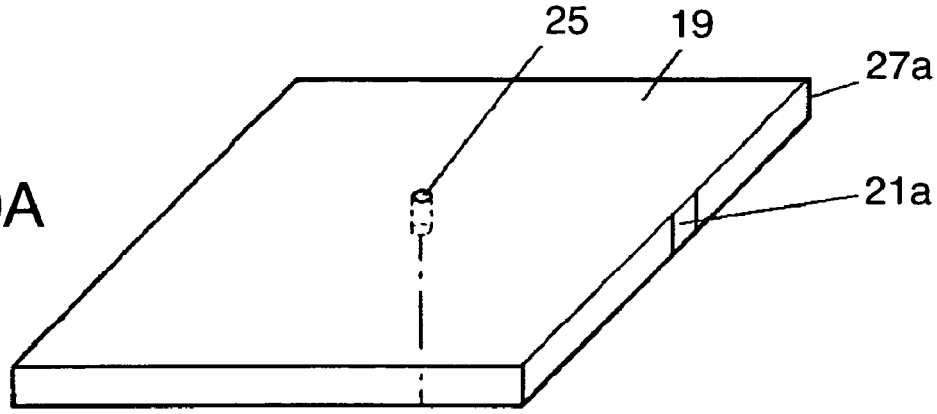
FIG. 20A is an exploded perspective view of the first layer of the antenna according to other preferred embodiment of the present invention.
Figure 20B:
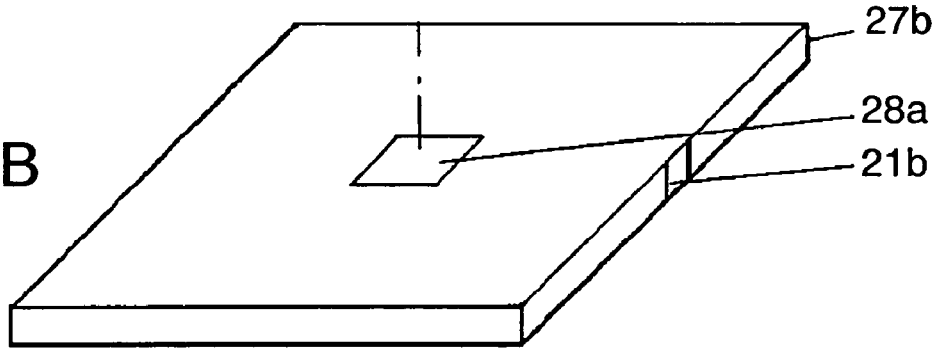
FIG. 20B is an exploded perspective view of the second layer of this antenna.
Figure 20C:
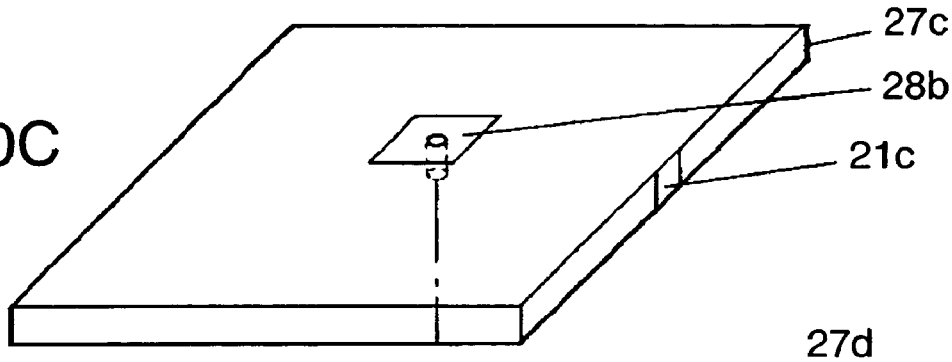
FIG. 20C is an exploded perspective view of the third layer of this antenna.
Figure 20D:
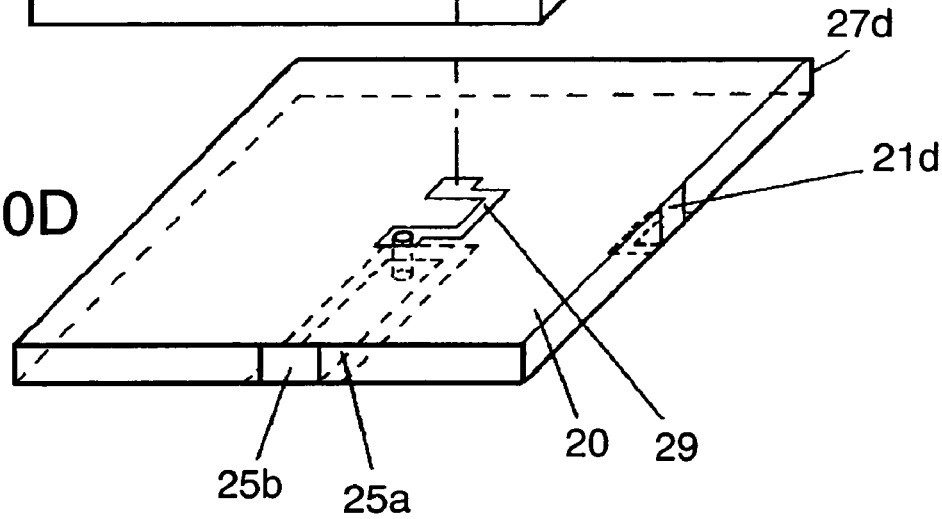
FIG. 20D is an exploded perspective view of the fourth layer of this antenna.
Figure 21A:
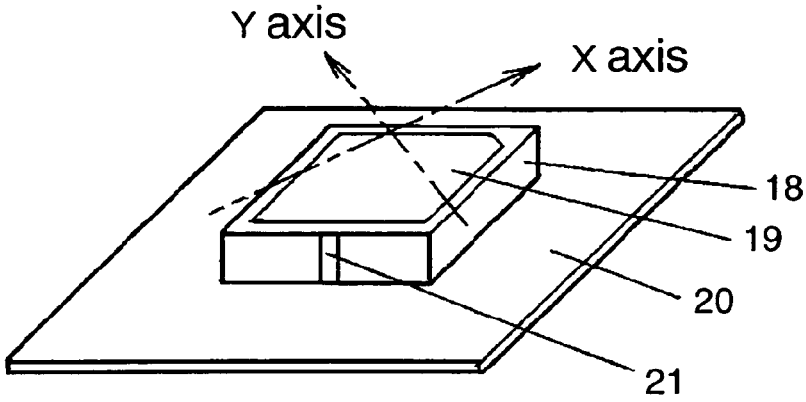
FIG. 21A is a perspective view of the antenna according to other preferred embodiment of the present invention.
Figure 21B:
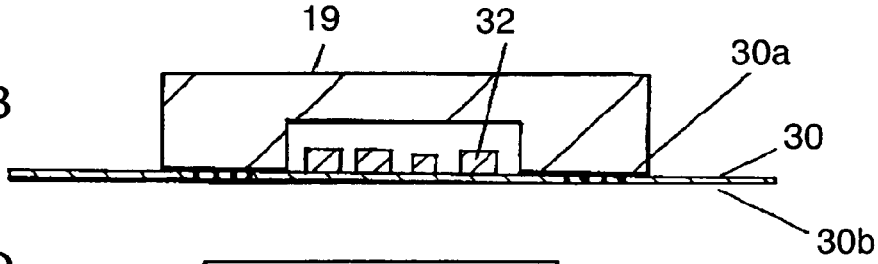
FIG. 21B is a sectional view of this antenna.
Figure 21D:
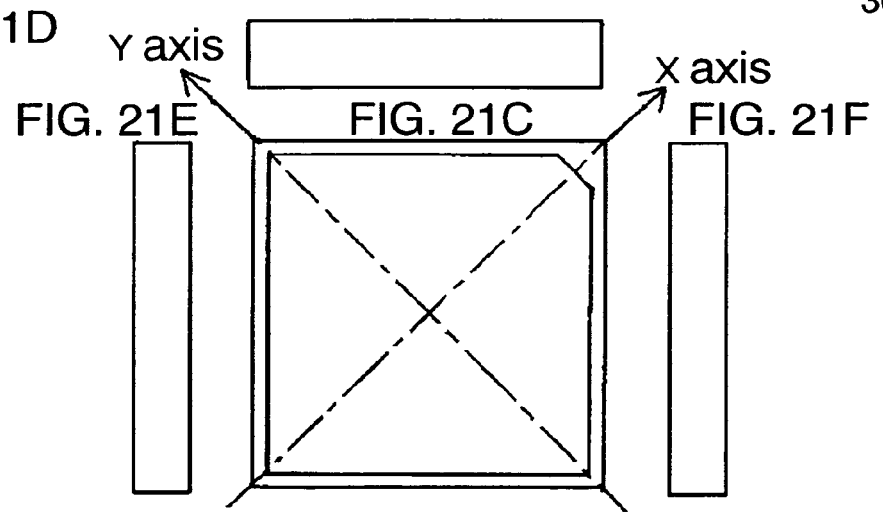
FIG. 21D is a first side view of this antenna.
Figure 21G:
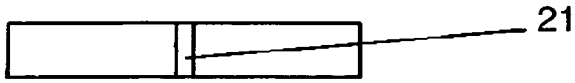
FIG. 21G is a fourth side view of this antenna.
Figure 21H:
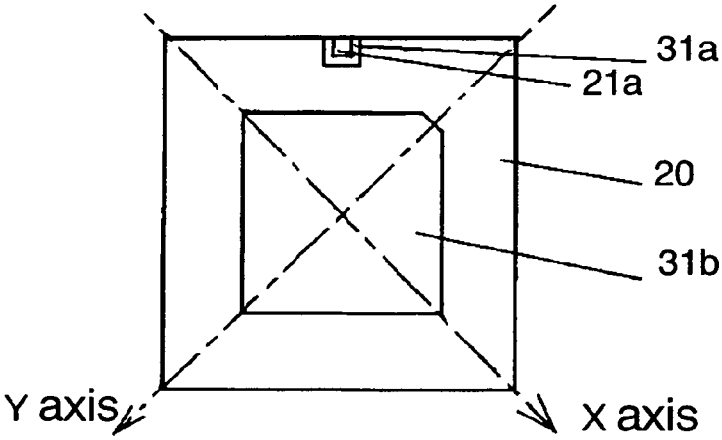
FIG. 21H is a bottom view of this antenna.

The antenna indicated in FIG. 19A and FIG. 19B is one realized by providing a grounding electrode 20 on the bottom face of the main body 18 in elliptical columnar shape, providing an antenna electrode 19 on the top face facing it, and providing a comb-shaped signal electrode 26 on the straight line having an angle of 45° against X axis and Y axis, at the intersection of X axis and Y axis, when the minor axis and the major axis of the antenna electrode 19 are given as X axis and Y axis. It is constructed by further providing a central signal electrode 25 at the intersection of X axis and Y axis. The central signal electrode 25 is electrically connected at one end to the antenna electrode 19, and its other end passes through about the central part of the main body 18 to reach the face on which is provided the grounding electrode 20. For that reason, at about the central part of the grounding electrode 20 is provided a no-electrode part 27 of the grounding electrode 20, and is constructed in a way to avoid any direct continuity between the central signal electrode 25 and the grounding electrode 20.

By adopting such construction, it becomes possible to provide 2 isolated and independent signal electrodes on a single antenna. Since the antenna which used to be required essentially in the number of 2 can be realized in one piece, it enables to reduce the cost and promote miniaturization of communication equipment. In addition, the possibility of providing the antenna itself with a branching function makes it unnecessary to use any sharing apparatus which used to be required immediately under the antenna, thus achieving miniaturization, reduction of weight and cost reduction of the communication equipment.

In the case where different frequencies are used for the signal electrode 21 and the central signal electrode 25, the working frequency band of the central signal electrode 25 exists in a band other than the band where, especially, a filter or matching circuit disposed just under the signal electrode 21 passes and that the working frequency band of the signal electrode 21 exists in a band other than the band where a filter or matching circuit disposed just under the signal electrode 21 passes, it is possible to increase the value of isolation between the signal electrode 21 and the central signal electrode 25, and this becomes an effective measure in the case where the antenna is provided with the function of a sharing apparatus.

FIG. 20A to FIG. 20D indicate an example of means for materializing the antenna according to the present invention. This antenna is realized by laminating 4 ceramic sheets before firing and, after punching, firing the entire sheets.

On the top face of the first layer ceramic 27*a* is formed an antenna electrode 19 in diamond shape, and near the intersection of its two diagonals is constructed a central signal electrode 25 by via hole. Yet more, at the intersection of the 2 diagonals of the antenna electrode 19 is provided a signal electrode 21*a* at the end face part of the first layer ceramic 27*a*, on the straight line having an angle of 45° against those two diagonals.

The bottom end part of the signal electrode 21*a* is connected with the top end part of the signal electrode 21*b* provided at the end face part of the second layer ceramic 27*b*, the bottom end part of the signal electrode 21*b* is connected with the top end part of the signal electrode 21*c* provided at the end face part of the third layer ceramic 27*c*, and the bottom end part of the signal electrode 21*c* is connected with the top end part of the signal electrode 21*d* provided at the end face part of the fourth layer ceramic 27*d*, by laminating the ceramics of each layer respectively.

The bottom end part of the central signal electrode 25 is electrically connected to a capacitor top face electrode 28*a* provided on the top face at about the central part of the second layer ceramic 27*b*, and at the top face position of the third layer ceramic 27C facing the capacitor top face electrode 28*a* is provided a capacitor bottom face electrode 28*b*. At the top face at about the central part of the fourth layer ceramic 27*d* is formed an inductor 29 by conductive line, and one end of the inductor 29 and the capacitor bottom face electrode 28*b* are electrically connected to each other by via hole.

Moreover, the other end of the inductor 29 is electrically connected with one end of the central signal electrode 25*a* formed in insulation from the grounding electrode 20 provided on the bottom face of the fourth layer ceramic 27*d*, and is electrically connected through a via hole to the central signal electrode 25*b* formed on one end face of the fourth layer ceramic 27*d*.

By adopting such construction, it becomes possible to integrally form, inside the antenna, a matching circuit required immediately under the central signal electrode 25. This enables to reduce the mounting surface area of the matching circuit of the antenna on the high-frequency circuit board.

FIG. 21A to FIG. 21H indicate other preferred embodiment of the present invention. The main body 18 is composed of a dielectric, and on its top face is provided an antenna electrode 19. The shape of the antenna electrode 19 is selected in such a way that the antenna electrode 19 is different in electric length at the X axis and the Y axis. The signal electrode 21 is located on the straight line having an angle of 45° against the X axis and Y axis, and is disposed at the end face part of the main body 18 with a certain clearance against the antenna electrode 19. Furthermore, the bottom end part of the signal electrode 21 is electrically connected with the signal electrode 21*a* on the bottom face of the main body 18, and the signal electrode 21*a* is provided at the no-electrode part 31*a* of the grounding electrode 20 which gets in a state insulated from the grounding electrode provided on the bottom face of the main body 18. Still more, a concave part is provided at the central part on the bottom face of the main body 18, and at the inner part of this concave part is further provided a no-electrode part 31*b* of the grounding electrode.

In the case where such antenna is mounted on a high-frequency circuit board 30, the mounting can be made in such a way that the high-frequency circuit part 32 mounted on the top face of the high-frequency circuit board 30 may be stored in the concave part on the bottom face of the main body 18, enabling to overcome the problem of requiring a wide mounting surface area for a flat reverse F antenna. Yet more, an open space can be constituted between the ground face 30*b* and the antenna electrode 19 provided on the bottom face of the high-frequency circuit board 30, by using the concave part provided on the bottom face of the main body 18. Regarding the characteristic impedance between the antenna electrode 19 and the ground face 30*b*, it is possible to enlarge the central part of the antenna electrode 19 and reduce the size of the peripheral part, thus enabling to achieve miniaturization of the antenna. The numeral 30*a* represents a grounding electrode.

The concave part on the bottom face of the main body 18 shall preferably be formed from a bottom face position facing the position of λ/8 in electric length from the peripheral part of the antenna electrode 19. That is because, by forming from such position, the antenna can be constructed in the smallest possible size.

FIG. 22A to FIG. 22H indicate other preferred embodiment of the present invention. The main body 18 is composed of a dielectric, and on its top face is provided an antenna electrode 19 in rectangular shape. At one corner parts on the periphery of the antenna electrode 19 is provided a signal electrode 21. Moreover, at the intersection of the X axis and Y axis of the antenna electrode 19 is provided a central signal electrode 25. A concave part is provided at the central part on the bottom face of the main body 18, and the bottom end of the central signal electrode 25 passes to the inside of this concave part. Furthermore, inside this concave part is mounted a high-frequency circuit part 32*b* and is formed a central signal electrode 25. The high-frequency circuit part 32*b* is electrically connected to a central signal electrode 25*a* formed on the face where no concave part is provided on the bottom face of the main body 18. Still more, this central signal electrode 25*a* is provided on the inside of the no-electrode part 20*b* of the grounding electrode 20, in a way to be insulated from the grounding electrode formed on about the entire face where no concave part is provided on the bottom face of the main body 18. Yet more, the central signal electrode 25*a* is electrically connected with the transmission line to be connected to a high-frequency circuit formed on the high-frequency circuit board 30, and on the high-frequency circuit board 30 covered by the concave part on the bottom face of the main body 18 is mounted a high-frequency circuit part 32*a* such as matching circuit, etc. of the antenna.

By constructing an antenna as described above, one may reduce the mounting surface area of an antenna having two isolated signal electrodes, and miniaturize the antenna by using the air space portion formed by the concave part on the bottom face of the main body 18.

The antenna in FIG. 23A to FIG. 23H indicate a case where the central signal electrode 25 of the antenna explained in FIG. 22A to FIG. 22H earlier is realized with a conductive pin 33, and also indicate a case where the signal electrode 21 is moved from the peripheral end face of the main body 18 to the inner part, and realized with a via hole 37. Even in the case where the antenna according to the present invention is embodied by such construction, one may obtain effects about equal to those of the antenna indicated in FIG. 21A to FIG. 21H and FIG. 22A to FIG. 22H.

The antenna in FIG. 24A to FIG. 24H indicate a case where the signal electrode 21 of the antenna indicated in FIG. 21A to FIG. 21H earlier is realized with a signal electrode 21*e* formed on the inside of the concave part provided at the central part on the bottom face of the main body 18. Even in the case where the antenna according to the present invention is embodied by such construction, one may obtain effects about equal to those of the antenna indicated in FIG. 21A to FIG. 21H.

The antenna indicated in FIG. 25B to FIG. 25H indicate other preferred embodiment of the present invention. This antenna is provided with an antenna electrode 19 in rectangular shape formed with a conductive material on the flat top face of the main body 18 composed of a dielectric material. At the central part on the bottom face of the main body 18 is formed a first concave part 34. This first concave part 34 shall preferably be formed from a bottom face position of the main body 18 facing the position of λ/8 in electric length from the peripheral part of the antenna electrode 19 on the X axis and Y axis. Moreover, apart from the first concave part 34, four second concave parts 35 are provided at positions axially symmetrical against the X axis and Y axis at the peripheral on the bottom face of the main body 18.

Furthermore, a grounding electrode 20 is provided in parts other than the inside of the first concave part 34 and the second concave parts 35 of the main body 18, and a signal electrode 21 is provided on the inner face of the second concave parts 35, and they are capacitively coupled with the antenna electrode 19, to exchange high-frequency signals with the antenna electrode 19. In this case, the high-frequency signals flow mainly to the direction of X axis and the direction of Y axis and, for that reason, the second concave parts 35 provided at positions apart from on the X axis and Y axis do not have any negative influences on miniaturization of the antenna. By adopting such construction for the antenna, it becomes possible to further reduce the mounting surface area of the high-frequency circuit board 30 necessary for the antenna, and to miniaturize the electronic equipment.

The antenna given in FIG. 26A to FIG. 26H indicate other preferred embodiment of the present invention. This antenna is provided with an antenna electrode 19 in rectangular shape formed with a conductive material on the flat top face of the main body 18 composed of a dielectric material. At the central part on the bottom face of the main body 18 is formed a concave part. This concave part shall preferably be formed from a bottom face position of the main body 18 facing the position of λ/8 in electric length from the peripheral part of the antenna electrode 19 on the X axis and Y axis. On about the entire area of the bottom face position of the main body 18 is disposed a grounding electrode 20. Still more, on part of the grounding electrode 20 is provided a no-electrode part 36 of the grounding electrode, and a signal electrode 21 is provided there in a state not in contact with the grounding electrode 20, and the top end part of the signal electrode 21 is electrically connected to the antenna electrode 19.

By adopting such construction, it becomes possible to secure a large space between the antenna electrode 19 and the grounding electrode 20, at the central part of the antenna electrode 19. The characteristic impedance near the central part of the antenna electrode 19 becomes larger, enabling to promote miniaturization of the antenna from the principle of stepped impedance resonator. Yet more, it also enables to miniaturize the electronic equipment, because only the convex part on the bottom face of the main body 18 is mounted on the high-frequency circuit board 30, and high-frequency circuit parts 32 can be mounted on other areas.

The antenna indicated in FIG. 27A to FIG. 27H is one realized by forming a concave part at the center of the convex part formed on the bottom face of the main body 18 of the antenna. No grounding electrode 20 is provided in the concave part. By adding such concave part, it becomes possible to constitute an open space between the ground face 30*b* and the antenna electrode 19 provided on the bottom face of the high-frequency circuit board 30. The characteristic impedance near the central part of the antenna electrode 19 becomes larger, enabling to further promote miniaturization of the antenna from the principle of stepped impedance resonator. At the same time, high-frequency circuit parts 32 can be mounted also in the top face area of the high-frequency circuit board 30 covered by this concave part, enabling to miniaturize the electronic equipment.

The antenna given in FIG. 28A to FIG. 28H indicate other preferred embodiment of the present invention. This antenna is provided with an antenna electrode 19 in rectangular shape disposed on the flat top face of the main body 18 composed of a magnetic material, and a convex part at the center on the bottom face of the main body 18. At this convex part, a grounding electrode 20 is provided on about the entire face of the part to be in contact with the top face of the high-frequency circuit board 30 at the time of mounting on this the high-frequency circuit board 30, a signal electrode 21 is disposed in an area where no grounding electrode 20 is provided on the bottom face of the main body 18, and they are electrically connected to the antenna electrode 19 the side face of the main body 18.

By adopting such construction, it becomes possible to design the characteristic impedance at the central part of the antenna electrode 19 larger than the characteristic impedance at the peripheral part of the antenna electrode 19, by constructing the peripheral part of the antenna electrode 19 with air and magnetic material, although only a magnetic material is loaded at the central part of the antenna electrode 19, regarding the area between the high-frequency circuit board 30 and the antenna electrode 19, and this enables to miniaturize the antenna. Furthermore, in the mounting on the high-frequency circuit board 30, the convex part on the bottom face of the main body 18 is the only portion to be in contact with the high-frequency circuit board 30, and this makes it possible to reduce the mounting surface area on the high-frequency circuit board 30, mount the high-frequency circuit parts 32 on part of the high-frequency circuit board 30, and to promote miniaturization of communication equipment.

Figure 29:
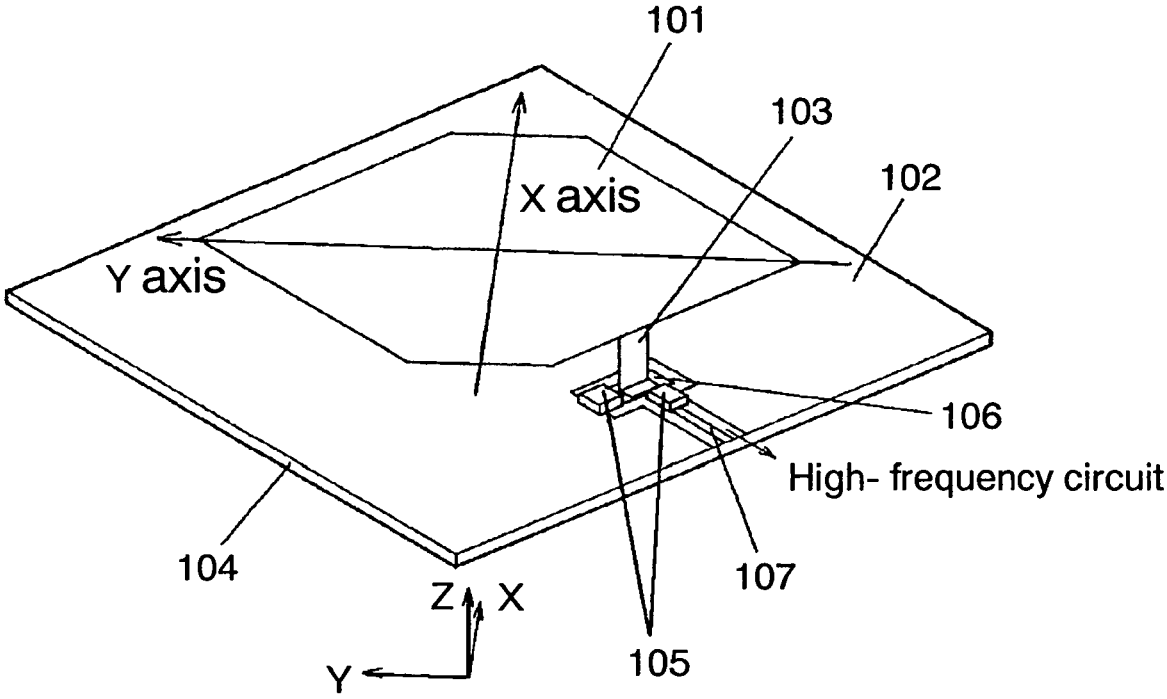
FIG. 29 is a perspective view of the antenna according to other preferred embodiment of the present invention.

FIG. 29 indicates other preferred embodiment of the present invention. This antenna in FIG. 29 is constructed with a radiation board 101 composed of a conductor plate, a grounding board 102 on the top face of the high-frequency circuit board 104 provided face to face with it, and a feeding conductor 103 provided at an end of the radiation board 101, on the straight line having an angle of 45° against the X axis and Y axis, at the intersection of the X axis and Y axis. A resonant current is produced on the X axis and Y axis of the radiation board 101, and the antenna is designed in such a way that the resonance frequency of the respective resonant currents can be controlled with the electric length on the X axis and Y axis of the radiation board 101 and that the respective electric lengths become about half wavelength of the respective resonance frequencies. In the case of this embodiment, the antenna is made to work as a circularly polarized wave antenna of single-point power feed type, by deleting corner parts on the X axis of the radiation board 101, and by displacing the phase of the resonant current on the X axis from the phase of the resonant current on the Y axis at 90°, at the intermediate frequency of the resonance frequency a on the X axis and the resonance frequency β on the Y axis. Needless to say, the antenna indicated in this embodiment can be used as an antenna working simply at frequencies.

With a conventional circularly polarized wave antenna of single-point power feed type, it was customary to match the antenna impedance by adjusting the mounting position of the feeding conductor 103 against the radiation board 101 and, for that reason, the feeding conductor 103 used to be mounted not at an end but on the inside of the radiation board 101. On the contrary, the antenna according to this embodiment is characterized in that the feeding conductor 103 is provided at an end of the radiation board 101. This makes it possible to manufacture an antenna by simply punching a flat conductor board and forming the portion of the feeding conductor 103 by press working, thus realizing an antenna which is inexpensive and with little variations of characteristics.

Figure 30A:
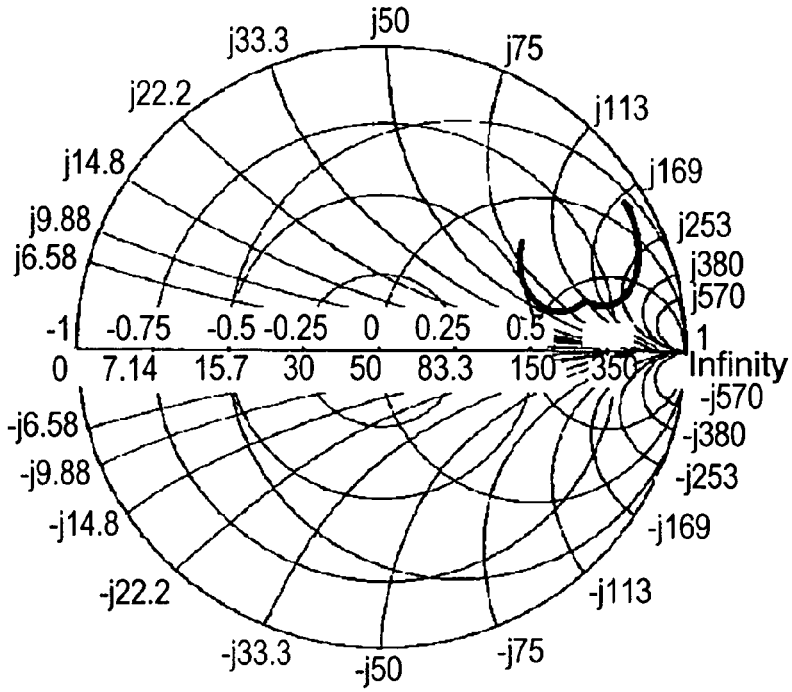
FIG. 30A to FIG. 30C are impedance characteristic chart and a radiation characteristic chart.
Figure 31A:
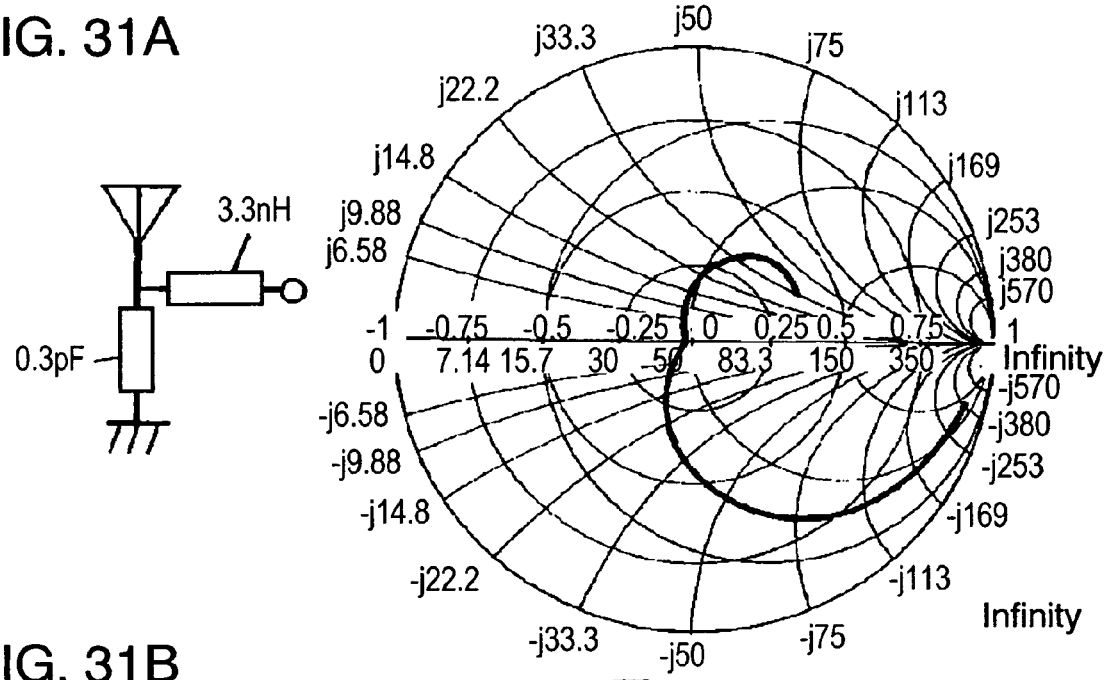
FIG. 31A to FIG. 31C are impedance characteristic chart and a radiation characteristic chart.

As described above, the antenna indicated in this embodiment, which does match antenna impedance with the connecting position of the feeding conductor 103, has an input antenna impedance much deviated from 50 Ω, as shown in FIG. 30A. For that reason, a matching circuit 105 is connected to the power feed land 106 insulated from the grounding electrode 102 to which is connected the bottom end part of the feeding conductor 103, and this enables to adjust the input antenna impedance to 50 Ω as shown in FIG. 31A and match it to the high-frequency circuit to be connected to the antenna through the power feed line 107.

Figure 30B:
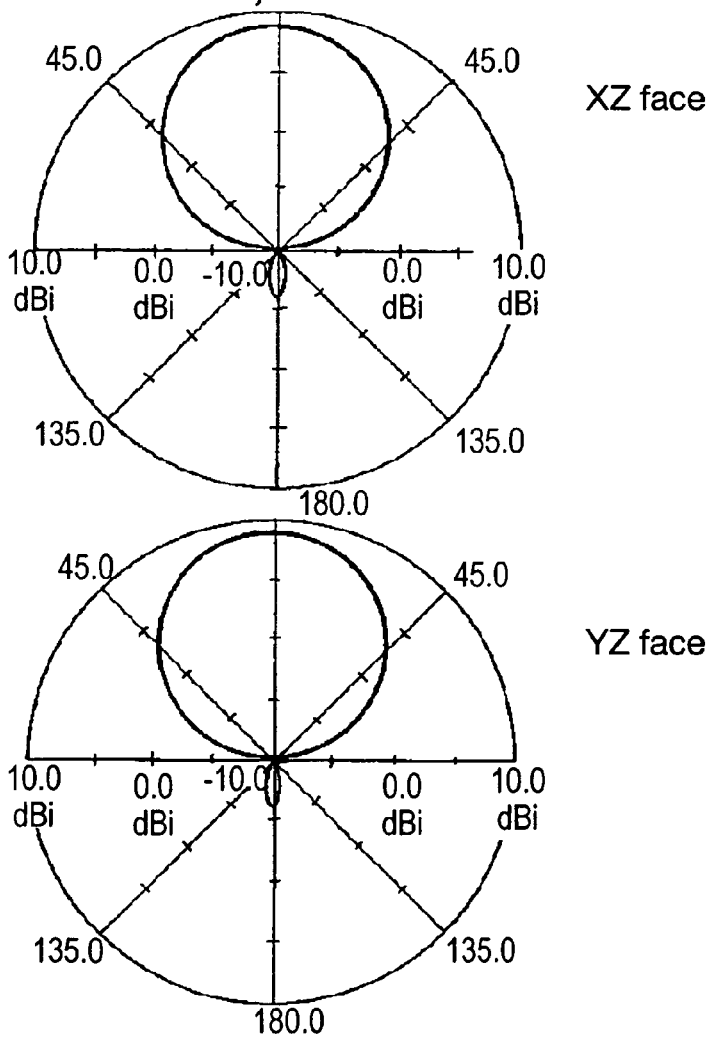
Figure 30C:
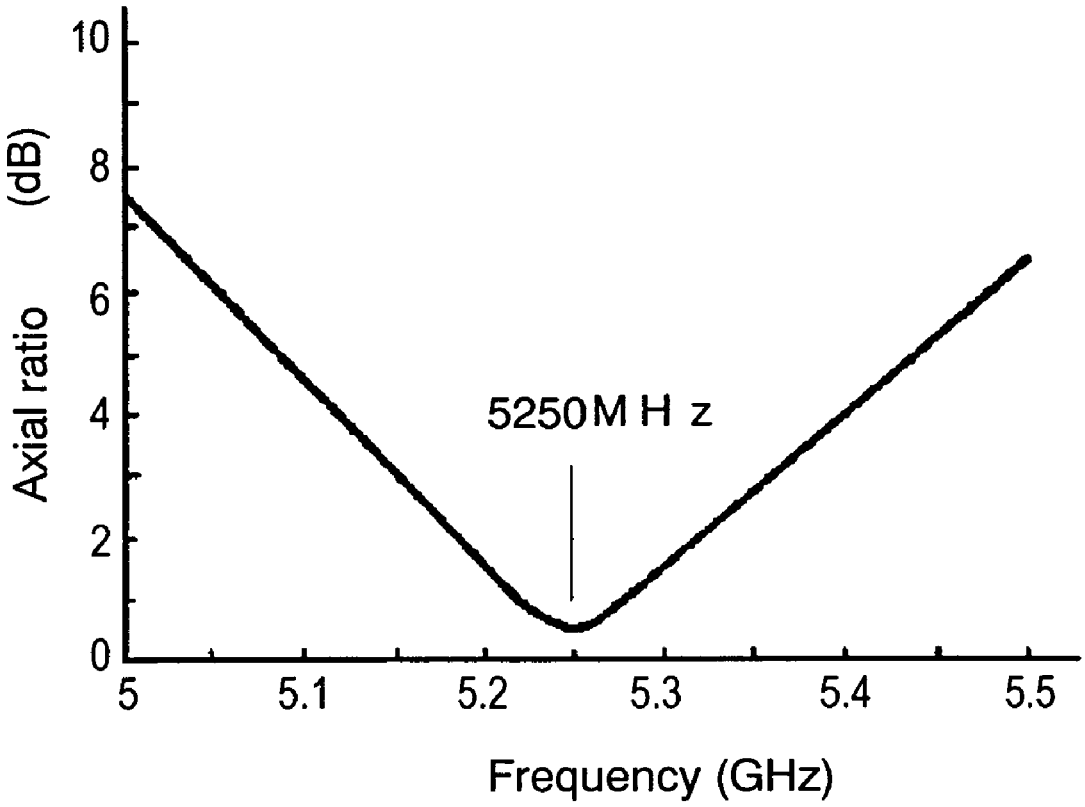
Figure 31B:
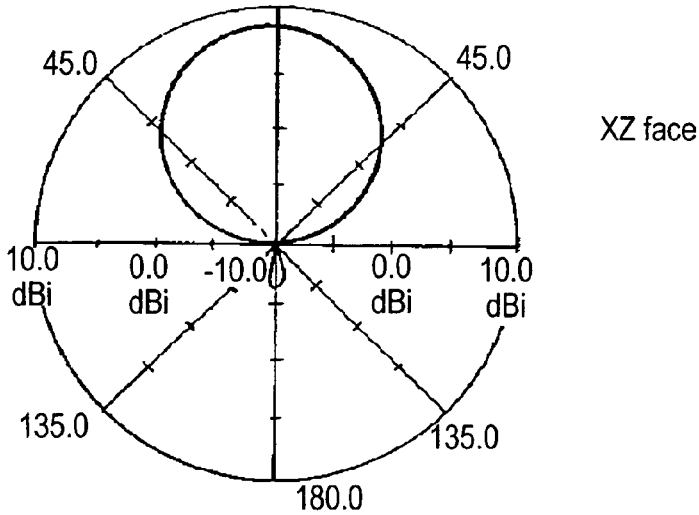
Figure 31B:
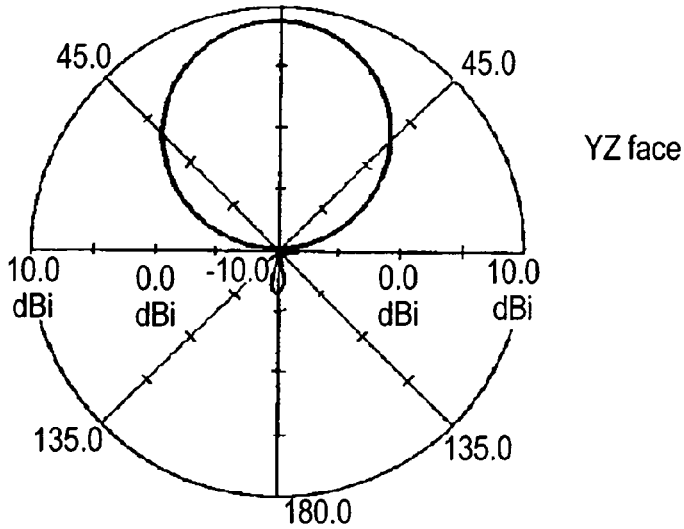
Figure 31C:
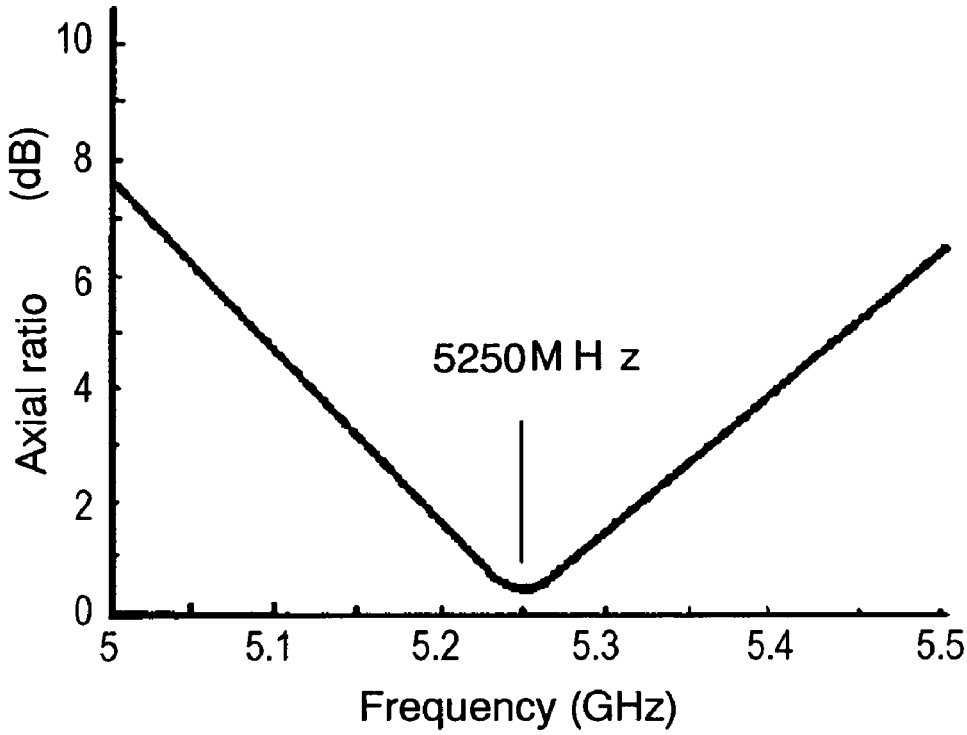

FIG. 30B and FIG. 30C indicate the radiation pattern and axial ratio characteristic before connection of matching circuit, while FIG. 31B and FIG. 31C show the radiation pattern and axial ratio characteristic after the connection of matching circuit. Those characteristics imply that radiation pattern and axial ratio characteristic do not fluctuate regardless of the presence or not of a matching circuit.

Figure 32A:
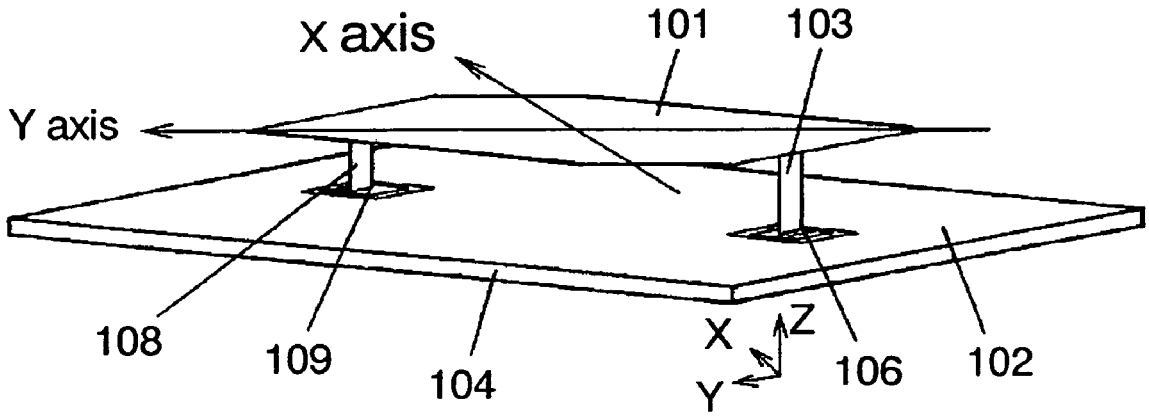
Figure 32B:
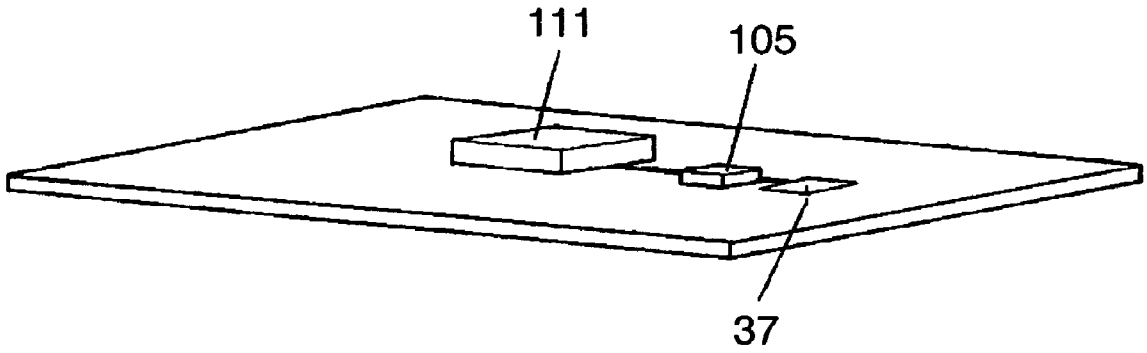
FIG. 32B is a perspective view of the bottom face of this antenna.

FIG. 32A and FIG. 32B indicate other preferred embodiment of the present invention. The antenna indicated in FIG. 32A and FIG. 32B is constructed, unlike that of FIG. 29, by providing a fixing conductor 108 at the central part of the end side opposed to the end side of the radiation board 101 where the feeding conductor 103 is provided, fixing the bottom end of the fixing conductor 108 to the fixing land 109 provided on the top face of the high-frequency circuit board 104 in the state insulated from the grounding board 102, and providing a matching circuit 105, to be connected to the bottom end of the feeding conductor 103, on the back face of the high-frequency circuit board 104 through a via hole 37.

This fixing conductor 108 is provided for the purpose of keeping the distance between the radiation board 101 and the grounding board 102 at a fixed value, so as to maintain the antenna characteristics in stable state. Considering the fact that the resonant current on the radiation board 101 is produced mainly on the X axis and Y axis, the connecting position of the fixing conductor 108 is set at a position different from on the X axis and Y axis, so that no deterioration of radiation pattern and axial ratio characteristic may take place even in case a large current flows through the fixing conductor 108.

Moreover, the reason why the matching circuit 105 is disposed on the back face of the high-frequency circuit board 104 is that, if the matching circuit 105 is disposed on the surface of the high-frequency circuit board 104 where the radiation board 101 is disposed, radiation of power is made also from the matching circuit and the feed line on the high-frequency circuit board, as the frequency of the signals fed to the antenna gets higher, leading to deterioration of the axial ratio characteristic.

Figure 33A:
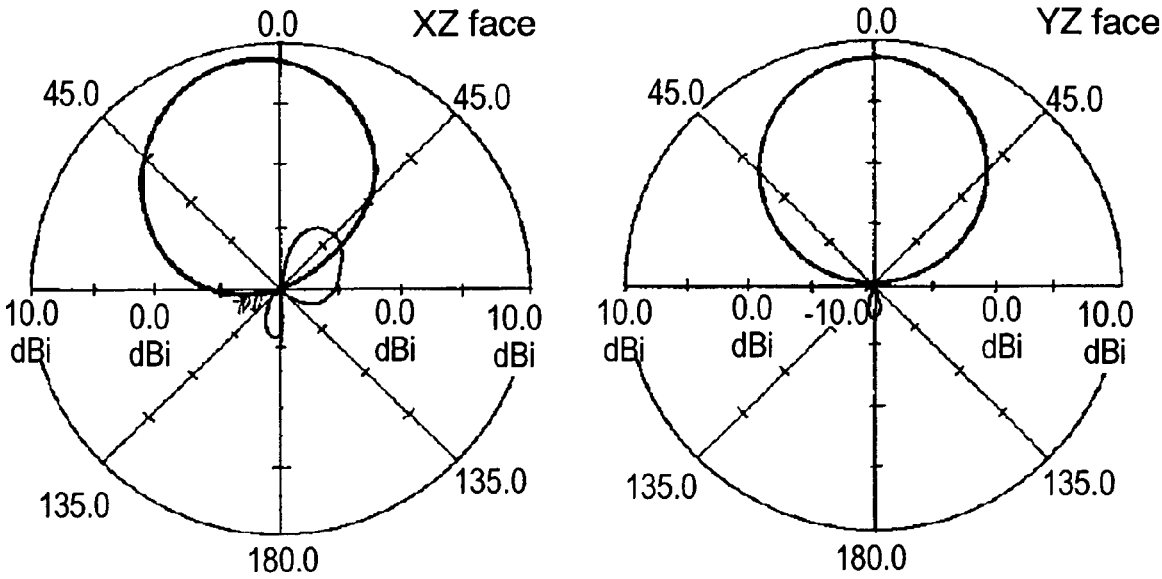
Figure 33B:
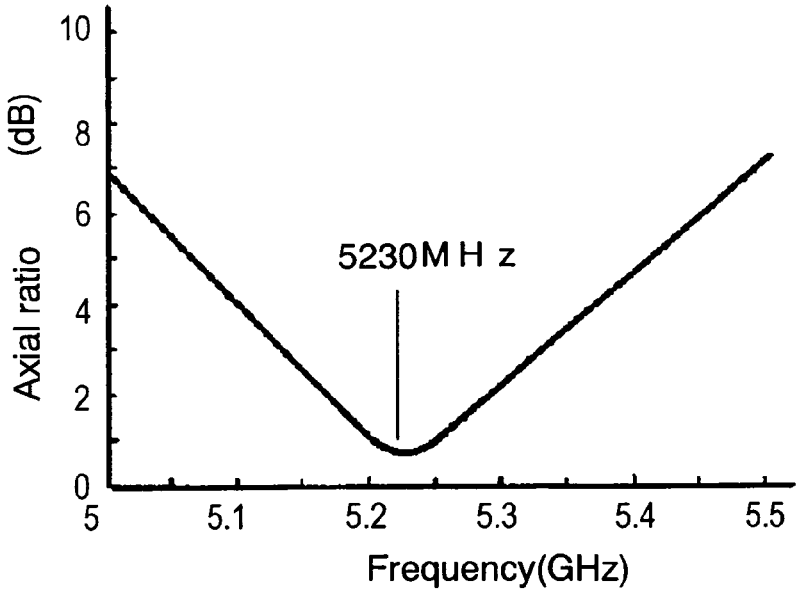

FIG. 33A indicates the radiation pattern of the antenna indicated in FIG. 32A and FIG. 32B, while FIG. 33B shows its axial ratio characteristic. From the fact that they do not show any marked change of characteristics compared with the radiation pattern and axial ratio characteristic indicated in FIG. 31A and FIG. 31B, one may understand that the presence of the fixing conductor 108 has little influences of the radiation characteristics. However, in case the gap provided for the purpose of insulating the fixing land 109 from the grounding board 102 is extremely narrow, a floating capacity is produced between the fixing land 109 and the grounding board 102 and, at higher frequencies, the fixing conductor 108 gets in a state equivalent to being connected with the grounding board 102 through the floating capacity. As a result, a large resonant current flows through the fixing conductor 108, changing the radiation pattern and greatly deteriorating the radiation gain.

Figure 38A:
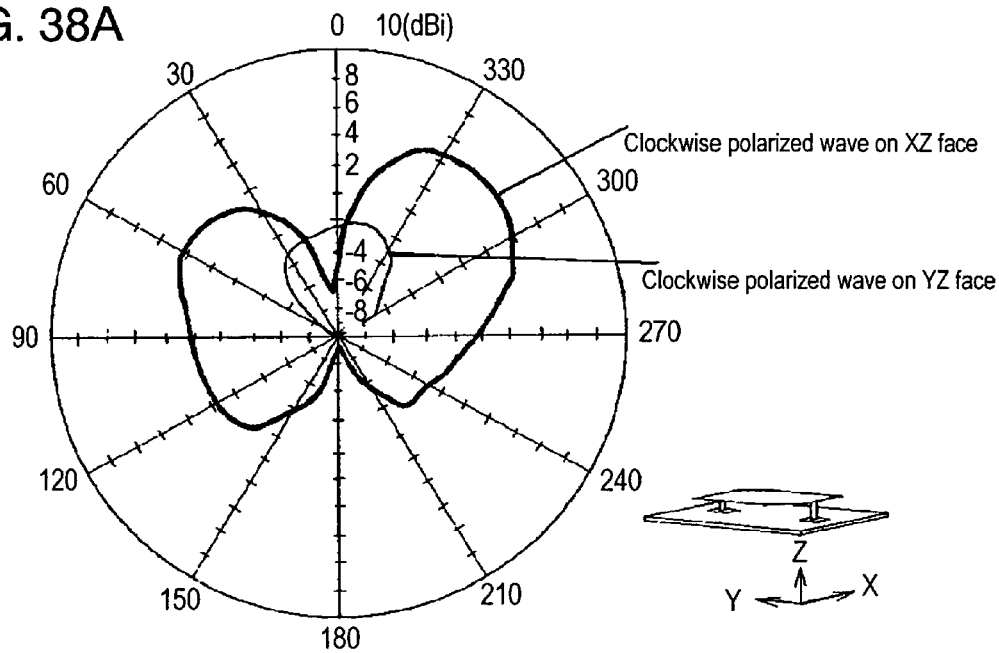
Figure 38B:
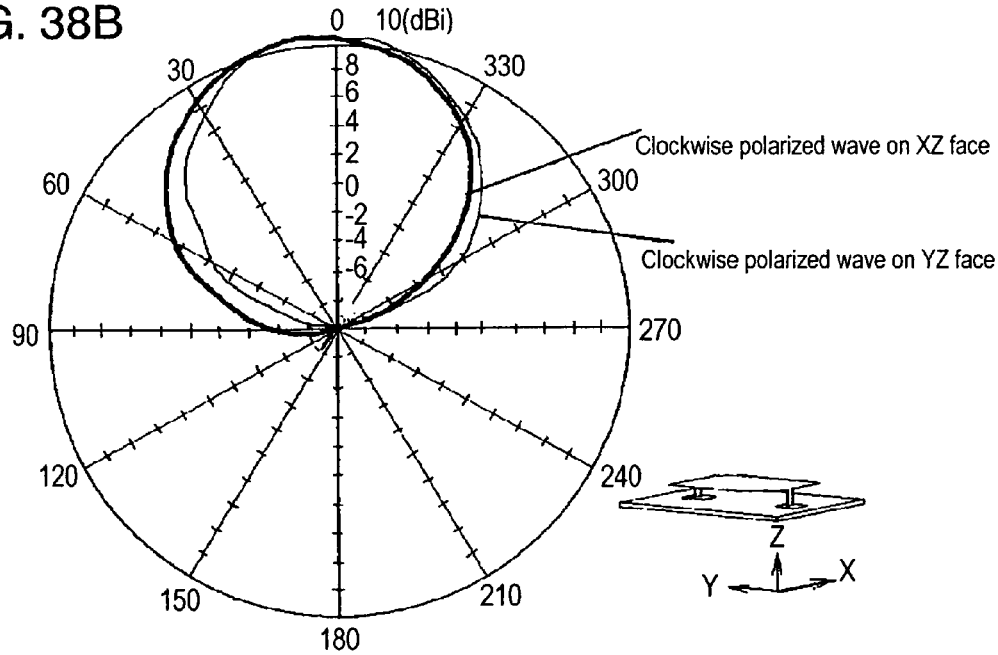
FIG. 38B is a drawing showing the radiation pattern in the case where an inductor is loaded between the between the bottom end part of the rigid conductor and the grounding board.

That state of things is indicated in FIG. 38A. From this drawing, one can see a sharp deterioration of the gain in the direction of zenith and a substantial increase of the gain in the horizontal direction. This is probably because the power radiation from the resonant current flowing through the fixing conductor 108 became the main stream, increasing the radiation gain in the direction perpendicular to the axis of the fixing conductor 108 (horizontal direction in the drawing). To prevent this from happening, an inductor (select an inductor value resonating with the floating capacity, at the working frequency) between the fixing land 109 and the grounding board 102, and this prevents production of floating capacity at the working frequency, and control deterioration of the radiation gain. The inductor to be inserted may be either a chip inductor or prepared with a circuit board pattern. That state of things is indicated in FIG. 38B. From this drawing, one can see that the radiation gain in the direction of zenith constitutes the main stream.

Figure 34A:
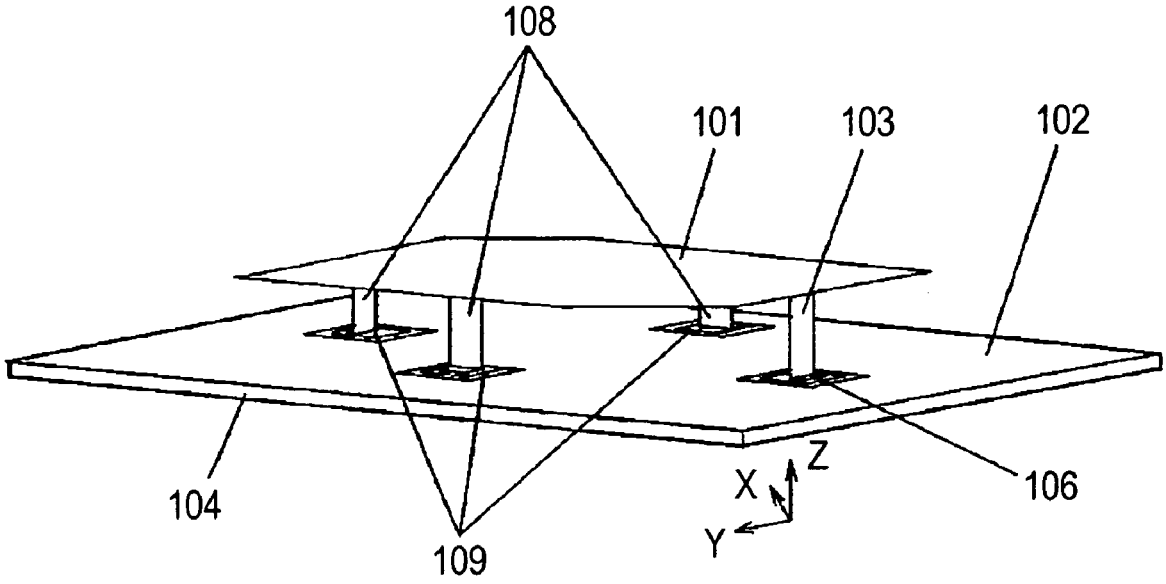
Figure 34B:
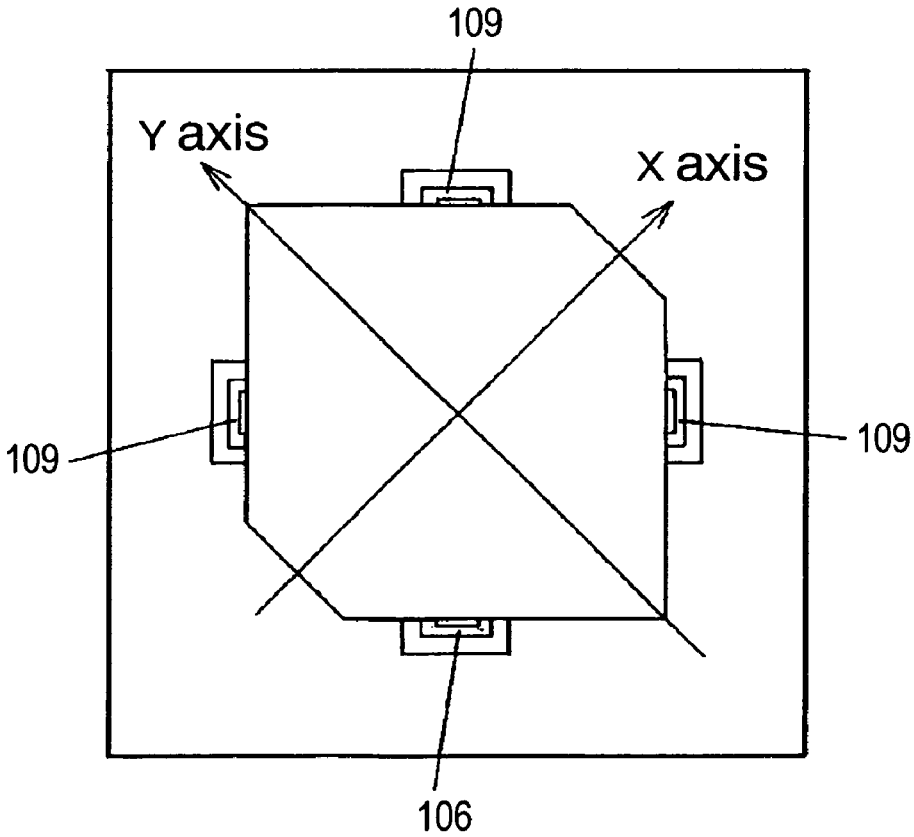
FIG. 34B is a top view of this antenna.

FIG. 34A and FIG. 34B indicate other preferred embodiment of the present invention. The antenna indicated in FIG. 34A and FIG. 34B is realized by further providing two pieces of fixing conductor 108 on the antenna of FIG. 32A and FIG. 32B. By adopting such construction, it further becomes possible to keep the distance between the radiation board 101 and the grounding board 102 at a fixed value, so as to stabilize the antenna characteristics under environments subject to vibrations.

Figure 35A:
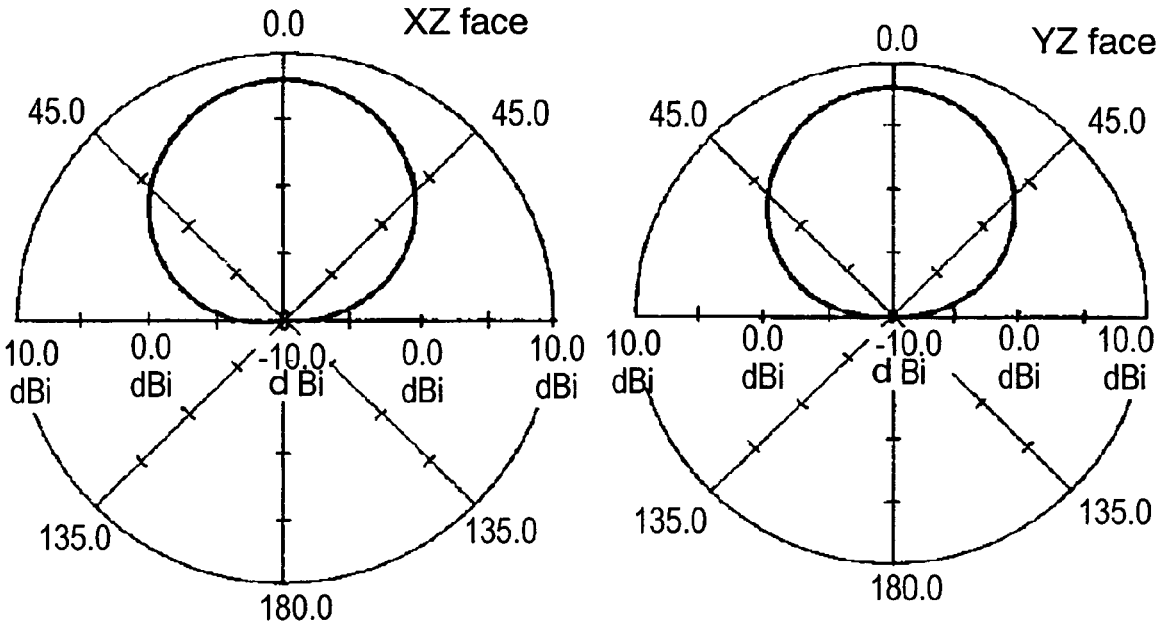
FIG. 35A to FIG. 35B are radiation characteristic chart and an axial ratio characteristic chart of the antenna according to present invention.
Figure 35B:
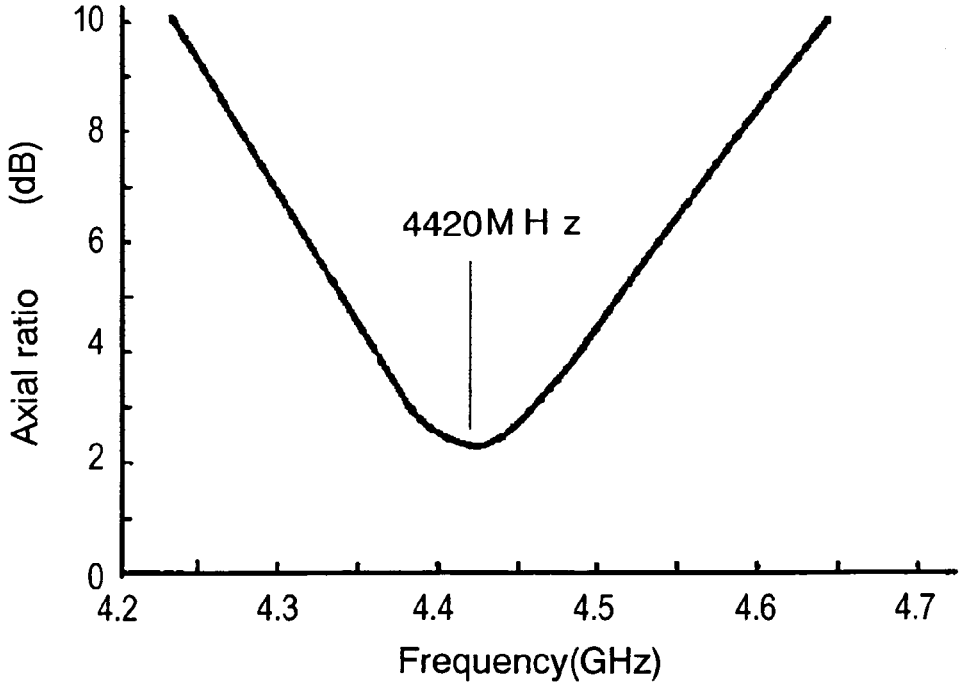

The respective fixing conductors 108 are disposed at positions different from on the X axis and Y axis where a resonant current is produced, so that the resonant current may not flow easily through the respective fixing conductors 108. FIG. 35B indicates the radiation pattern of this antenna, while FIG. 35B indicates its axial ratio characteristic. From the radiation pattern indicated in FIG. 35B, one can see that there is no marked difference from the radiation pattern in FIG. 35B. One can also see that a clockwise polarized wave antenna having its largest gain 8 dBi in the direction of zenith is realized. However, FIG. 35B implies that the lowest frequency is drifted by 750 MHz or so to the direction of lower frequency. This is due to influences of part of the resonant current flowing through the respective fixing conductors 108. This makes it possible to realize an antenna with low working frequency with the same size of the radiation board 101, and to eventually reduce the size of the radiation board 101.

Figure 36A:
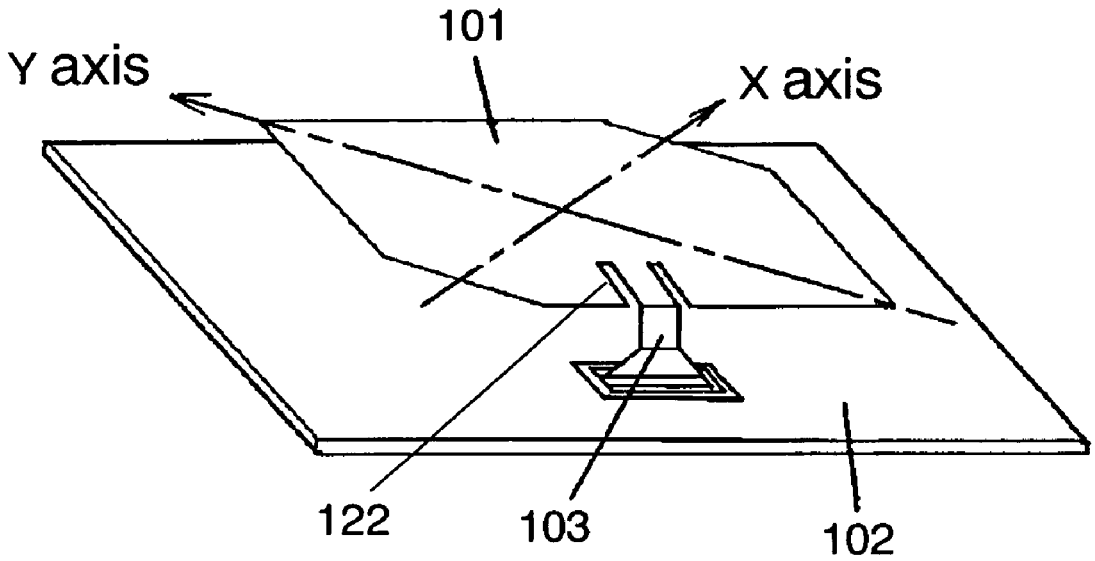
FIG. 36A is a perspective view of the antenna according to other preferred embodiment of the present invention.
Figure 36B:
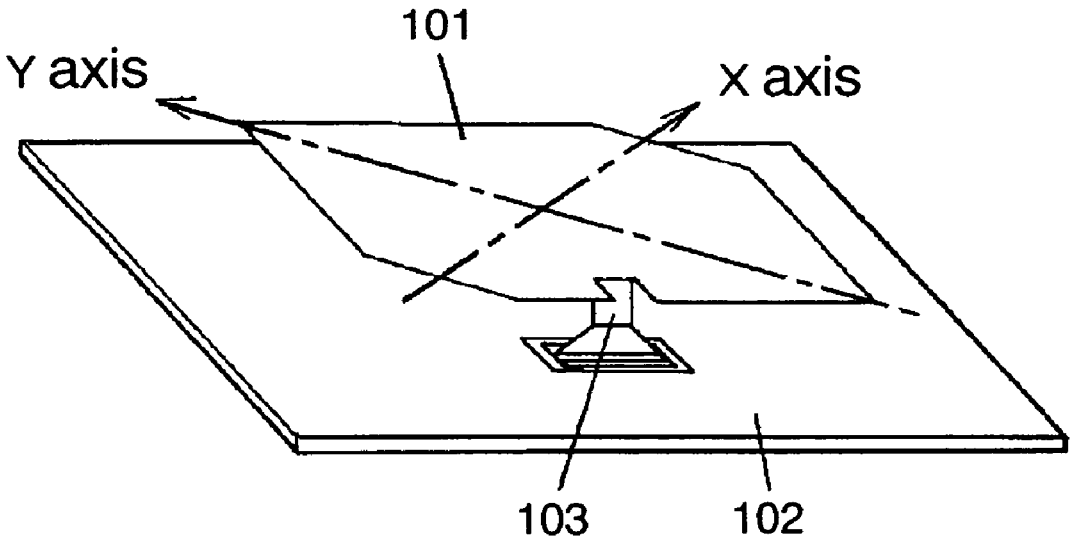
FIG. 36B is a perspective view of this antenna.

FIG. 36A and FIG. 36B indicate other preferred embodiment of the present invention. The antenna indicated in FIG. 36A matches the impedance of antenna with the shape of the radiation board 101, by making a slit 112 in the radiation board 101, making it possible to realize an antenna with high gain.

Furthermore, the antenna in FIG. 36B is realized by bending downward vertically, on the antenna in FIG. 29, one end of the radiation board 101 on the straight line having an angle of 45°, at the intersection of the X axis and Y axis, including the optional area, to use it as part of the feeding conductor 103. This provides the same effect as substantially moving the connecting position of feeding conductor 103 to radiation board 101, making it easy to match the input impedance of antenna.

Still more, the bottom end part of the feeding conductor 103 is worked in trapezoidal shape, so that the distance between the radiation board 101 and the grounding board 102 may be easily maintained constant.

This makes it possible to realize stable antenna characteristics even under environments subject to vibrations. The antenna according to this embodiment can also be manufactured by means of punching and press working from a single piece of conductor board, enabling to realize a low-cost antenna with stable antenna characteristics.

Figure 37:
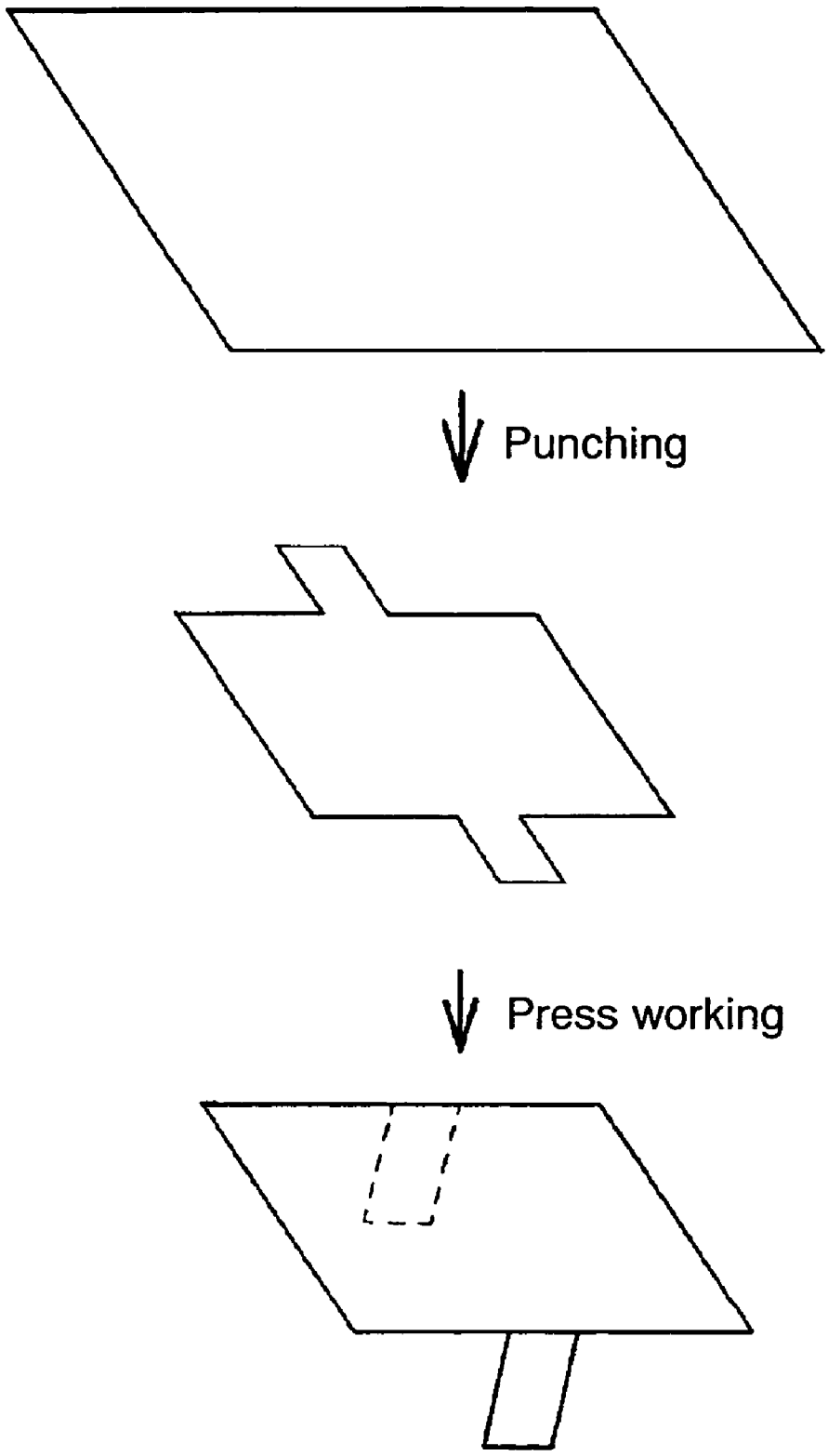
FIG. 37 is a schematic chart showing the manufacturing method of the antenna according to present invention.

FIG. 37 schematically illustrates the manufacturing method of the antenna according to the present invention. This antenna can be materialized by punching a flat conductor board into the desired shape, and bending the connecting portion between the feeding conductor and fixing conduction and the radiation board about vertically by press working.

Figure 39:
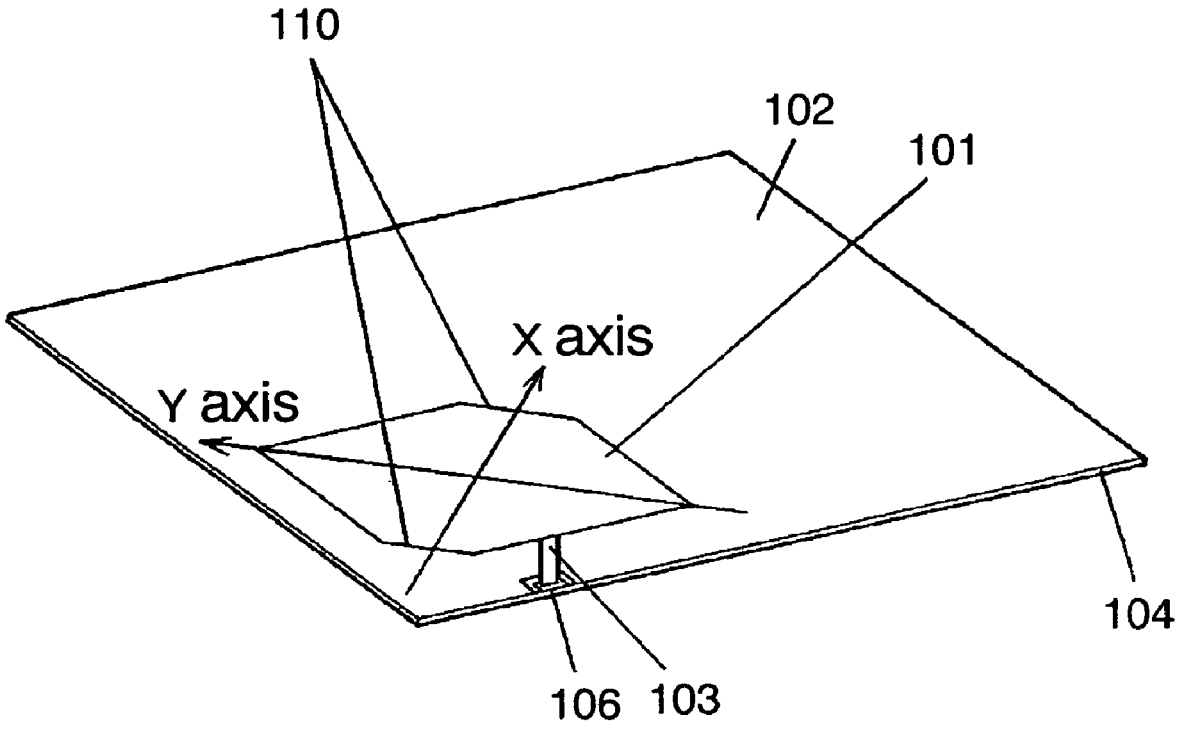
FIG. 39 is a perspective view of the top face of the antenna according to other preferred embodiment of the present invention.

FIG. 39 indicates other preferred embodiment of the present invention. The antenna indicated in FIG. 39 is realized by disposing the radiation board 101 over the grounding board 102 provided on the top face of the high-frequency circuit board 104, and disposing the feeding conductor 103 one end of which is electrically connected to the feeding land 106 formed at the top end of the grounding board 102 and the other end of which is electrically connected to the end of the radiation board 101. At corner ends on the X axis are formed notches 110 for differentiating the electric lengths on X axis and Y axis, and the radiation board 101 is disposed in such a way that one of the notches 110 may be disposed over the corner end of the grounding board 102.

Figure 40A:
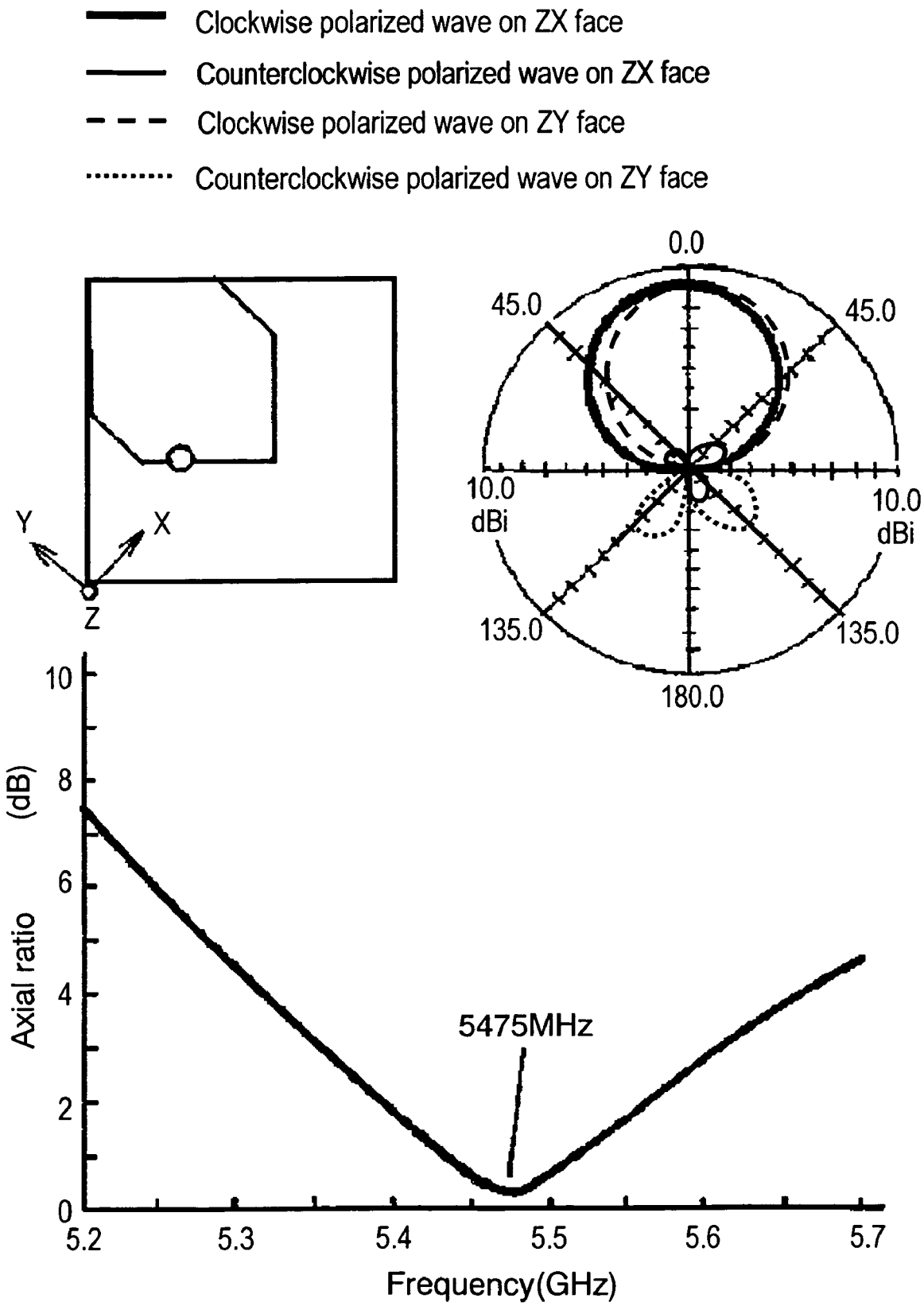
FIG. 40A to FIG. 40D are axial ratio characteristic charts and radiation characteristic charts in the case where the position of arrangement on the radiation board are changed.
Figure 40B:
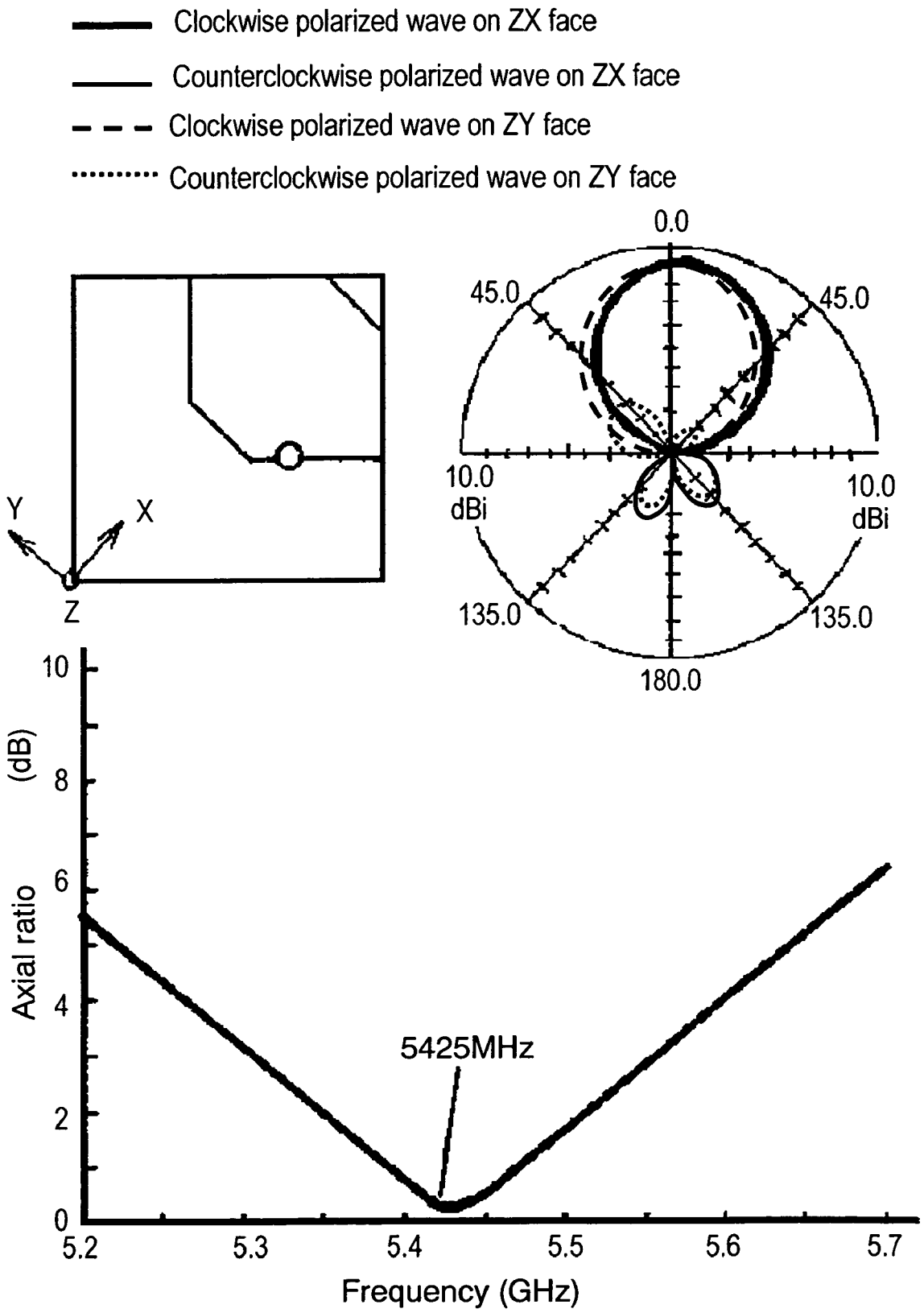
Figure 40C:
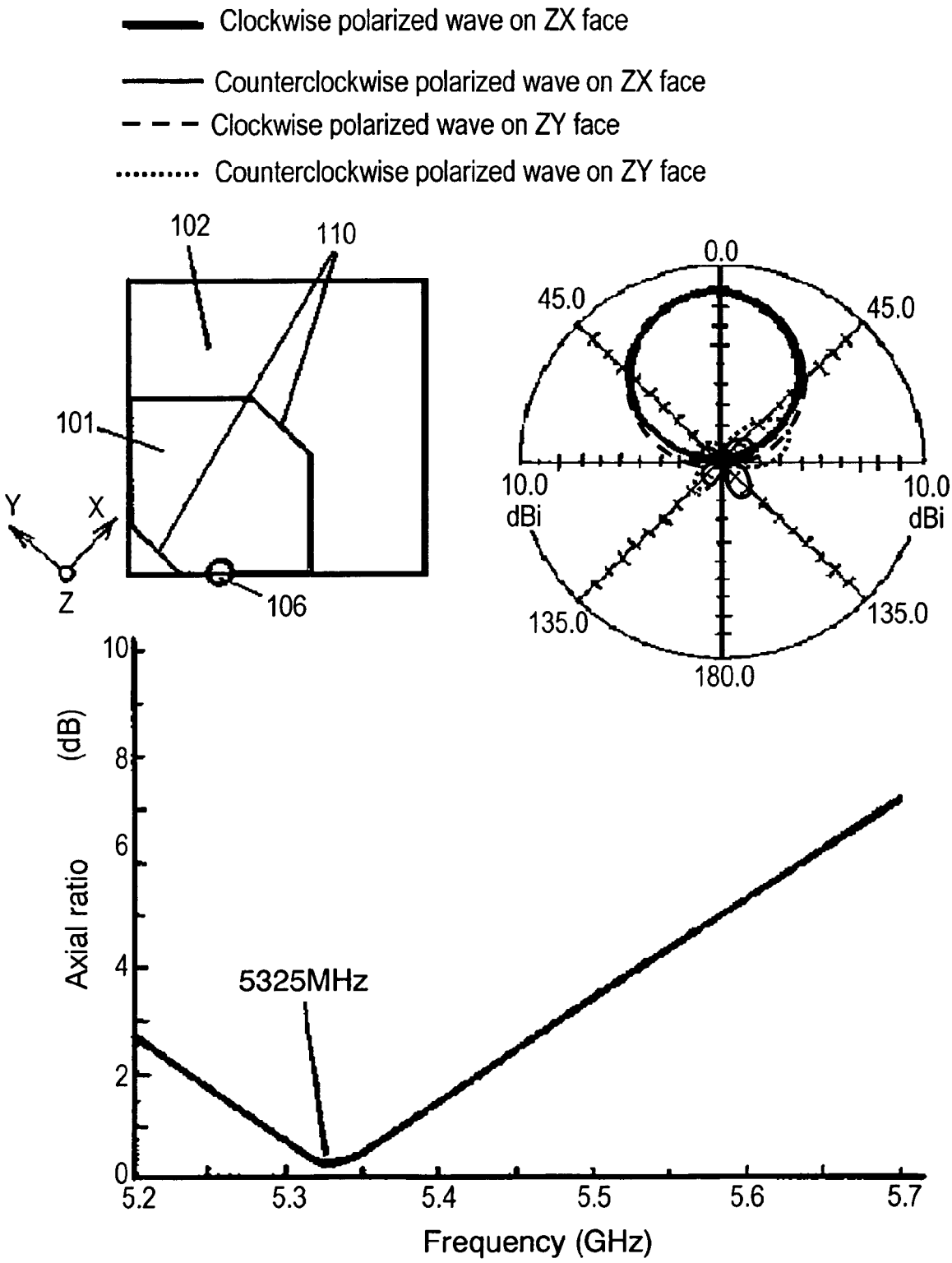
Figure 40D:
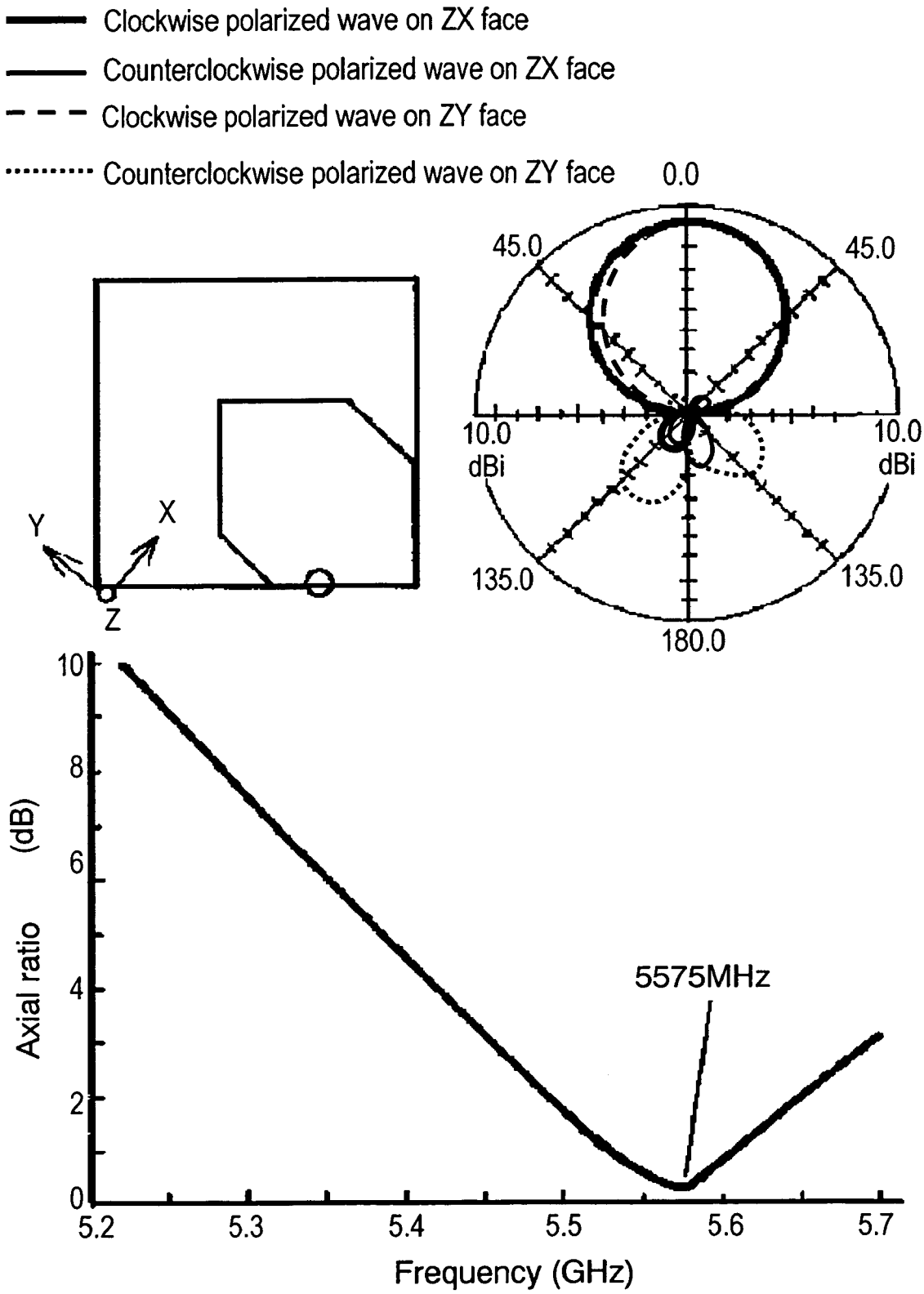

FIG. 40C indicates the axial ratio characteristic and radiation characteristic of a case where this antenna is working as circularly polarized wave antenna, by adjusting the size of the notches 110, with the size of 24 mm×24 mm for the radiation board 101 and a distance of 4 mm between the grounding board 102 and the radiation board 101. Yet more, FIG. 40A, FIG. 40B to FIG. 40D indicate the axial ratio characteristic and radiation characteristic respectively of a case where the position of arrangement of the radiation board 101 on the grounding board 102 is varied.

By comparing the frequencies at which the axial ratio at the respective antenna positions are minimized, one can see that, compared with a case where the notches 110 are disposed over the grounding board 102 as in FIG. 40B and FIG. 40C, the frequencies become higher in the case where the notches 110 are not disposed that way. Therefore, by disposing the notches 110 over the grounding board 102, it becomes possible to design in compact size an antenna working as circularly polarized wave antenna at a desired frequency. In addition, compared with a case where the notches 110 are not disposed over the grounding board 102, the radiation patterns on XY face and YZ face better agree with each other with little distortion of radiation patterns in the case where the notches 110 are disposed, enabling to realize an antenna with largest gain in the direction of zenith.

The space between the radiation board 101 and the grounding board 102 may be filled with air, or loaded with a dielectric substance or a magnetic material. Moreover, though not illustrated in FIG. 39, it may also be all right to integrate the antenna with the high-frequency circuit section by mounting a matching circuit of antenna, passive element such as filter, etc. and active element, etc. on the surface of the high-frequency circuit board 104, so as to reduce electric power loss at the feed line portion between the antenna and the high-frequency circuit.

Figure 41A:
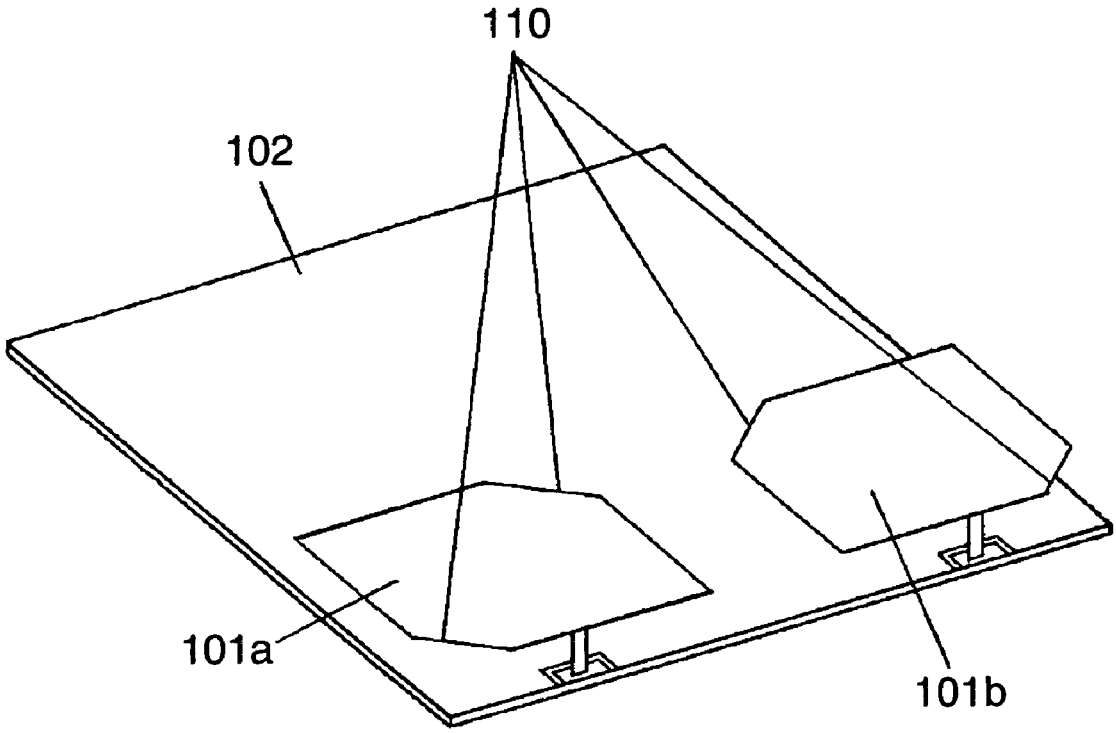
FIG. 41A and FIG. 41B are perspective views of the antenna according to other preferred embodiment of the present invention.
Figure 41B:
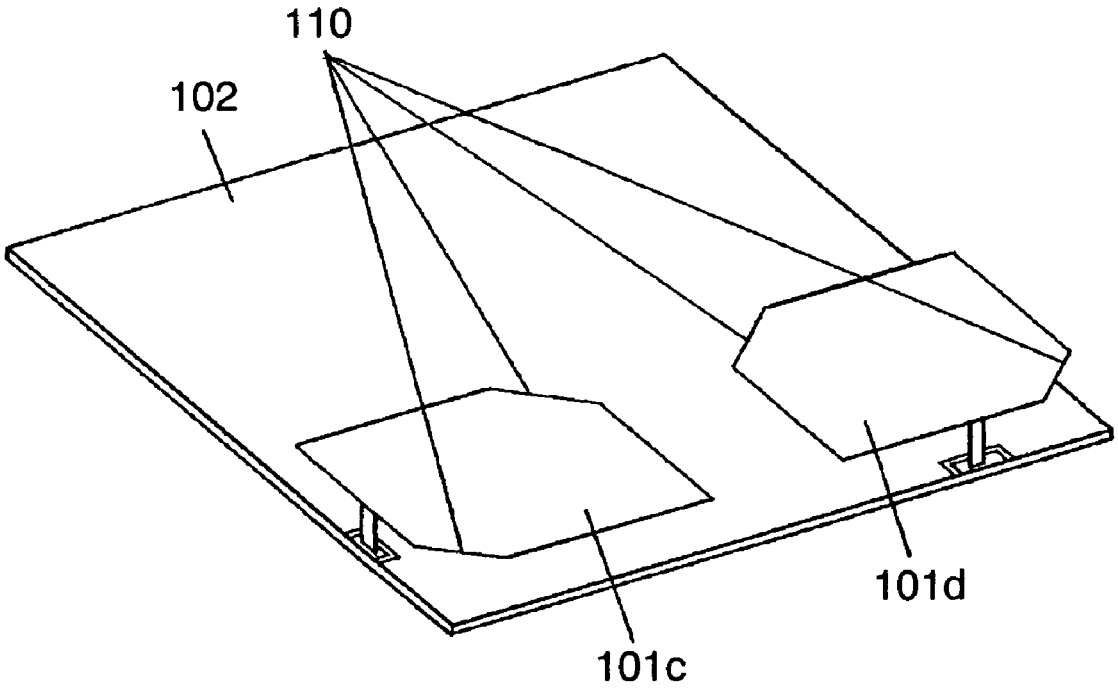

FIG. 41A and FIG. 41B indicate other preferred embodiment of the present invention. The antenna indicated in FIG. 41A has a radiation board 101*a* and a radiation board 101*b* disposed on the top face of the grounding board 102. By adjusting the size of the notches 110 in a way to make the radiation board 101*a* function for receiving clockwise polarized wave and the radiation board 101*b* function for receiving counterclockwise polarized wave, it becomes possible to receive the signals incoming from above the grounding board 102 by separating them into clockwise polarized wave and counterclockwise polarized wave, to reduce production of multipath fading.

On the other hand, the antenna in FIG. 41B indicates a case where the radiation board 101*c* and the radiation board 101*d* function for receiving clockwise polarized wave with an adjustment of size of the notches 110, which enables to construct a space diversity antenna of clockwise polarized wave antenna, and alleviate deterioration of communication quality under multipath fading environments. One of the notches 110 of the radiation board 101*a*–101*d* is disposed near over a corner part of the grounding board 102, thereby enabling to miniaturize the two radiation boards 101 as a matter of course.

Figure 42:
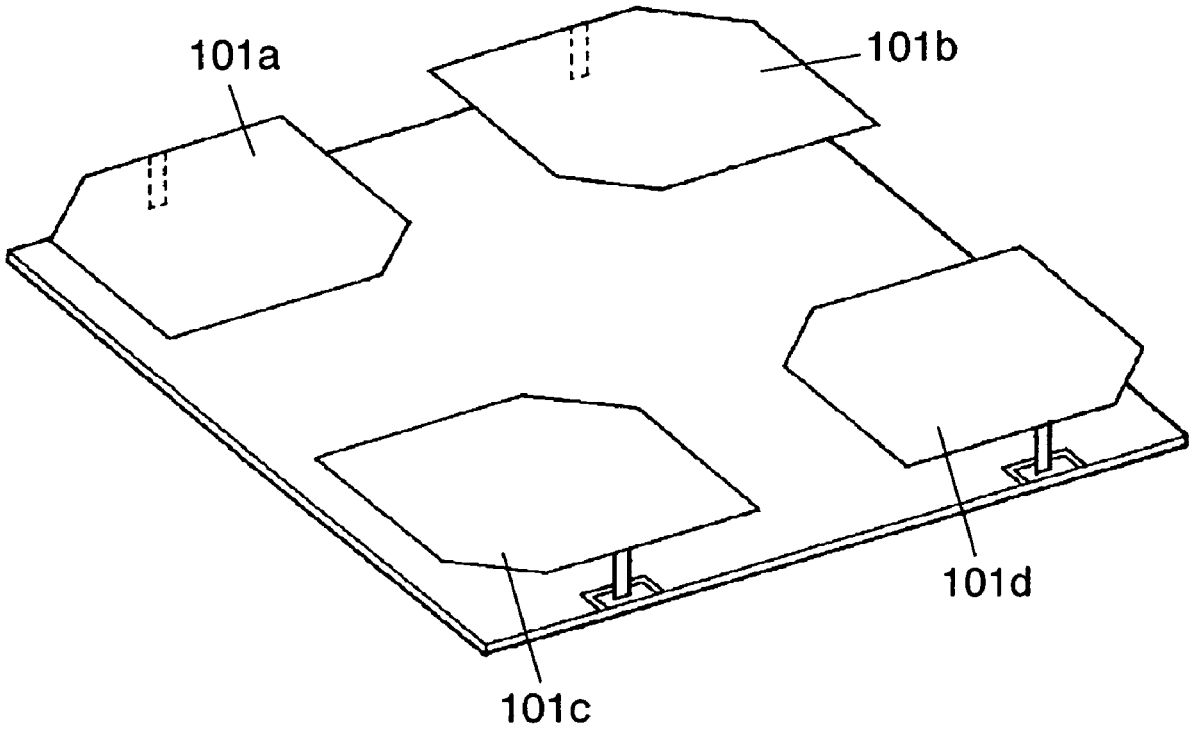
FIG. 42 is a perspective view of the antenna according to other preferred embodiment of the present invention.

FIG. 42 indicates an antenna construction in the case where the number of radiation boards is set at 4 (111*a* to 101*d*), enabling to realize a 4-branch diversity antenna or array antenna.

Figure 43A:
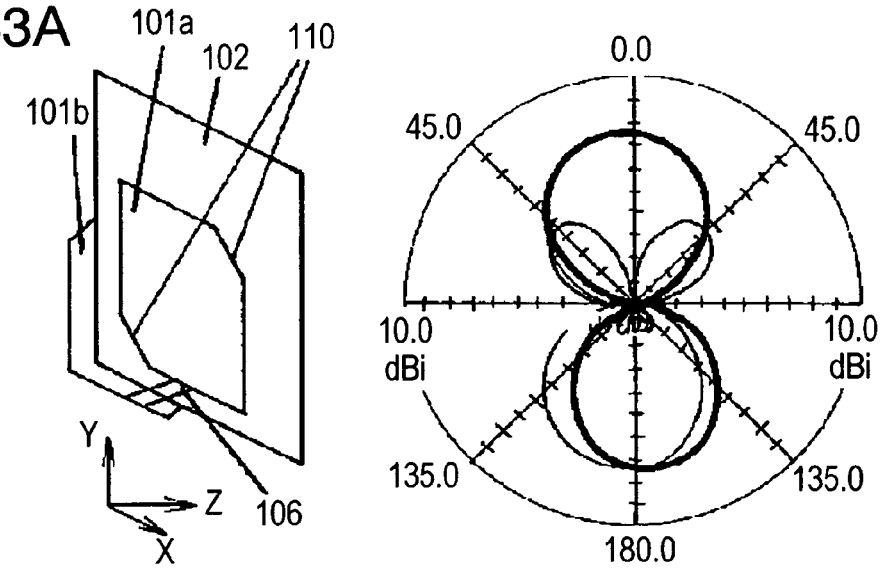
Figure 43B:
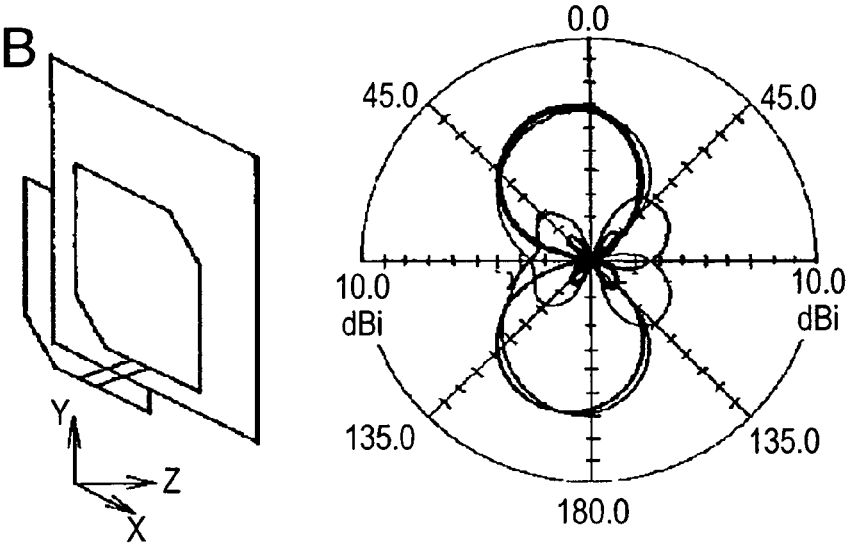
Figure 43C:
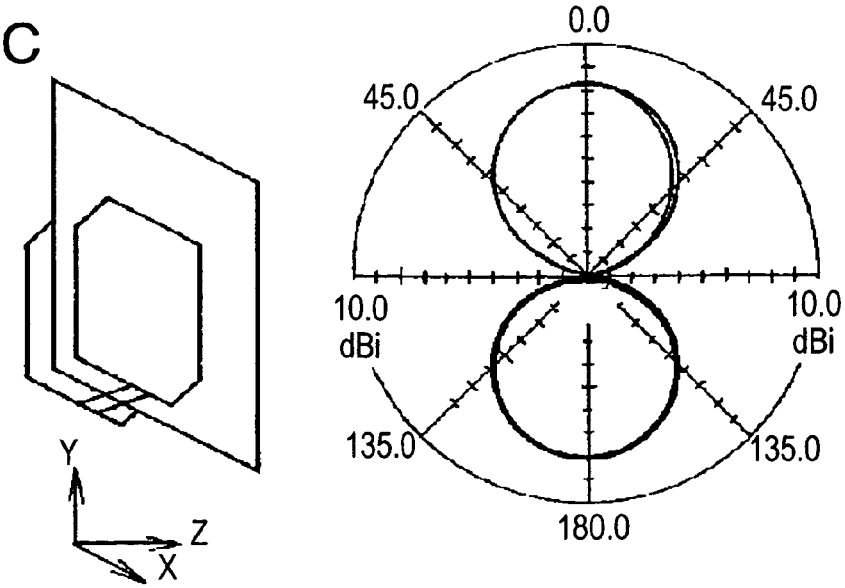
FIG. 43C, FIG. 43E and FIG. 43F are perspective views and radiation characteristic charts of other preferred embodiment of the present invention.
Figure 43D:
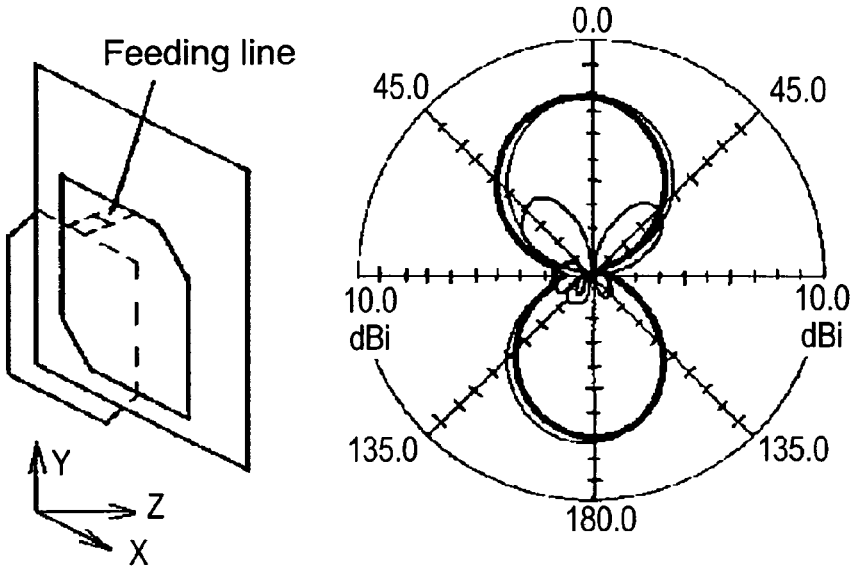
Figure 43E:
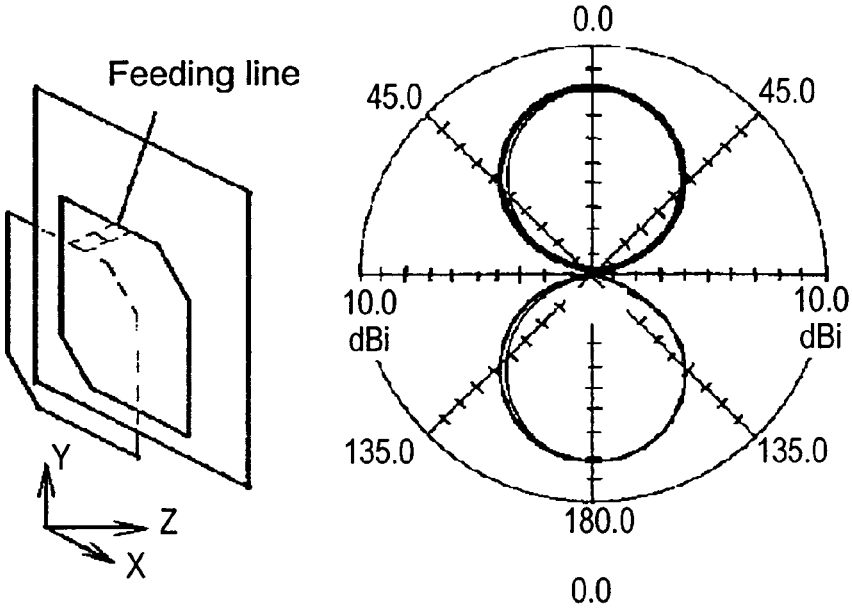
Figure 43F:
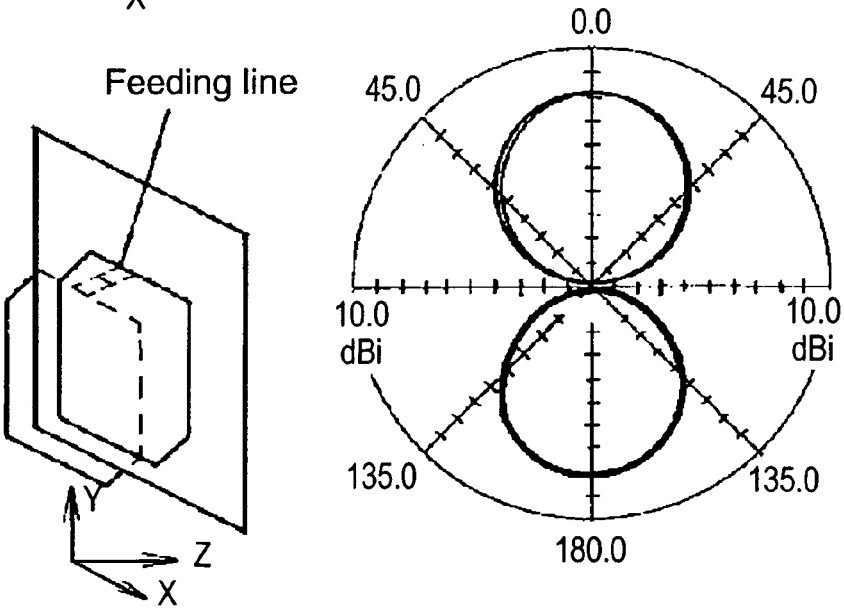

FIG. 43C, FIG. 43E and FIG. 43F indicate other preferred embodiment of the present invention. The antenna in FIG. 43A to FIG. 43F indicates changes in radiation characteristics in the case where the position of the notches 110 and of the feeding conductor 103 is changed, when the radiation boards 101*a* and 101*b* are disposed over and under the grounding board 102 respectively. One can see that, especially FIG. 43C, FIG. 43E and FIG. 43*f*, among FIG. 43A to FIG. 43F, show a gain of 6 dBi higher than that in other forms and realize symmetrical radiation patterns against the Z axis in the matter of radiation pattern.

Therefore, from the construction of the antenna according to the present invention, one can realize an angle diversity antenna having a high gain over and below the grounding board 102, and maintain a high communication quality even under multipath fading environments. While FIG. 43A to FIG. 43C describes a case where the radiation boards 101*a* and 101*b* are designed as circularly polarized wave antennas, the above statement also applies to a case where they re designed as linearly polarized wave antennas or elliptically polarized wave antennas.

Figure 44A:
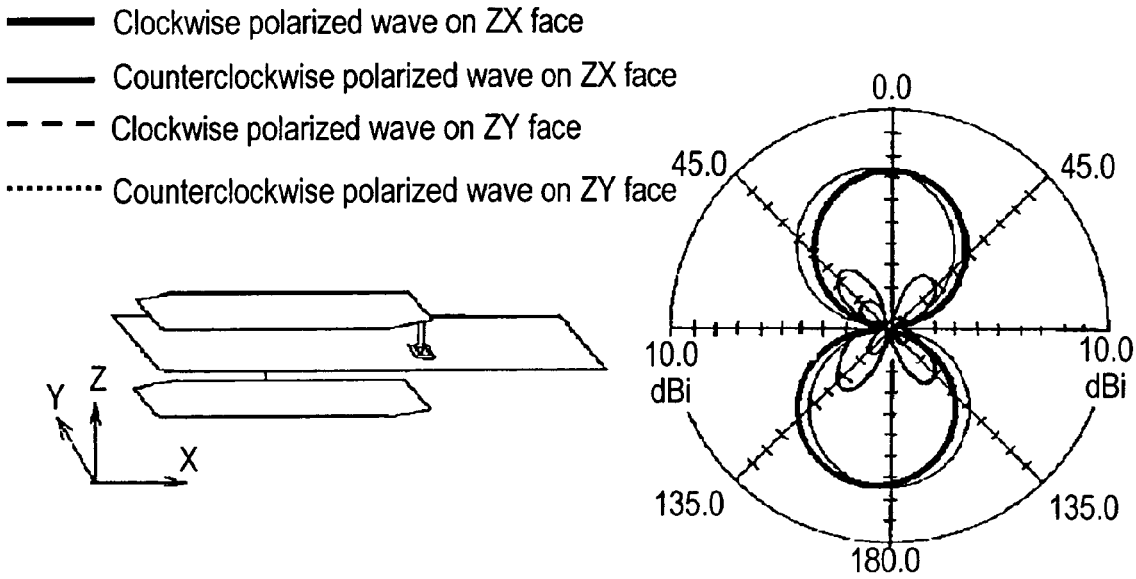
FIG. 44A to FIG. 44C are perspective views and drawings showing the radiation pattern in the case where the position of arrangement of the feed conductor is changed.
Figure 44B:
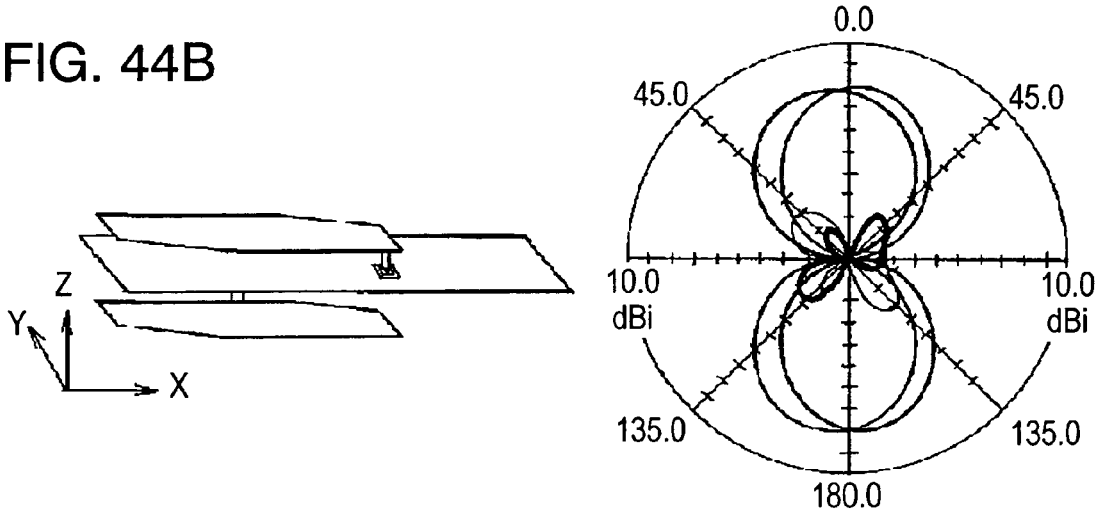
Figure 44C:
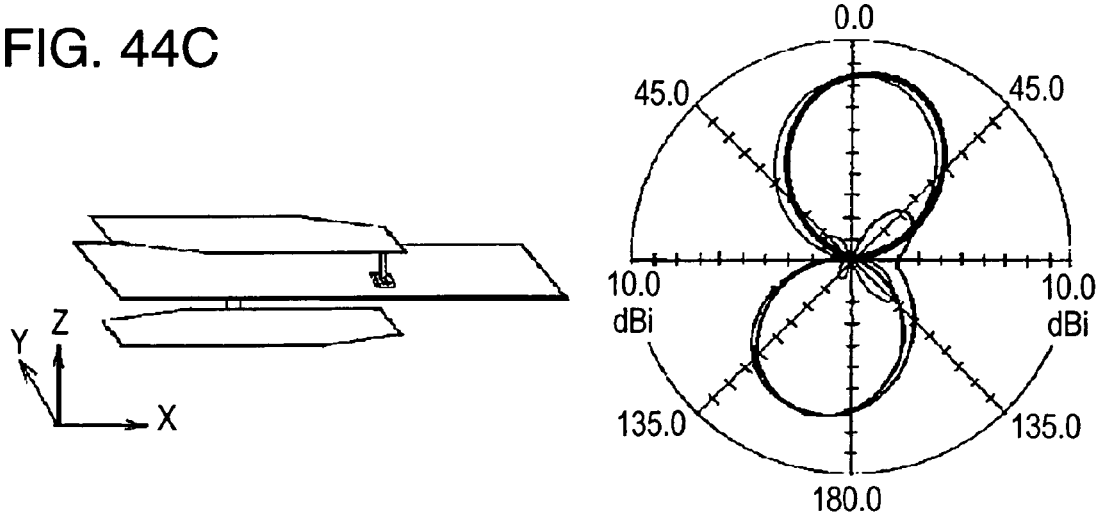

FIG. 44A to FIG. 44C indicate a radiation characteristic in the case where the position of arrangement of the feeding conductor 103 is variable depending on if the feeding conductor 103, which is disposed both above and below the grounding board 102, is disposed above the grounding board 102 or below that board. Here the largest gain 6 dBi is not realized in upward and downward directions, and the direction of largest gain inclines from the direction of Z axis, showing a tendency for distorted radiation pattern. Therefore, the feed conductors disposed above and below against the grounding board of the antenna which is an embodiment of the present invention described in FIG. 43C, FIG. 43E and FIG. 43F are disposed at about one same position above and below the grounding board.

Figure 45:
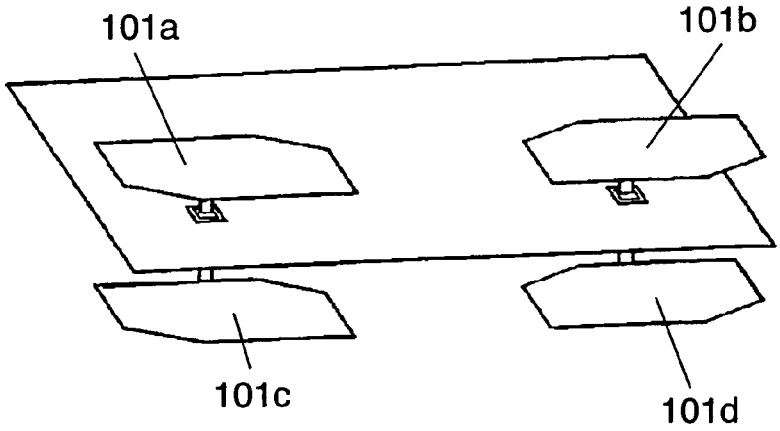
FIG. 45 is a perspective view of the antenna according to other preferred embodiment of the present invention.

The antenna indicated in FIG. 45 is one the number of radiation boards of which is increased to four (101*a* to 101*d*), thereby enabling to materialize an angle diversity antenna capable of receiving the signals incoming from above and below the grounding board 102 by separating them into clockwise polarized wave and counterclockwise polarized wave, and securing a good communication quality under multipath fading environments.

Figure 46A:
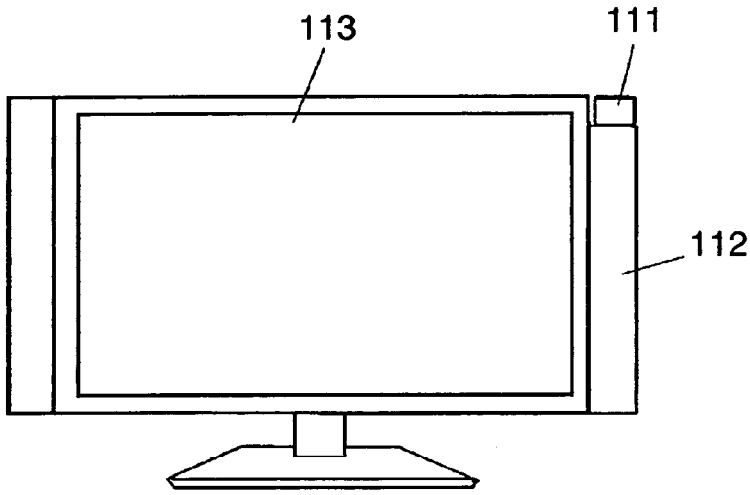
Figure 46B:
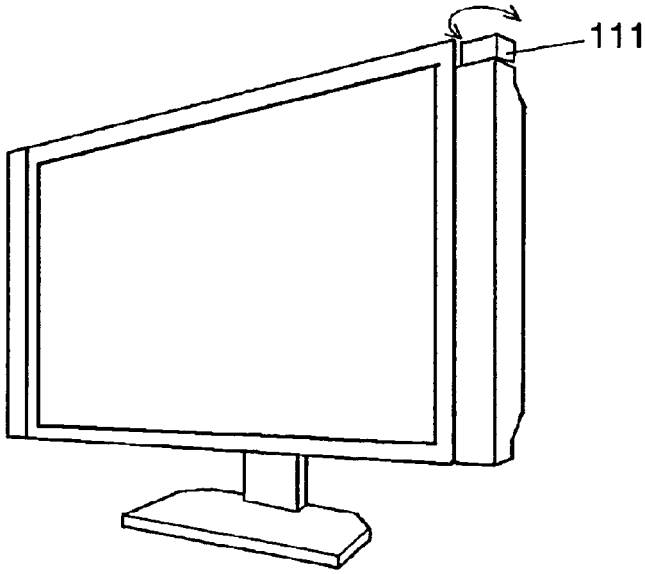
FIG. 46B is a perspective view of this electronic equipment.

FIG. 46A and FIG. 46B indicate other preferred embodiment of the present invention, and show an image receiving unit 113 on which is loaded the antenna according to the present invention. At the top of the speaker box 112 is disposed an antenna unit 111 in which is incorporated the antenna according to the present invention, and this image receiving unit 113 has a mechanism for changing the direction of the antenna unit 111, to as to realize optimal communication characteristics against the electric wave environments which are variable depending on the installed position, etc. of the image receiving unit 113. This makes it possible to make the direction of maximum gain of the antenna according to the present invention agree with the direction of the incoming waves, to improve the receiving level. The adjustment of direction of the antenna unit 111 may be made manually by referring to the indication of signal reception level displayed on the image receiving unit, for example, or by monitoring the receiving electric power of the antenna with a detecting circuit provided just under the antenna and by automatically controlling the direction of the antenna unit 111 by software based on the results of monitoring.

The antenna according to the present invention comprises an antenna electrode and a grounding electrode provided in a way to face the antenna electrode, the antenna electrode being different in length at the X axis and the Y axis orthogonal or about orthogonal to it, and enables to construct a broad-band antenna by utilizing the property of having two different resonance characteristics on a single antenna by simply differentiating the length of the X axis and Y axis of the antenna electrode, and synthesizing those resonance characteristics.

Moreover, the antenna according to the present invention is an antenna comprising a grounding board composed of a conductor plate, and a radiation board composed of a conductor plate provided facing this grounding board, this radiation board being different in length at its X axis and Y axis either orthogonal or about orthogonal to it and at about half wave of the working frequency range. Furthermore, the antenna according to the present invention is an antenna constructed by having a feed conductor, which is provided at an end part on straight lines having an angle of about 45° against the X axis and Y axis at their intersection, and bent condownward in a way to have an angle of about 90° against the radiation board.

This makes it possible to realize an antenna by processing a flat conductor board into a proper shape by either punching or etching and bending the feed conductor portion by means of press working, etc., and realize an inexpensive and high-quality antenna with simplification of the antenna manufacturing method.

Still more, the antenna according to the present invention enables to realize reduction of antenna size, by optimizing the position of arrangement of the radiation board against the grounding board and the position of arrangement of the feed conductor.

Yet more, the electronic equipment according to the present invention comprises a circuit board and an antenna mounted on the surface of this circuit board, said antenna comprising a main body having a flat part, an antenna electrode provided on the flat part of this body, and a grounding electrode provided on the main body portion facing this antenna electrode, said antenna electrode being constructed to be different in length at the X axis from the Y axis orthogonal or about orthogonal to this X axis, said circuit board further comprising a signal electrode, wherein this signal electrode is made to face the no-electrode part of grounding electrode provided on the grounding electrode of said antenna.

Since the antenna impedance can be controlled freely with a change in the position of the no-electrode part of the grounding electrode facing the signal electrode of the circuit board, it becomes possible to design antennas in broad band by a simple method of changing the mounting position of the antenna.

The antenna according to the present invention and the electronic equipment using the same provide the effect of producing a broad-band antenna by utilizing the property of having two different resonance characteristics on a single antenna, and are useful as an antenna and an electronic equipment using the same.

What is claimed is:

1. An antenna comprising a main body having a flat part, an antenna electrode provided on the flat part of this body, a signal electrode electrically connected to this antenna electrode, and a grounding electrode provided in a way to face said antenna electrode of the main body, said antenna electrode being different in length at the X axis from the Y axis orthogonal or about orthogonal to it, wherein the clearance between the antenna electrode and the grounding electrode is variable, and this clearance between the antenna electrode and the grounding electrode in the area around the central part (intersection of X axis and Y axis) of the antenna electrode is larger than that in the peripheral area of the antenna electrode.

2. An antenna as defined in claim 1, wherein the clearance between the antenna electrode and the grounding electrode is widened at the point of about ⅛ in electric length from the peripheral part of the antenna electrode.

3. An antenna as defined in claim 1, wherein the bottom face of the main body is mounted on the top face of the high-frequency circuit board as mounting face, a convex part is formed on said bottom face of the main body, on the surface of this convex part is formed about the entire part of the grounding electrode, and a high-frequency circuit is mounted in the area other than the area where the convex part on said bottom face of the main body on the top face of said high-frequency circuit board is mounted on said high-frequency circuit board.

4. An antenna comprising a main body having a flat part, an antenna electrode provided on the flat part of this body, a signal electrode electrically connected to this antenna electrode, and a grounding electrode provided in a way to face said antenna electrode of the main body, said antenna electrode being different in length at the X axis from the Y axis orthogonal or about orthogonal to it, wherein the main body between the antenna electrode and the grounding electrode is composed of either a dielectric material, a magnetic material or a mixture of dielectric material and magnetic material, the value obtained by dividing the relative permeability by the relative permittivity of the main body varies at an optional point in the area from the peripheral part of the antenna electrode to the central part of the antenna electrode, and the value obtained by dividing the relative permeability by the relative permittivity of said main body in the area around the central part is made larger than the value obtained by dividing the relative permeability by the relative permittivity of the main body in the peripheral area of the antenna electrode.

5. An antenna as defined in claim 4, wherein the value obtained by dividing the relative permeability by the relative permittivity of the main body is made larger at the point of about ⅛ in electric length from the peripheral part of the antenna electrode.

6. An antenna comprising a main body having a flat part, an antenna electrode provided on the flat part of this body, a signal electrode electrically connected to this antenna electrode, and a grounding electrode provided in a way to face said antenna electrode of the main body, said antenna electrode being different in length at the X axis from the Y axis orthogonal or about orthogonal to it, having 4 slits axially symmetrical against X axis and Y axis on the antenna electrode, and constructed in such a way that 2 sides of the respective slits get about in contact with straight lines orthogonal to the X axis and Y axis at an optional point in the area from the peripheral part of the antenna electrode to the central part of the antenna electrode.

7. An antenna as defined in claim 6, constructed in such a way that 2 sides of the respective slits get about in contact with straight lines orthogonal to the X axis and Y axis at the point of about ⅛ in electric length from the peripheral part of the antenna electrode.

8. An antenna comprising a main body having a flat part, an antenna electrode provided on the flat part of this body, a signal electrode electrically connected to this antenna electrode, and a grounding electrode provided in a way to face said antenna electrode of the main body, said antenna electrode being different in length at the X axis from the Y axis orthogonal or about orthogonal to it, wherein the bottom face of the main body is mounted on the top face of the high-frequency circuit board as mounting face, a concave part is formed on said bottom face of the main body, a no-electrode part of grounding electrode is provided inside this concave part, and a high-frequency circuit is mounted in the area covered by the concave part on said bottom face of the main body on the top face of said high-frequency circuit board.

9. An antenna as defined in claim 8, wherein a concave part is provided, on the bottom face of the main body, at a position of about $\lambda/8$ in electric length from the peripheral part of the main body.

10. An antenna as defined in claim 8, wherein the bottom face of the main body is mounted on the top face of the high-frequency circuit board as mounting face, a convex part is formed on said bottom face of the main body, on the surface of this convex part is formed about the entire part of the grounding electrode, in part of the area at the bottom face of the main body to be in contact with said high-frequency circuit board is formed a concave part, inside this concave part is provided a no-electrode part of the grounding electrode, and a high-frequency circuit is mounted in the area other than the area where the convex part on said bottom face of the main body on the top face of said high-frequency circuit board is mounted on said high-frequency circuit board and the area covered by the concave part, wherein the value obtained by dividing the relative magnetic permeability by the relative permittivity of the base material of the main body is no larger than 1.

11. An antenna as defined in claim 8, wherein the signal electrode and/or the central signal electrode are constructed with a conductive pattern formed inside the concave part facing the antenna electrode, in a way to perform transmission and reception of high-frequency signals by capacity coupling.

12. An antenna comprising a main body having a flat part, an antenna electrode provided on the flat part of this body, a signal electrode electrically connected to this antenna electrode, and a grounding electrode provided in a way to face said antenna electrode of the main body, said antenna electrode being different in length at the X axis from the Y axis orthogonal or about orthogonal to it, wherein the bottom face of the main body is mounted on the top face of the high-frequency circuit board as mounting face, a convex part is formed on said bottom face of the main body, on the surface of this convex part other than the area to be in contact with the high-frequency circuit board is formed about the no-electrode part of the grounding electrode, and a high-frequency circuit is mounted in the area other than the area where the convex part on said bottom face of the main body on the top face of said high-frequency circuit board is mounted on said high-frequency circuit board.

13. An antenna as defined in either one of claims 1, 4, 6, 8, or 12, wherein the electric length on the X axis and Y axis are set for approximately half wave lengths.

14. An antenna as defined in either one of claims 1, 4, 6, 8, or 12, wherein a central signal electrode is provided near the intersection of X axis and Y axis, and this central signal electrode electrically connects between the antenna electrode and a high frequency circuit.

* * * * *